US011358401B2

(12) United States Patent
Amano et al.

(10) Patent No.: US 11,358,401 B2
(45) Date of Patent: Jun. 14, 2022

(54) POST-PROCESSING DEVICE AND PRINTING SYSTEM

(71) Applicant: SEIKO EPSON CORPORATION, Tokyo (JP)

(72) Inventors: Yusaku Amano, Matsumoto (JP); Shota Sakagami, Matsumoto (JP); Yu Tsumuraya, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/102,782

(22) Filed: Nov. 24, 2020

(65) Prior Publication Data

US 2021/0155020 A1 May 27, 2021

(30) Foreign Application Priority Data

Nov. 25, 2019 (JP) ..... JP2019-212099

(51) Int. Cl.

| | |
|---|---|
| ***B41J 13/00*** | (2006.01) |
| ***B41J 11/00*** | (2006.01) |
| ***B41J 13/10*** | (2006.01) |
| ***B65H 31/36*** | (2006.01) |
| ***B65H 31/02*** | (2006.01) |
| ***B65H 29/14*** | (2006.01) |

(52) U.S. Cl.

CPC ..... *B41J 13/0036* (2013.01); *B41J 11/0095* (2013.01); *B41J 13/106* (2013.01); *B65H 29/14* (2013.01); *B65H 31/02* (2013.01); *B65H 31/36* (2013.01); *B65H 2404/1114* (2013.01)

(58) Field of Classification Search

CPC .. B41J 13/0036; B41J 13/106; B41J 11/0095; B65H 2404/1114; B65H 31/36; B65H 31/02; B65H 29/14

See application file for complete search history.

(56) References Cited

U.S. PATENT DOCUMENTS

2013/0070014 A1* 3/2013 Iesaki ..... B41J 11/42 347/16
2016/0347087 A1* 12/2016 Abe ..... B41J 2/01
2017/0348969 A1* 12/2017 Chiba ..... B41J 19/205
2018/0104926 A1* 4/2018 Aoyagi ..... B65H 43/04

FOREIGN PATENT DOCUMENTS

JP 2011093632 A 5/2011

* cited by examiner

*Primary Examiner* — Henok D Legesse
(74) *Attorney, Agent, or Firm* — Chip Law Group

(57) ABSTRACT

A post-processing device includes a transport path along which a medium printed with liquid ejected by a liquid ejecting portion is transported, an intermediate tray on which the medium is stacked, a first transporting member starting a first transporting operation of transporting the medium upstream in a transport direction after a rear end of the medium passes through the transport path, a rear-end alignment portion that comes into contact with the rear end of the medium transported by the first transporting member and that aligns the medium, a control portion controlling an operation of the first transporting member, and a detection portion detecting a transporting state of the medium in the intermediate tray, in which when the control portion determines, from an output of the detection portion, that the medium reaches the rear-end alignment portion, the control portion regulates the first transporting operation of the first transporting member.

18 Claims, 29 Drawing Sheets

FIG. 28

| LENGTH OF MEDIUM IN TRANSPORT DIRECTION LESS THAN OR EQUAL TO 210 mm<br>NORMAL TEMPERATURE AND NORMAL HUMIDITY | | | | | FIRST MEDIUM | | | | | |
|---|---|---|---|---|---|---|---|---|---|---|
| | | | | | BACK SURFACE IN DOUBLE-SIDED PRINTING | | | | | |
| | | | | | BASIS WEIGHT IS LESS THAN OR EQUAL TO 90 gsm | | | BASIS WEIGHT EXCEEDS 90 gsm | | |
| | | | | | BACK SURFACE DUTY IS LESS THAN F% | BACK SURFACE DUTY IS GREATER THAN OR EQUAL TO F% | | BACK SURFACE DUTY IS LESS THAN F% | BACK SURFACE DUTY IS GREATER THAN OR EQUAL TO F% | |
| | | | | | | STANDBY TIME PERIOD IS LESS THAN OR EQUAL TO Jsec | STANDBY TIME PERIOD EXCEEDS Jsec | | STANDBY TIME PERIOD IS LESS THAN OR EQUAL TO Jsec | STANDBY TIME PERIOD EXCEEDS Jsec |
| SECOND MEDIUM | FRONT SURFACE IN DOUBLE-SIDED PRINTING | BASIS WEIGHT IS LESS THAN OR EQUAL TO 90 gsm | FRONT SURFACE DUTY IS LESS THAN F% | NUMBER OF STACKED SHEETS IS LESS THAN OR EQUAL TO H | 0 | +2 | +4 | 0 | +1 | +2 |
| | | | | NUMBER OF STACKED SHEETS EXCEEDS H | 0 | +2 | +4 | 0 | +1 | +2 |
| | | | FRONT SURFACE DUTY IS GREATER THAN OR EQUAL TO F% | NUMBER OF STACKED SHEETS IS LESS THAN OR EQUAL TO H | +1 | +3 | +5 | +1 | +2 | +3 |
| | | | | NUMBER OF STACKED SHEETS EXCEEDS H | +2 | +4 | +6 | +2 | +3 | +4 |
| | | BASIS WEIGHT EXCEEDS 90 gsm | FRONT SURFACE DUTY IS LESS THAN F% | NUMBER OF STACKED SHEETS IS LESS THAN OR EQUAL TO H | 0 | +2 | +4 | 0 | +1 | +2 |
| | | | | NUMBER OF STACKED SHEETS EXCEEDS H | 0 | +2 | +4 | 0 | +1 | +2 |
| | | | FRONT SURFACE DUTY IS GREATER THAN OR EQUAL TO F% | NUMBER OF STACKED SHEETS IS LESS THAN OR EQUAL TO H | 0 | +2 | +4 | 0 | +1 | +2 |
| | | | | NUMBER OF STACKED SHEETS EXCEEDS H | 0 | +2 | +4 | 0 | +1 | +2 |

FIG. 29

| LENGTH OF MEDIUM IN TRANSPORT DIRECTION EXCEEDS 210 mm<br>NORMAL TEMPERATURE AND NORMAL HUMIDITY | | | | | FIRST MEDIUM | | | | | |
|---|---|---|---|---|---|---|---|---|---|---|
| | | | | | BACK SURFACE IN DOUBLE-SIDED PRINTING | | | | | |
| | | | | | BASIS WEIGHT IS LESS THAN OR EQUAL TO 90 gsm | | | BASIS WEIGHT EXCEEDS 90 gsm | | |
| | | | | | CONTACT PORTION BACK SURFACE DUTY IS LESS THAN F% | CONTACT PORTION BACK SURFACE DUTY IS GREATER THAN OR EQUAL TO F% | | CONTACT PORTION BACK SURFACE DUTY IS LESS THAN F% | CONTACT PORTION BACK SURFACE DUTY IS GREATER THAN OR EQUAL TO F% | |
| | | | | | | STANDBY TIME PERIOD IS LESS THAN OR EQUAL TO Jsec | STANDBY TIME PERIOD EXCEEDS Jsec | | STANDBY TIME PERIOD IS LESS THAN OR EQUAL TO Jsec | STANDBY TIME PERIOD EXCEEDS Jsec |
| SECOND MEDIUM | FRONT SURFACE IN DOUBLE-SIDED PRINTING | BASIS WEIGHT IS LESS THAN OR EQUAL TO 90 gsm | CONTACT PORTION FRONT SURFACE DUTY IS LESS THAN F% | NUMBER OF STACKED SHEETS IS LESS THAN OR EQUAL TO H | +1 | +3 | +5 | +1 | +2 | +3 |
| | | | | NUMBER OF STACKED SHEETS EXCEEDS H | +1 | +3 | +5 | +1 | +2 | +3 |
| | | | CONTACT PORTION FRONT SURFACE DUTY IS GREATER THAN OR EQUAL TO F% | NUMBER OF STACKED SHEETS IS LESS THAN OR EQUAL TO H | +2 | +4 | +6 | +2 | +3 | +4 |
| | | | | NUMBER OF STACKED SHEETS EXCEEDS H | +3 | +5 | +7 | +3 | +4 | +5 |
| | | BASIS WEIGHT EXCEEDS 90 gsm | CONTACT PORTION FRONT SURFACE DUTY IS LESS THAN F% | NUMBER OF STACKED SHEETS IS LESS THAN OR EQUAL TO H | +1 | +3 | +5 | +1 | +2 | +3 |
| | | | | NUMBER OF STACKED SHEETS EXCEEDS H | +1 | +3 | +5 | +1 | +2 | +3 |
| | | | CONTACT PORTION FRONT SURFACE DUTY IS GREATER THAN OR EQUAL TO F% | NUMBER OF STACKED SHEETS IS LESS THAN OR EQUAL TO H | +1 | +3 | +5 | +1 | +2 | +3 |
| | | | | NUMBER OF STACKED SHEETS EXCEEDS H | +1 | +3 | +5 | +1 | +2 | +3 |

POST-PROCESSING DEVICE AND PRINTING SYSTEM

The present application is based on, and claims priority from JP Application Serial Number 2019-212099, filed Nov. 25, 2019, the disclosure of which is hereby incorporated by reference herein in its entirety.

BACKGROUND

1. Technical Field

The present disclosure relates to a post-processing device and a printing system which process a printed medium.

2. Related Art

JP-A-2011-093632 discloses a post-processing device including a processing tray as an example of an intermediate tray on which a transported medium is stacked and subjected to output manipulation processing, and an end-portion alignment unit as an example of a transporting member driving the medium by moving perpendicularly to a medium stacking surface of the processing tray. Furthermore, the end-portion alignment unit has a rear-end alignment portion that is a surface in contact with an end portion of the medium by transporting the medium. The end-portion alignment unit has a control unit controlling a drive unit based on a detection result of a rear-end-height detection unit for the medium.

In a printing portion of a printing device, printing is performed on media of various materials or basis weights, and a coefficient of friction of the medium may change depending on a printing method. For example, in a liquid ejection method as an example of the printing portion of the printing device, ejecting liquid to a paper sheet as an example of the printed medium increases a water content ratio of the paper sheet and changes the coefficient of friction between paper sheets.

An elastic member having a high coefficient of friction is generally used as the transporting member when the paper sheet is aligned to the rear-end alignment portion. When the paper sheet containing water is aligned to the intermediate tray, the coefficient of friction between paper sheets is higher than when a paper sheet not containing water is aligned. When the paper sheet containing water is transported, the coefficient of friction between the paper sheet to be transported and a paper sheet already stacked on the intermediate tray is increased. Thus, a transporting force necessary for the transporting member at a time of a transporting operation is increased even when a rear end height of the medium is small. Thus, a time period in which the end portion of the medium reaches the rear-end alignment portion is lengthened.

In the post-processing device disclosed in JP-A-2011-093632, the drive unit of the transporting member is controlled based on the detection result of the rear-end-height detection unit for the medium, and the medium is transported to the rear-end alignment portion by causing the transporting member to transport the medium for a predetermined time period. However, a rear end of the medium may not reach the rear-end alignment portion within the predetermined time period depending on a water content state of the medium printed by the printing portion of the printing device.

SUMMARY

According to an aspect of the present disclosure, there is provided a post-processing device including a transport path along which a medium printed by a liquid ejecting portion included in a printing device is transported, a processing tray on which the medium transported by the transport path is stacked, a first transporting member that is disposed in the processing tray and that starts a first transporting operation of transporting the medium upstream in a transport direction after a rear end of the medium passes through the transport path, a rear-end alignment portion that comes into contact with the rear end of the medium transported by the first transporting member and that aligns the medium, a control portion controlling an operation of the first transporting member, and a detection portion detecting a transporting state of the medium in the processing tray, in which when the control portion determines, from an output of the detection portion, that the medium reaches the rear-end alignment portion, the control portion regulates the first transporting operation of the first transporting member.

According to another aspect of the present disclosure, there is provided a post-processing device including a transport path along which a medium printed by a liquid ejecting portion included in a printing device is transported, a processing tray on which the medium transported by the transport path is stacked, a first transporting member that is disposed in the processing tray and that starts a first transporting operation of transporting the medium upstream in a transport direction after a rear end of the medium passes through the transport path, a rear-end alignment portion that comes into contact with the rear end of the medium transported by the first transporting member and that aligns the medium, a control portion controlling an operation of the first transporting member, and a detection portion detecting a transporting state of the medium in the processing tray, in which the control portion regulates the first transporting operation of the first transporting member based on the transporting state of the medium and a condition of a parameter of the medium.

According to still another aspect of the present disclosure, there is provided a printing system including a transport path along which a medium printed by a liquid ejecting portion included in a printing device is transported, a processing tray on which the medium transported by the transport path is stacked, a first transporting member that is disposed in the processing tray and that starts a first transporting operation of transporting the medium upstream in a transport direction after a rear end of the medium passes through the transport path, a rear-end alignment portion that comes into contact with the rear end of the medium transported by the first transporting member and that aligns the medium, a control portion controlling an operation of the first transporting member, and a detection portion detecting a transporting state of the medium in the processing tray, in which when the control portion determines, from an output of the detection portion, that the medium reaches the rear-end alignment portion, the control portion regulates the first transporting operation of the first transporting member.

According to still another aspect of the present disclosure, there is provided a printing system including a transport path along which a medium printed by a liquid ejecting portion included in a printing device is transported, a processing tray on which the medium transported by the transport path is stacked, a first transporting member that is disposed in the processing tray and that starts a first transporting operation of transporting the medium upstream in a transport direction after a rear end of the medium passes through the transport path, a rear-end alignment portion that comes into contact with the rear end of the medium transported by the first transporting member and that aligns the medium, a control portion controlling an operation of the first transporting member, and a detection portion detecting a transporting state of the medium in the processing tray, in which the control portion regulates the first transporting operation of the first transporting member based on the transporting state of the medium and a condition of a parameter of the medium.

BRIEF DESCRIPTION OF THE DRAWINGS

FIG. 28 is an example of a control table for an increase in necessary number of rotations applied to the first transporting member and the second transporting member when a length of the medium in a transport direction is less than or equal to 210 mm.

FIG. 29 is an example of the control table for the increase in necessary number of rotations applied to the first transporting member and the second transporting member when the length of the medium in the transport direction exceeds 210 mm.

DESCRIPTION OF EXEMPLARY EMBODIMENTS

First Embodiment

Hereinafter, a first embodiment of a post-processing device and a printing system will be described with reference to the drawings. The printing system is configured with a printing device performing printing processing of printing a text or an image to a medium by ejecting ink as an example of liquid to the medium such as a paper sheet, and the post-processing device performing predetermined post-processing as an example of processing on the printed medium.

Summary of Printing System

Figure 1:
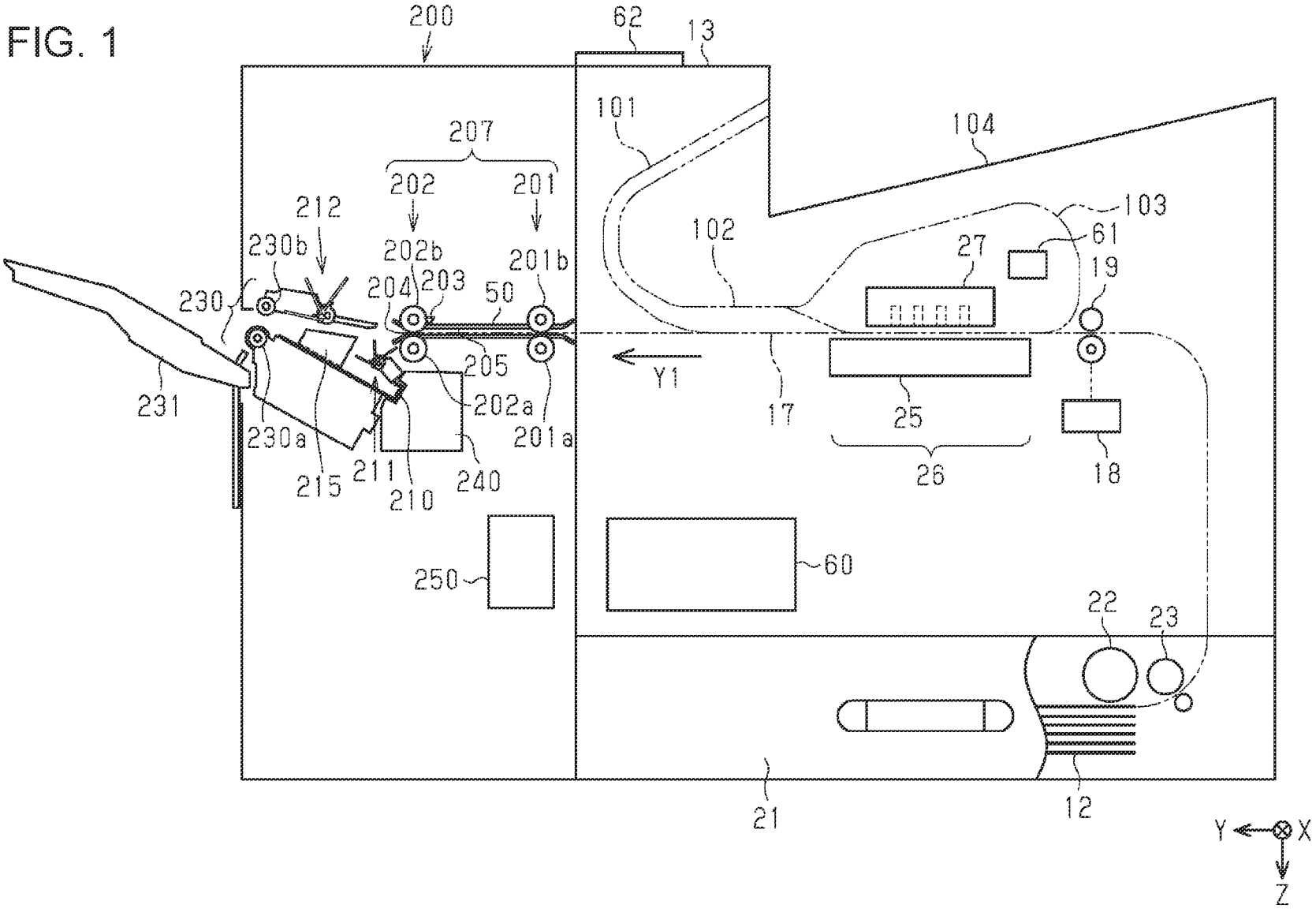
FIG. 1 is a schematic side view illustrating a printing system in a first embodiment and a second embodiment.

As illustrated in FIG. 1, a printing system 11 includes a printing device 13 performing printing on the medium 50, and a post-processing device 200 performing post-processing on the printed medium 50. For example, the printing device 13 is an ink jet type printer printing a text or an image by ejecting ink to the medium 50. The post-processing device 200 performs punching processing of opening a hole the medium 50 for each sheet, stapling processing of binding a plurality of media 50, and the like as the post-processing performed on the printed medium 50.

A transport path 17 that is illustrated by a double-dot dashed line in FIG. 1 and that continues to the post-processing device 200 from the printing device 13 is disposed in the printing system 11. The printing system 11 includes one or a plurality of transport roller pairs 19 transporting the medium 50 along the transport path 17 by driving of a transport motor 18. The transport motor 18 driving the transport roller pair 19 is included in each of the printing device 13 and the post-processing device 200. Each of the printing device 13 and the post-processing device 200 may include a plurality of transport motors 18.

In the drawings, a direction of gravity when the printing system 11 is placed on a horizontal surface is denoted by a Z axis, and directions along planes intersecting with the Z axis are denoted by an X axis and a Y axis. It is preferable that the X axis, the Y axis, and the Z axis are orthogonal to each other, and the X axis and the Y axis are along the horizontal surface. In the following description, an X axis direction will be referred to as a width direction X, and a Z axis direction will be referred to as a vertical direction Z. A direction orthogonal to the width direction X along the transport path 17 will be referred to as a transport direction Y1. The transport direction Y1 is a direction in which the medium is transported along the transport path 17, and changes depending on a position on the transport path 17. A transport direction in a part of the transport direction Y1 in which printing is performed on the medium 50 is parallel to the Y axis and will be referred to as a transport direction Y.

Overall Configuration of Printing System and Flow of Medium Processing

First, a configuration of the printing device 13 and a flow of medium processing will be described.

As illustrated in FIG. 1, a cassette 21 capable of accommodating the medium 50 in a stacked state is attachably and detachably disposed in the printing device 13. The printing device 13 includes a pick-up roller 22 forwarding the uppermost medium 50 among the media 50 accommodated in the cassette 21, and a separation roller 23 separating the medium 50 forwarded by the pick-up roller 22 one sheet at a time.

While the printing device 13 includes one cassette 21 in the present embodiment, the printing device 13 may include a plurality of cassettes 21. That is, the plurality of cassettes 21 are configured as a stack.

The printing device 13 includes a printing portion 26. The printing portion 26 includes a support portion 25 that is disposed at a position along the transport path 17 and that supports the medium 50, and a liquid ejecting portion 27 performing printing by ejecting liquid to the medium 50 supported by the support portion 25. The liquid ejecting portion 27 is disposed at a position facing the support portion 25 with the transport path 17 interposed therebetween. The liquid ejecting portion 27 may be a line head capable of ejecting liquid in the width direction X at the same time, or may be a serial head ejecting liquid while moving in the width direction X.

The printing device 13 includes, as a part of the transport path 17, a discharge path 101 along which the medium 50 is discharged, a switchback path 102 along which the medium 50 is transported in a switchback manner, and an inversion path 103 along which a position of the medium 50 is inverted. The medium 50 printed by the liquid ejecting portion 27 is discharged to a discharge portion 104 through the discharge path 101.

As illustrated in FIG. 1, when double-sided printing is executed, the medium 50 of which a single side is printed is transported to the switchback path 102 and then, is transported in the opposite direction and transported to the inversion path 103 from the switchback path 102. The medium 50 inverted by the inversion path 103 is fed to the liquid ejecting portion 27 again, and the liquid ejecting portion 27 performs printing on a surface on an opposite side from an already printed surface. In such a manner, the printing device 13 performs double-sided printing on the medium 50.

The printing device 13 transports the printed medium 50 toward the discharge portion 104 or the post-processing device 200. That is, when an instruction for the post-processing is not provided, the printing device 13 discharges the printed medium 50 to the discharge portion 104. When the instruction for the post-processing is provided, the printing device 13 transports the printed medium 50 toward the post-processing device 200. The post-processing in the present embodiment includes not only processing of manipulating the medium 50 like the stapling processing and but also processing of not manipulating the medium 50 like offset processing of shifting the medium 50 leftward or rightward one copy at a time.

Configuration of Post-Processing Device and Flow of Medium Processing

Next, a configuration of the post-processing device 200 and the flow of medium processing will be described.

As illustrated in FIG. 1, the post-processing device 200 includes an import portion 207 importing the medium 50 exported from the printing device 13, an intermediate tray 210 in which the post-processing is performed on the imported medium, and a discharge stacker 231 in which the medium 50 subjected to the post-processing is stacked.

The import portion 207 includes a reception roller pair 201 receiving the medium 50, the transport path 17 along which the medium 50 printed with liquid ejected by the liquid ejecting portion 27 included in the printing device 13 is transported to an intermediate discharge roller pair 202 from the reception roller pair 201, and a reception sensor 203 detecting a rear end of the medium 50.

As illustrated in FIG. 1, the medium 50 transported by the transport path 17 is stacked on the intermediate tray 210. The intermediate tray 210 includes a first transporting member 211 and a second transporting member 212 starting a transporting operation of transporting the rear end of the transported medium 50 upstream in the transport direction Y1 after the rear end of the medium 50 passes through the transport path 17. The second transporting member 212 is disposed downstream of the first transporting member 211 in the transport direction Y1.

Furthermore, the intermediate tray 210 includes a rear-end alignment portion 210*a* (refer to FIG. 2) that comes into contact with the rear end of the medium 50 transported by the first transporting member 211 and that aligns the rear end of the medium 50, and a pair of side-end alignment members 215 aligning a pair of side ends that are edges orthogonal to the rear end of the medium 50. Furthermore, the intermediate tray 210 includes a post-processing mechanism 240 performing the post-processing on the aligned medium 50, and a discharge roller pair 230 discharging the medium 50 after the post-processing from the intermediate tray 210.

Figure 2:
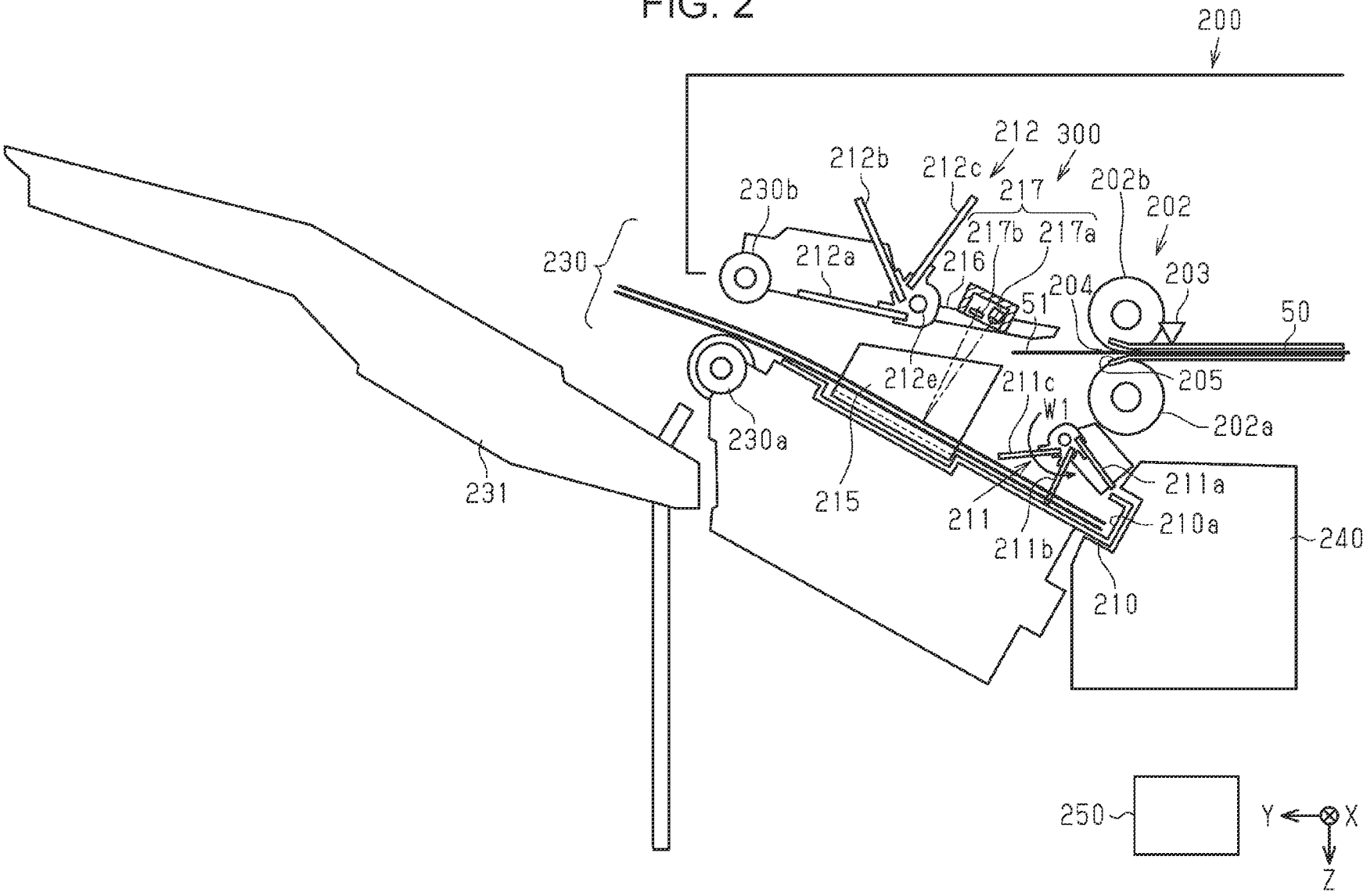
FIG. 2 is a schematic side view illustrating a state of a post-processing device when a medium is discharged to an intermediate tray in the first embodiment.

As illustrated in FIG. 2, the rear-end alignment portion 210*a* is a reference surface when the rear end of the medium 50 is aligned in the transport direction Y1. The pair of side-end alignment members 215 have reference surfaces at a time of aligning the side ends of the medium 50 and are arranged side by side in the width direction X to pinch the medium 50 transported to the intermediate tray 210. The pair of side-end alignment members 215 align the side ends of the medium 50 by repeating an operation of pinching the medium 50 in the width direction X.

As illustrated in FIG. 2, the post-processing device 200 includes a control portion 250. The control portion 250 controls an operation of the first transporting member 211, an operation of the second transporting member 212, an operation of the side-end alignment members 215, an operation of the post-processing mechanism 240, and a stacking operation in the discharge stacker 231.

In the present embodiment, the post-processing device 200 includes a state detection sensor 217 as an example of a detection portion. The state detection sensor 217 includes a light source 217*a* irradiating a front surface of the medium 50, a capturing portion 217*b* capturing the front surface of the medium 50 using reflected light from the medium 50, and a calculation portion, not illustrated, detecting a movement amount and a movement direction from two patterns of an area of a predetermined size captured at a time interval by the capturing portion 217*b*. The state detection sensor 217 outputs the calculated movement amount and the movement direction of the medium 50 to the control portion 250. The captured area of the predetermined size will be referred to as a "capturing area". For example, the predetermined size is approximately a diameter of 0.1 mm which is small. However, the state detection sensor 217 has high resolution and thus, differentiates small roughness or shades on a medium surface of the medium 50 in detail.

When the movement amount and the movement direction of only a portion of the capturing area are output, the calculation portion, not illustrated, of the state detection sensor 217 determines that the rear end of the medium 50 is within the capturing area. The state detection sensor 217 may output a capturing result to the control portion 250 along with the movement amount and the movement direction of the medium 50, and the control portion 250 may determine whether or not the rear end of the medium 50 is within the capturing area. It is configured that a position and a skew amount of the rear end of the medium 50 and a time at which the rear end of the medium 50 is within the capturing area can be detected from a boundary between an area from which the movement amount and the movement direction are output in the capturing area, and an area from which the movement amount and the movement direction are not output.

Figure 3:
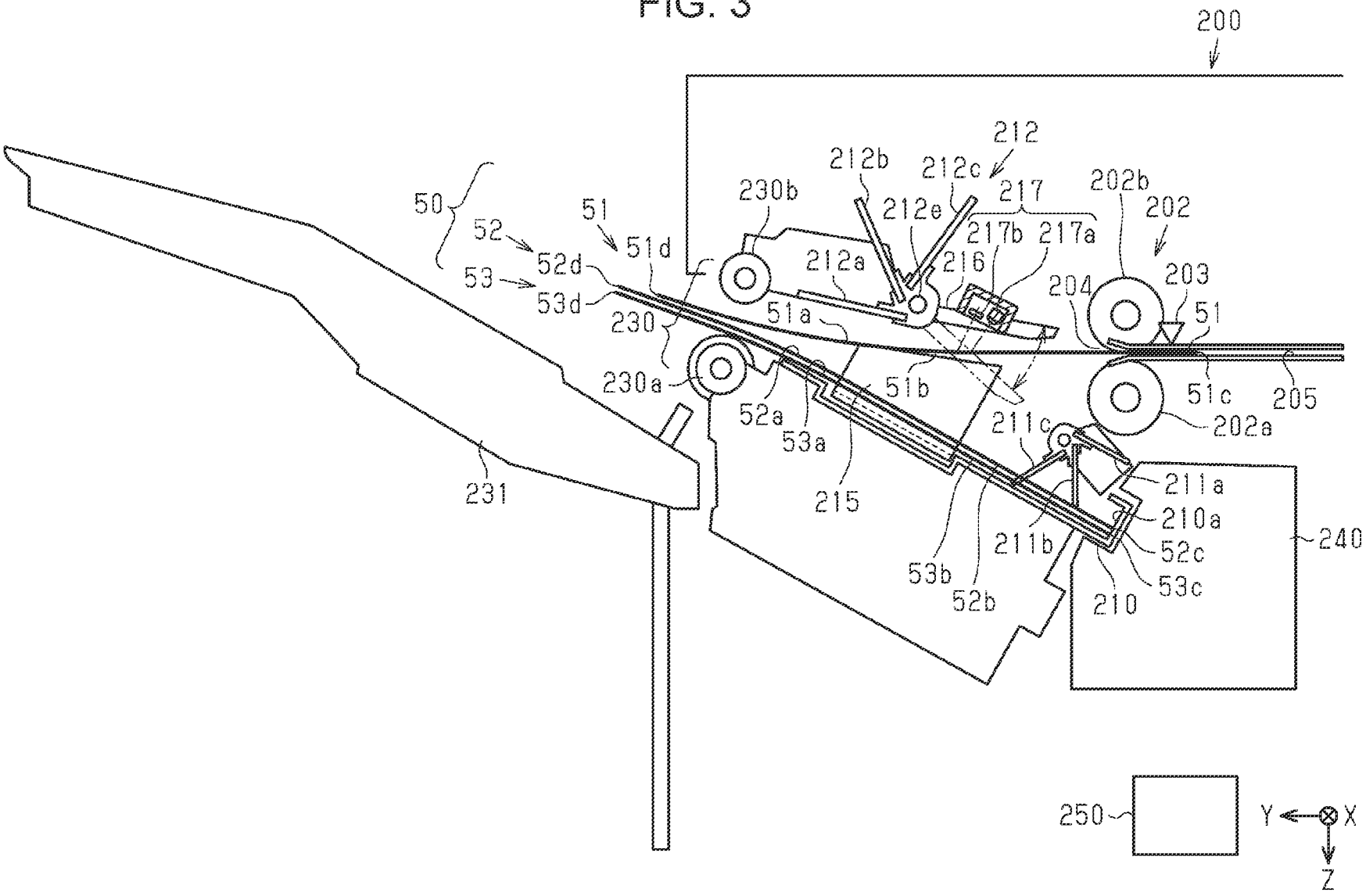
FIG. 3 is a schematic side view illustrating the state of the post-processing device immediately before completion of discharge of the medium to the intermediate tray in the first embodiment.

As illustrated in FIG. 3, the medium 50 on which the first transporting member 211 performs a first transporting operation will be referred to as a first medium 51. When the first medium 51 is transported and the first transporting operation is performed, the medium 50 stacked uppermost on the intermediate tray 210 will be referred to as a second medium 52. The transporting operation of the first transporting member 211 will be referred to as the first transporting operation.

The reception sensor 203 is arranged at a position slightly upstream of the intermediate discharge roller pair 202 in the transport direction Y1. The first medium 51 is transported by the intermediate discharge roller pair 202. A surface of the medium 50 on an intermediate tray 210 side when the medium 50 is stacked on the intermediate tray 210 will be referred to as a back surface, and a surface of the medium 50 on an opposite side from the rear surface will be referred to as the front surface. The front surface of the medium 50 and the back surface of the medium 50 will be collectively referred to as the medium surface. When a rear end 51*c* of the first medium 51 passes through the intermediate discharge roller pair 202, the first medium 51 falls onto the second medium 52.

When the first medium 51 falls, a medium falling member 216 accelerates falling of the first medium 51 by causing the medium falling member 216 to pivot clockwise for a short time period by an electric motor 235 (refer to FIG. 9) and immediately pivot counterclockwise for a short time period to return to an original position.

Immediately after the first medium 51 falls to the intermediate tray 210, the first transporting member 211 and the second transporting member 212 stop rotating at an angle at which the first transporting member 211 and the second transporting member 212 are not in contact with the first medium 51. Hereinafter, this angle will be referred to as a "standby angle".

Figure 4:
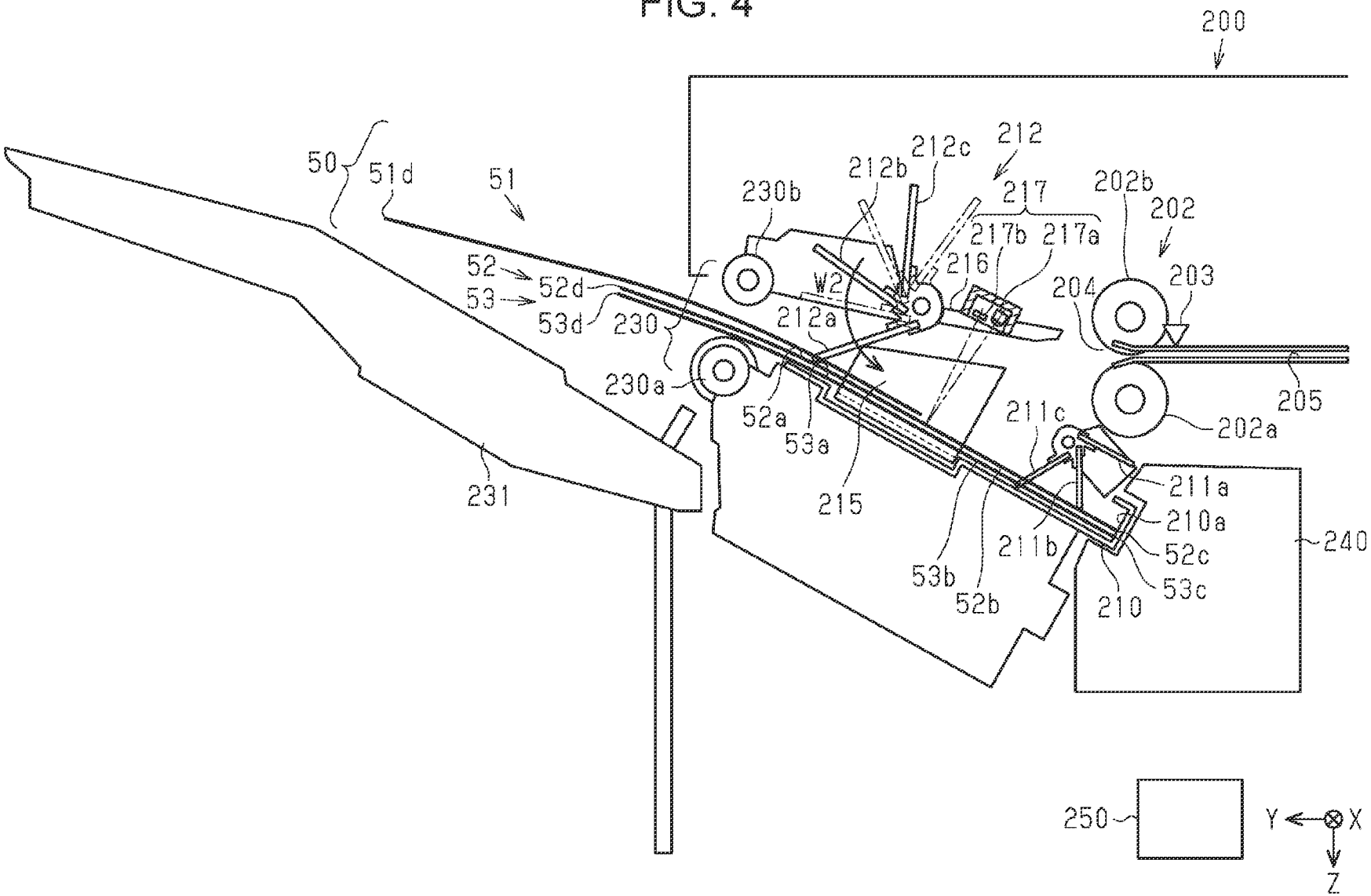
FIG. 4 is a schematic side view illustrating the state of the post-processing device when a second transporting member starts performing a transporting operation on the medium in the first embodiment.

As illustrated in FIG. 4, after the reception sensor 203 detects the rear end 51*c* of the first medium 51 and the rear end 51*c* of the first medium 51 passes through the intermediate discharge roller pair 202, the control portion 250 starts controlling the operation of the second transporting member 212 arranged above the intermediate tray 210. That is, the second transporting member 212 starts rotating in a W2 direction and transports the first medium 51 in a direction of the rear-end alignment portion 210*a* present upstream in the transport direction Y1.

A detection area of the state detection sensor 217 is installed upstream, in the transport direction Y1, of a position at which the rear end 51*c* of the first medium 51 falls onto the intermediate tray 210. Thus, the state detection sensor 217 detects, from downstream in the transport direction Y1, the rear end 51*c* of the first medium 51 entering the capturing area and detects, from upstream in the transport direction Y1, the rear end 51*c* of the first medium 51 exiting from the capturing area. That is, the state detection sensor 217 detects the rear end 51*c* of the first medium 51 that has passed through the capturing area. At this point, the state detection sensor 217 detects, from the pattern of the capturing area of the capturing portion 217*b*, the position and the skew amount of the rear end 51*c* of the first medium 51 at a time at which the rear end 51*c* of the first medium 51 has passed through the capturing area. The detection area of the state detection sensor 217 is present downstream of the first transporting member 211 in the transport direction Y1.

Figure 5:
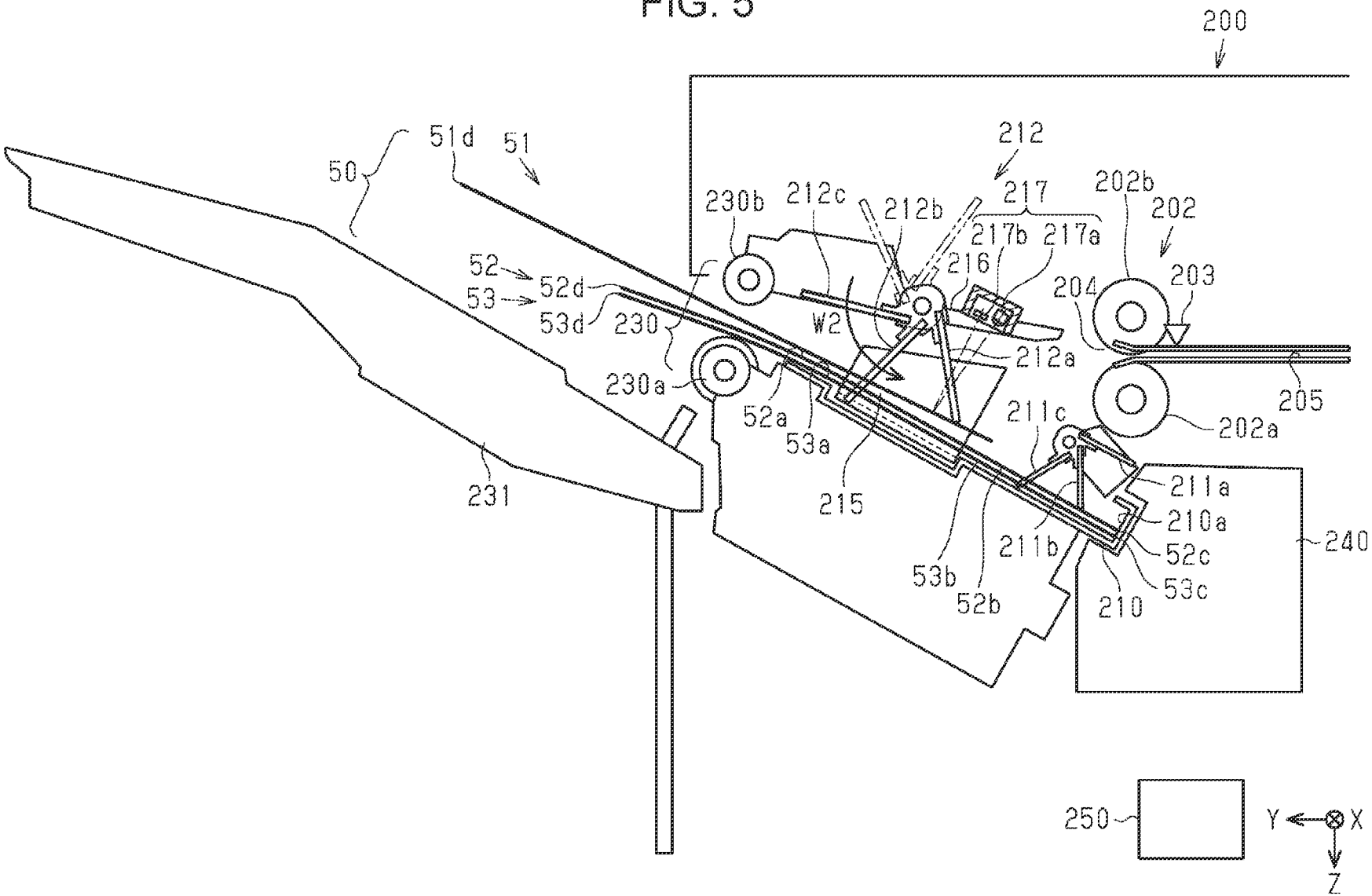
FIG. 5 is a schematic side view illustrating the state of the post-processing device when the second transporting member transports the medium in the first embodiment.

As illustrated in FIG. 5, the intermediate tray 210 is arranged in an inclined position in which the intermediate tray 210 is inclined in a direction in which an upstream end of the intermediate tray 210 in the transport direction Y1 is positioned below a downstream end of the intermediate tray 210 in the vertical direction Z. Thus, by the gravity, a force in a direction of sliding down along an upper surface of the intermediate tray 210 upstream in the transport direction Y1 acts on the first medium 51 that has fallen onto the intermediate tray 210. The second transporting member 212 rotates and transports the first medium 51 upstream in the transport direction Y1 along the upper surface of the intermediate tray 210. The transporting operation of the second transporting member 212 will be referred to as a second transporting operation.

Figure 6:
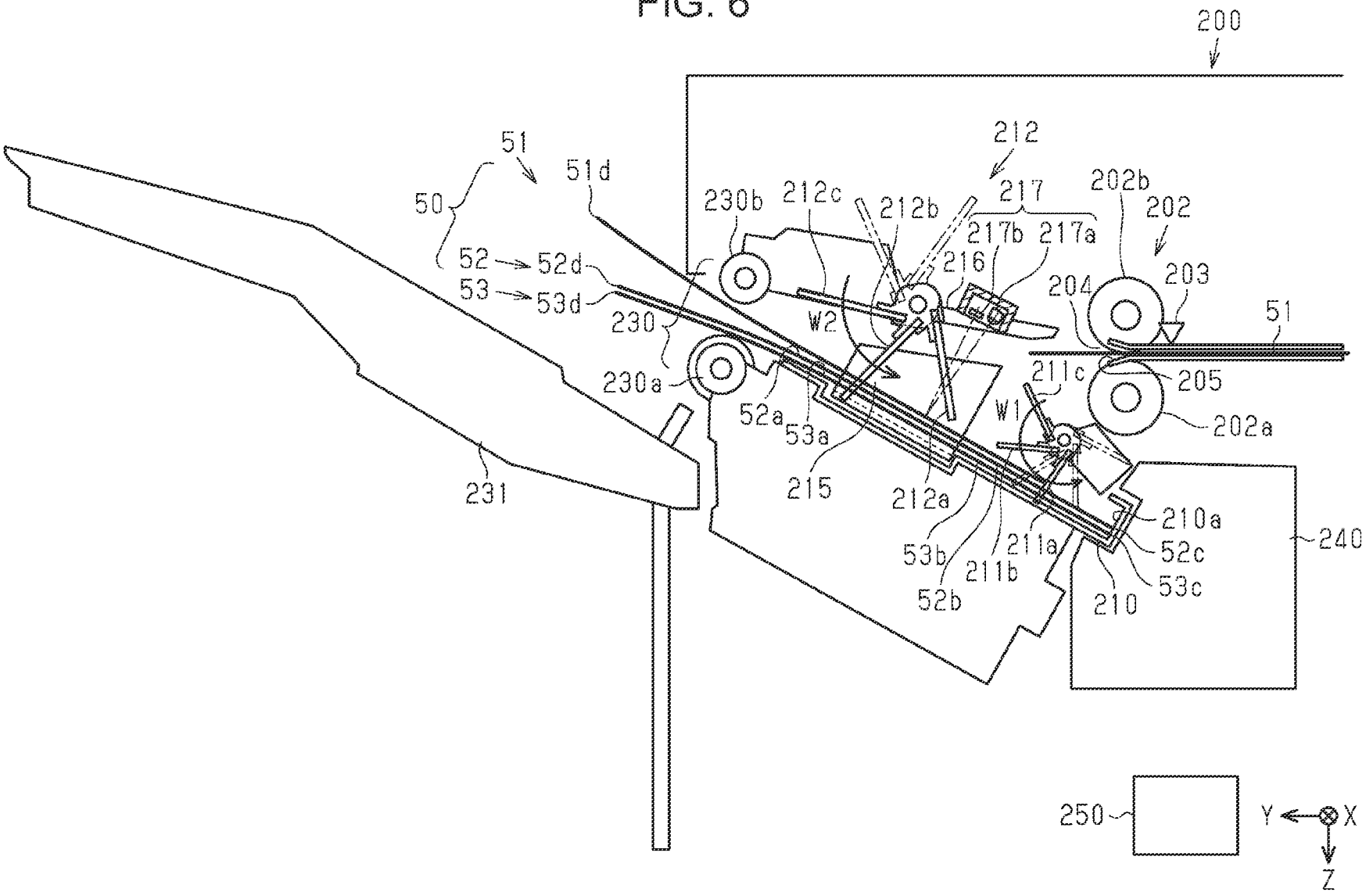
FIG. 6 is a schematic side view illustrating the state of the post-processing device when a first transporting member and the second transporting member transport the medium in the first embodiment.

As illustrated in FIG. 6, when the rear end 51*c* of the first medium 51 passes through the transport path 17 and then, the rear end 51*c* of the first medium 51 reaching the first transporting member 211 is detected from an output of the state detection sensor 217, the control portion 250 starts the first transporting operation of transporting upstream in the transport direction Y1 in a first position. Reaching means a timing that is immediately before the rear end of the medium 50 abuts the stopped first transporting member 211, and at which a first blade 211*a* transports a front surface 51*a* of the first medium 51 with the rear end of the medium 50 not abutting a first blade 211*c* of the first transporting member 211 when the first transporting member 211 is changed to a height of the first position and starts rotating (refer to FIG. 5). The first medium 51 is transported upstream in the transport direction Y1 by the first transporting operation.

The state detection sensor 217 outputs the movement amount and the movement direction of the medium 50 from two patterns captured at a time interval by the capturing portion 217*b*. Thus, the control portion 250 is configured to be capable of calculating the timing or a time at which the rear end 51*c* of the first medium 51 reaches the first transporting member 211. Furthermore, the control portion 250 is configured to be capable of determining the reaching of the rear end 51*c* of the first medium 51 from the pattern of the capturing area of the capturing portion 217*b* obtained when the rear end 51*c* of the first medium 51 has reached the first transporting member 211.

The first position is a position in which the first transporting member 211 rotates in the W1 direction at a predetermined height and transports the rear end 51*c* of the first medium 51 to the rear-end alignment portion 210*a*. A height of the first transporting member 211 is a distance between a stacking bottom surface 210*b* of the intermediate tray 210 and a first rotation center 211*e* (refer to FIG. 24) of the first transporting member 211. The predetermined height is a height appropriate for a user to transport the medium 50 of a type recommended to be used in the printing device 13. The control portion 250 is configured to be capable of changing, by a first upward/downward movement motor 253 (refer to FIG. 9), a height of the first rotation center 211*e* (refer to FIG. 24) of the first transporting member 211 when a position of the first transporting member 211 is the first position.

Figure 7:
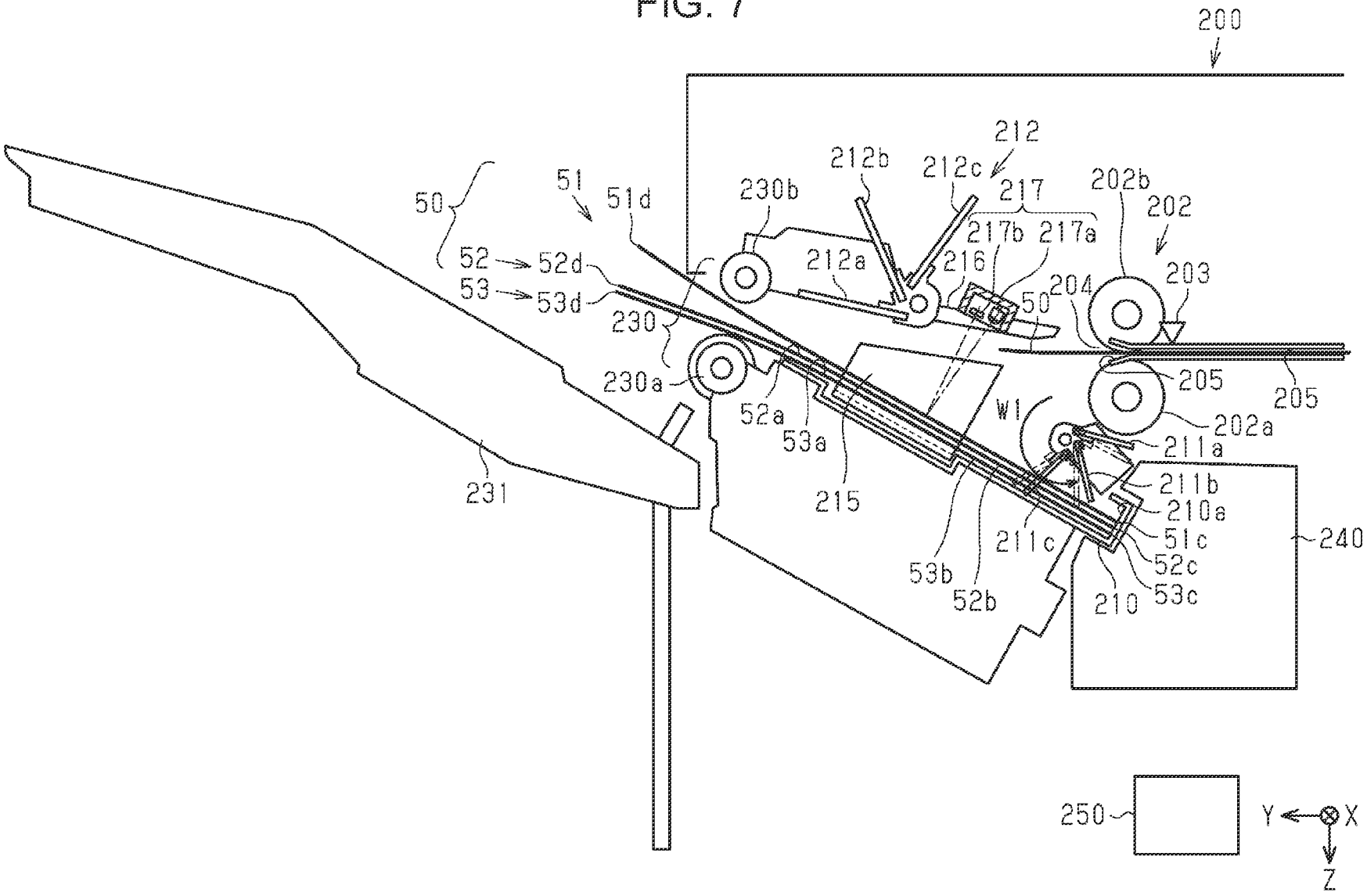
FIG. 7 is a schematic side view illustrating the state of the post-processing device when the first transporting member aligns the medium to a rear-end alignment portion in the first embodiment.

As illustrated in FIG. 7, the first transporting member 211 causes the rear end 51*c* of the first medium 51 to reach the rear-end alignment portion 210*a* by rotating in the W1 direction and generating a force of transporting the first medium 51. The first transporting member 211 causes the entire edge of the rear end 51*c* of the first medium 51 to abut the reference surface which is the rear-end alignment portion 210*a*, such that the rear end 51*c* of the first medium 51 is not buckled. The rear-end alignment portion 210*a* comes into contact with the rear end 51*c* of the first medium 51 transported by the first transporting member 211 and aligns the rear end 51*c* of the first medium 51.

The control portion 250 calculates a skew amount of the first medium 51 at a time at which the rear end 51*c* of the first medium 51 reaches the rear-end alignment portion 210*a*, by adding the movement amount and the movement direction to the skew amount of the rear end 51*c* of the first medium 51 obtained when the state detection sensor 217 detects the rear end 51*c* of the first medium 51. Furthermore, the control portion 250 is configured to be capable of determining the skew amount of the first medium 51 from the pattern of the capturing area of the capturing portion 217*b* obtained when the rear end 51*c* of the first medium 51 reaches the rear-end alignment portion 210*a*.

The control portion 250 controls the second transporting operation in accordance with the output of the state detection sensor 217. When the control portion 250 determines, from the output of the state detection sensor 217 that is a detection portion 300, that the medium 50 has reached the rear-end alignment portion 210*a*, the control portion 250 regulates the second transporting operation of the second transporting member 212.

As a method of regulating the second transporting operation, the control portion 250 may stop rotation of the second transporting member 212 or slow the rotation. In the present embodiment, the control portion 250 stops the second transporting operation.

A timing at which the second transporting operation is stopped may be immediately before the rear end 51*c* of the first medium 51 is aligned to the rear-end alignment portion 210*a*, or may be a timing at which alignment is performed. The control portion 250, by a second rotation motor 214 (refer to FIG. 9), stops rotation of the second transporting member 212 at a timing at which a rotation position of the second transporting member 212 is a position of the standby angle.

As illustrated in FIG. 7, when the entire edge of the rear end 51*c* of the first medium 51 abuts a surface of the rear-end alignment portion 210*a*, the control portion 250 moves the side-end alignment members 215 in a +X direction or a −X direction. That is, the side-end alignment members 215 align side ends of the first medium 51 by pinching both side ends of the first medium 51 between the reference surfaces of the pair of side-end alignment members 215 and separating from the first medium 51. However, when the side-end alignment members 215 align the side ends of the first medium 51, the first medium 51 may not move parallel to the reference surface of the rear-end alignment portion 210*a* depending on a size of the first medium 51 or the position at which the first medium 51 falls onto the intermediate tray 210.

Meanwhile, in the present embodiment, the control portion 250 continues rotating the first transporting member 211 at least while the side-end alignment members 215 align the side ends of the first medium 51. That is, the side-end alignment members 215 align the side ends of the first medium 51 while the first transporting member 211 causes the rear end 51*c* of the first medium 51 to abut the reference surface of the rear-end alignment portion 210*a*. When the side ends of the first medium 51 are aligned and the first transporting member 211 aligns the rear end 51*c* of the first medium 51 to the rear-end alignment portion 210*a*, all media 50 stacked on the intermediate tray 210 are aligned to the rear-end alignment portion 210*a*.

The control portion 250 is configured to be capable of determining that the rear end 51*c* of the first medium 51 has abutted the reference surface of the rear-end alignment portion 210*a* in a non-skewed state, from the pattern of the capturing area of the capturing portion 217*b* obtained when alignment of the side ends of the first medium 51 by the side-end alignment members 215 is finished.

When the rear end 51*c* of the first medium 51 is abutting the reference surface of the rear-end alignment portion 210*a* in a non-skewed state at a time at which the side-end alignment members 215 finish aligning the side ends of the first medium 51, the control portion 250 finishes the first transporting operation. That is, when the control portion 250 determines, from the output of the state detection sensor 217 which is the detection portion 300, that the medium 50 has reached the rear-end alignment portion 210*a*, the control portion 250 regulates the first transporting operation of the first transporting member 211.

However, when the side-end alignment members 215 finish aligning the side ends of the first medium 51, only a single side of the edge of the rear end 51*c* may be abutting the reference surface of the rear-end alignment portion 210*a*. The control portion 250 determines that the first medium 51 is still in a skewed state, and continues the first transporting operation of the first transporting member 211 until it can be confirmed that the first medium 51 is abutting the reference surface of the rear-end alignment portion 210*a* in a non-skewed state. When a skew amount of the medium 50 is large, the control portion 250 increases a transporting amount of the first transporting member 211. That is, when the control portion 250 determines, from the output of the state detection sensor 217, that the medium 50 is skewed, the control portion 250 changes the transporting amount of the first transporting member 211 in accordance with the skew amount of the medium 50.

As a method of regulating the first transporting operation, when a determination that the medium 50 has reached the rear-end alignment portion 210*a* is made, the side-end alignment members 215 may align the side ends of the first medium 51, and the first transporting operation may be regulated after an alignment operation is finished, as in the present embodiment.

As a method of regulating the first transporting operation, the control portion 250 may lessen a degree of abutting the first medium 51 by increasing the height of the first transporting member 211 or may slow rotation of the first transporting member 211.

As a method of regulating the first transporting operation, the control portion 250 may change the first transporting member 211 to a second position. In a state where the first transporting member 211 is abutting the first medium 51, the control portion 250 can change the first transporting member 211 to the second position for pressing the first medium 51 by the first transporting member 211, by stopping the first transporting operation of the first transporting member 211 and decreasing the height of the first transporting member 211.

Figure 8:
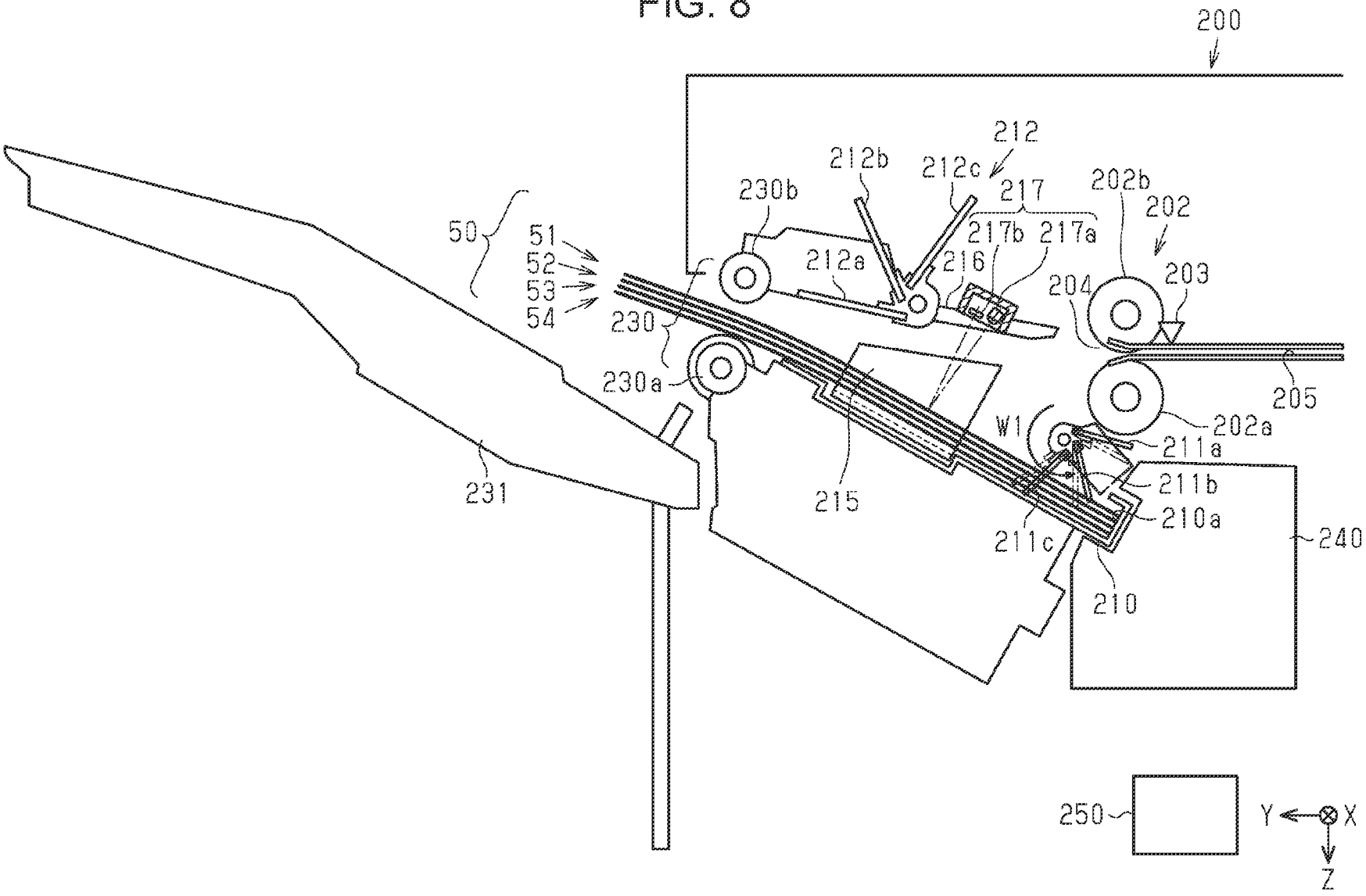
FIG. 8 is a schematic side view illustrating the state of the post-processing device when alignment of the medium is finished in the first embodiment.

As illustrated in FIG. 8, the medium 50 that has passed through the intermediate discharge roller pair 202 is stacked on the intermediate tray 210 one sheet at a time. When the media 50 in number designated by the user are stacked on the intermediate tray 210, the post-processing mechanism 240 performs the post-processing on a bundle of the stacked media 50. For example, the stapling processing is performed on the bundle of the stacked media 50 at a binding position designated by the user. The bundle of the media 50 on which the post-processing is performed is discharged, by the discharge roller pair 230, onto the discharge stacker 231 arranged to be movable upward and downward along a front surface of the post-processing device 200.

Block Diagram of Post-Processing Device Related to Alignment of Medium

Figure 9:
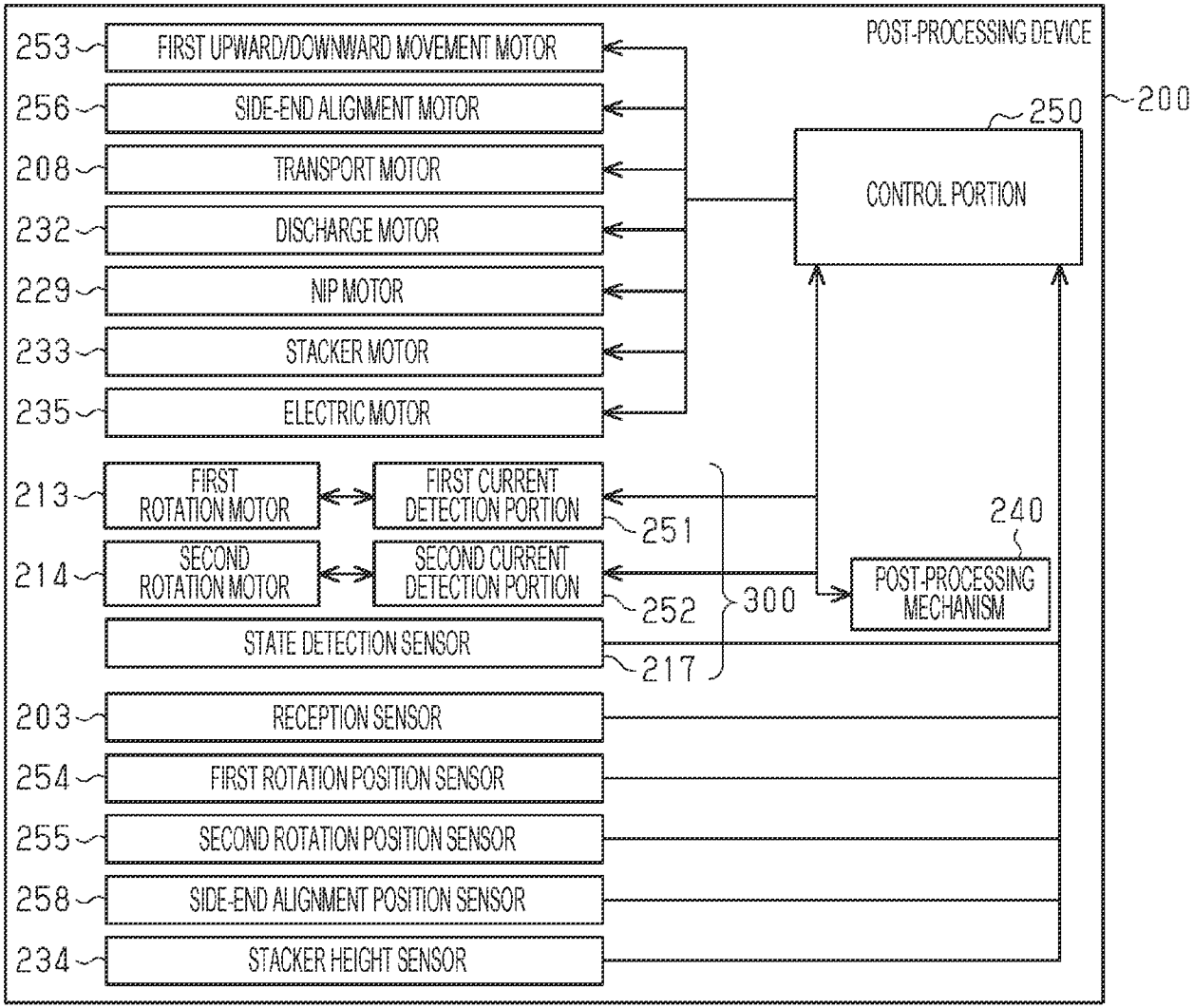
FIG. 9 is a block diagram illustrating a part of the post-processing device related to alignment of the medium in the first embodiment.

As illustrated in FIG. 9, the post-processing device 200 includes the control portion 250. Furthermore, the post-processing device 200 includes a plurality of detection portions 300 detecting a transporting state of the medium 50 in the intermediate tray 210. The control portion 250 controls the first transporting operation of the first transporting member 211, the second transporting operation of the second transporting member 212, the operation of the side-end alignment members 215, and the operation of the post-processing mechanism 240.

The post-processing device 200 includes a first rotation motor 213 rotating the first transporting member 211, a first current detection portion 251 detecting a current value of the first rotation motor 213, the first upward/downward movement motor 253 changing the height of the first transporting member 211, and a first rotation position sensor 254 detecting a rotation position of the first transporting member 211.

The post-processing device 200 includes a second rotation motor 214 rotating the second transporting member 212, a second current detection portion 252 detecting a current value of the second rotation motor 214, and a second rotation position sensor 255 detecting the rotation position of the second transporting member 212.

The first current detection portion 251 and the second current detection portion 252 as an example of the detection portions 300 are used for the control portion 250 to estimate the transporting state of the medium 50 from a changing state of the detected current values. The first transporting member 211 rotates until the rear end 51*c* of the first medium 51 reaches the rear-end alignment portion 210*a*, and is arranged close to the rear-end alignment portion 210*a*. Thus, the first transporting member 211 directly receives a load generated when the rear end 51*c* of the first medium 51 reaches the rear-end alignment portion 210*a*. Thus, the first current detection portion 251 includes a determination portion determining that the medium 50 has reached the rear-end alignment portion 210*a* when the current value exceeds a predetermined threshold.

The predetermined threshold is a value that is greater than a maximum value of the current value shown by the first transporting member 211 before the rear end 51*c* of the first medium 51 reaches the rear-end alignment portion 210*a*, and less than a minimum value of the current value shown by the first transporting member 211 after the rear end 51*c* of the first medium 51 reaches the rear-end alignment portion 210*a*.

When the medium 50 is jammed in the intermediate tray 210 due to the transporting operation of the first transporting member 211 or the second transporting member 212, the current value of the first rotation motor or the second rotation motor 214 is rapidly increased. Thus, the current value of the first rotation motor 213 or the second rotation motor 214 may be used for the control portion 250 to detect jamming of the medium 50.

As illustrated in FIG. 9, the post-processing device 200 includes a side-end alignment motor 256 moving the side-end alignment members 215, and a side-end alignment position sensor 258 detecting positions of the side-end alignment members 215. The operation of the side-end alignment members 215 is controlled by the control portion 250.

The post-processing device 200 includes a discharge motor 232 discharging, to the discharge stacker 231, the bundle of the media 50 subjected to the post-processing on the intermediate tray 210, a stacker motor 233 increasing or decreasing a height of a stacking surface in accordance with an amount of the stacked media 50, and a stacker height sensor 234 detecting a height of the stacking surface. An operation of stacking the media 50 in the discharge stacker 231 is controlled by the control portion 250.

Motion of Each Portion of Post-Processing Device

Next, a motion of each portion of the post-processing device 200 when the plurality of media 50 are being aligned and stacked on the intermediate tray 210 in a case of regulating the first transporting operation using the output of the state detection sensor 217 will be described with reference to the timing chart illustrated in FIG. 10. Times t2 to t8 illustrated in FIG. 10 indicate states corresponding to FIG. 2 to FIG. 8, respectively.

Figure 10:
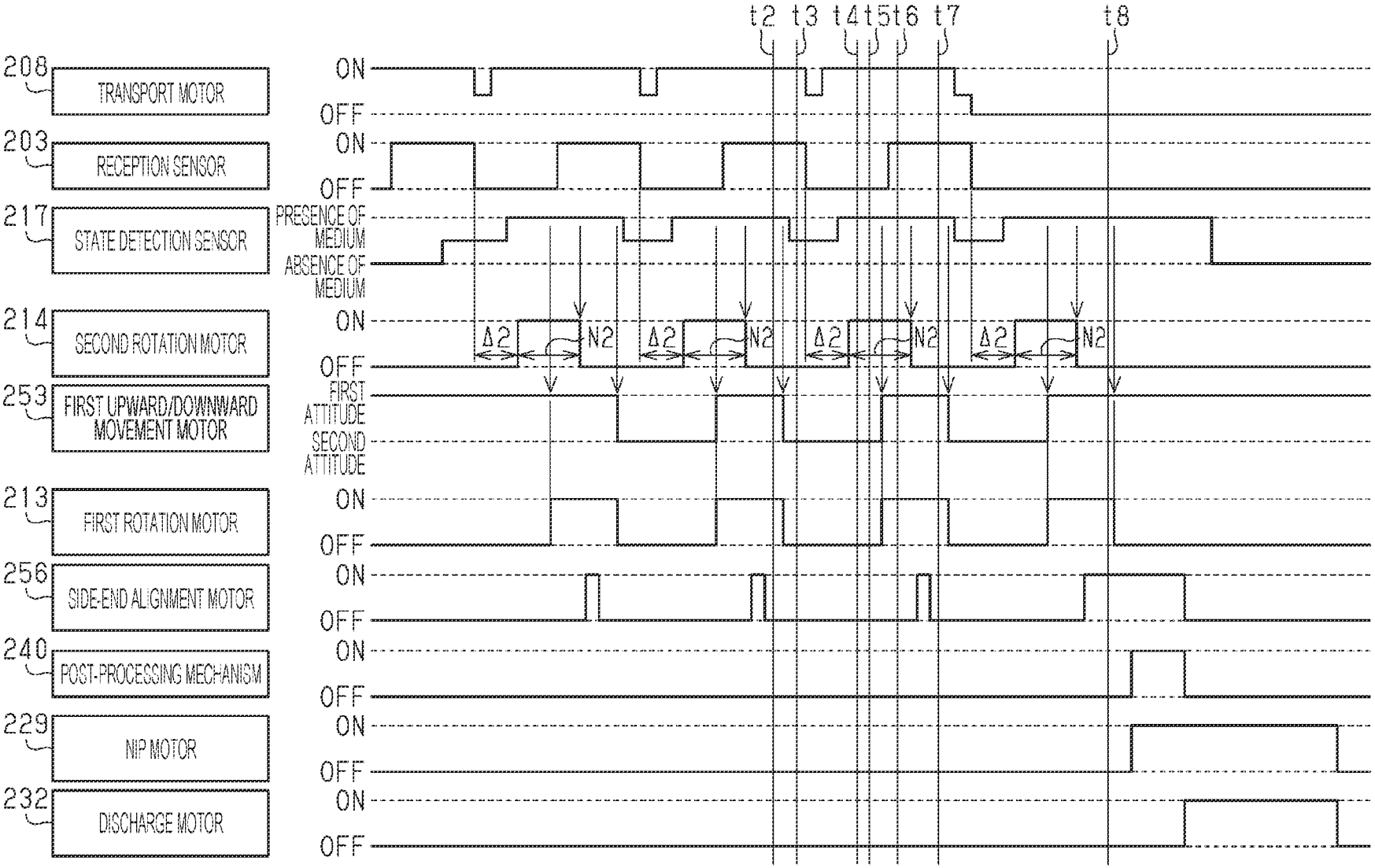
FIG. 10 is a timing chart illustrating an operation of the post-processing device when a first transporting operation is regulated using an output of a state detection sensor in the first embodiment.

As illustrated in FIG. 10, when a post-processing operation is started, a transport motor 208 starts rotating, and preparation for receiving the medium 50 is completed. When the last medium of a printing job is transported, rotation is stopped. In addition, each time an output of the reception sensor 203 is set to OFF, the transport motor 208 temporarily decreases a rotation speed. That is, each time the rear end of the medium 50 passes through the intermediate discharge roller pair 202, the medium 50 is prevented from flying away from the intermediate discharge roller pair 202 by causing the transport motor 208 to decrease a transport speed of the medium 50.

The reception sensor 203 detects presence or absence of the medium 50. The output of the reception sensor 203 is set to ON when the medium 50 passes through a detection target position, and is set to OFF when the medium 50 does not pass through the detection target position. The rotation speed of the transport motor 208 may be configured to be maintained even when the output of the reception sensor 203 is set to OFF.

As illustrated in FIG. 10, the first upward/downward movement motor 253 changes the height of the first transporting member 211. It is possible to switch between the height of the first position that is a position in which the medium 50 is transported, and a height of the second position that is a position in which the medium 50 is pressed. In addition, the first upward/downward movement motor 253 can change the height of the first position. FIG. 10 illustrates a state where the position of the first transporting member 211 is changed between the first position and the second position.

The state detection sensor 217 has three output states. A first state is a state where the medium 50 is not present on the intermediate tray 210. At this point, the capturing portion 217*b* of the state detection sensor 217 captures a surface of the intermediate tray 210. Front surface states of the medium 50 and the surface of the intermediate tray 210 are significantly different. Thus, the control portion 250 distinguishes between the front surface of the medium 50 and the surface of the intermediate tray 210. The output of the state detection sensor 217 illustrated in FIG. 10 indicates absence of the medium.

A second state is a state where the medium 50 is present on the intermediate tray 210. When the rear end 51*c* of the first medium 51 is present downstream of the detection area of the state detection sensor 217 in the transport direction Y1, that is, when the first medium 51 has just been discharged onto the intermediate tray 210, the capturing portion 217*b* captures a front surface 52*a* of the second medium 52. After the second transporting member 212 starts rotating and the rear end 51*c* of the first medium 51 enters the detection area of the state detection sensor 217, the capturing portion 217*b* captures the front surface 51*a* of the first medium 51. The output of the state detection sensor 217 illustrated in FIG. 10 indicates presence of the medium.

A third state is a state where a state on the intermediate tray 210 cannot be confirmed and the medium 50 is present at a position that is between the state detection sensor 217 and the intermediate tray 210 and that is at a significantly short distance from the state detection sensor 217. The third state is a state where the state detection sensor 217 is hidden. That is, a state where the intermediate discharge roller pair 202 is discharging the medium 50, and a state where the medium 50 discharged from the intermediate discharge roller pair 202 is falling correspond to the third state.

In the third state, the medium 50 is present at a significantly short distance from the state detection sensor 217. Thus, the capturing portion 217*b* is not focused on the medium 50. In the third state, small roughness or shades detected when a front surface of the intermediate tray 210 or the medium 50 is present at a position on which the capturing portion 217*b* is focused are not clearly captured by the capturing portion 217*b*. Thus, the control portion 250 distinguishes the front surface of the intermediate tray 210 or the front surface of the medium 50 stacked on the intermediate tray 210 from others. The output of the state detection sensor 217 illustrated in FIG. 10 indicates a state between the presence of the medium and the absence of the medium.

As illustrated in FIG. 10, the second rotation motor 214 rotates the second transporting member 212. When a second processing time period Δ2 elapses from a timing at which the output of the reception sensor 203 is set to OFF from ON, the second rotation motor 214 is set to ON. That is, the second transporting member 212 starts rotating. When the second rotation motor 214 rotates for a second rotation time period N2 after being set to ON, the second rotation motor 214 is set to OFF, and the second transporting member 212 stops rotating. The control portion 250 decides the second rotation time period N2 in accordance with the output of the state detection sensor 217.

The first rotation motor 213 rotates the first transporting member 211. When the control portion 250 detects, from the output of the state detection sensor 217, the rear end 51*c* of the first medium 51 reaching the first transporting member 211, the first rotation motor 213 is set to ON. That is, the first transporting operation of transporting upstream in the transport direction Y1 in the first position is started.

The side-end alignment motor 256 is set to ON for a short time period after the rear end of the medium 50 reaches the rear-end alignment portion 210*a*, and performs a side-end alignment operation on the medium 50. When the medium 50 is the last medium in units of copies, the side-end alignment members 215 press side ends of a media bundle on the intermediate tray 210 until the stapling processing is finished. Thus, when the medium 50 is the last paper sheet, a time period in which the side-end alignment motor 256 is ON is lengthened. The side-end alignment motor 256 may be set to ON for a short time period before the rear end of the medium 50 reaches the rear-end alignment portion 210*a*, and may perform the side-end alignment operation on the medium 50. In this case, the side-end alignment motor 256 may be driven during a period in which any of the blades of each of the transporting members 211 and 212 does not abut the front surface of the medium 50.

As illustrated in FIG. 10, when the control portion 250 determines, from the output of the state detection sensor 217, that a motion of the medium 50 is stable after the side-end alignment operation for the medium 50 and the rear end of the medium 50 has been aligned to the rear-end alignment portion 210*a*, the alignment operation for the rear end and the side ends of the medium 50 is completed, and the first rotation motor 213 is set to OFF. That is, the first transporting member 211 stops rotating. At the same time, the first upward/downward movement motor 253 changes the height of the first transporting member 211 to the height of the second position from the height of the first position.

When the subsequent medium 50 is discharged onto the intermediate tray 210 with the height of the first transporting member 211 set to the height of the second position by the first upward/downward movement motor 253, the second rotation motor 214 is set to ON, and the second transporting member 212 starts rotating. That is, when the first transporting member 211 is in the second position, the control portion 250 starts the second transporting operation of causing the second transporting member 212 to transport the first medium 51 upstream in the transport direction Y1.

When the rear end of the subsequent medium 50 reaches the first transporting member 211, the first upward/downward movement motor 253 changes the height of the first transporting member 211 to the height of the first position from the height of the second position, and the first rotation motor 213 rotates the first transporting member 211 again. A time of reaching means a timing that is immediately before the rear end of the medium 50 abuts the first transporting member 211, and at which the first blade 211*a* transports the front surface 51*a* of the first medium 51 with the rear end of the medium 50 not abutting the first blade 211*c* of the first transporting member 211 when the first transporting member 211 is changed to the height of the first position and starts rotating (refer to FIG. 5). That is, the control portion 250 is configured to cause the first transporting member 211 to return to the first position from the second position and start the first transporting operation again after the second transporting member 212 transports the first medium 51 by a predetermined amount. The first upward/downward movement motor 253 may change the height of the first transporting member 211 to the height of the first position from the height of the second position, and the first rotation motor 213 may rotate the first transporting member 211 again, until the rear end of the subsequent medium 50 reaches the first transporting member 211.

The predetermined amount varies depending on a detection position and a method of the detection portion 300. For example, as illustrated in FIG. 10, when the detection portion 300 is the state detection sensor 217, the control portion 250 constantly calculates a rear end position of the first medium 51. Thus, the predetermined amount is an actual amount of transporting the first medium 51 by the second transporting member 212 from when the second transporting member 212 starts rotating until the control portion 250 determines that the rear end 51*c* of the first medium 51 has reached the first transporting member 211.

For example, when the detection portion 300 is the first current detection portion 251, only information indicating that the rear end 51*c* of the first medium 51 reaches the rear-end alignment portion 210*a* is output. Unlike the case of the state detection sensor 217, the control portion 250 cannot obtain information about a positional relationship between the rear end 51*c* of the first medium 51 and the first transporting member 211 until the rear end 51*c* of the first medium 51 reaches the rear-end alignment portion 210*a*. When the control portion 250 sets the predetermined amount to be large, there is a possibility that the rear end 51*c* of the first medium 51 abuts the first transporting member 211 during a stoppage of rotation of the first transporting member 211 in the second position. Thus, it is desirable that the predetermined amount is set to a value obtained when the rear end 51*c* of the first medium 51 reaches the first transporting member 211 earliest. That is, a value with which the medium 50 having the lowest coefficient of friction among the media 50 used in the post-processing device 200 reaches the first transporting member 211 is set. When the value is a significantly small value, the first transporting member 211 may be configured to be started again at the same time as the start of the second transporting operation by the second transporting member 212.

A second detection portion may be disposed downstream of the first transporting member 211 in the transport direction Y1. When the second detection portion detects the rear end 51*c* of the first medium 51, the first transporting member 211 may be configured to return to the first position from the second position and start the first transporting operation again. Alternatively, after the rear end 51*c* of the first medium 51 is detected by the second detection portion and then, the first transporting member 211 transports the first medium 51 by a predetermined amount, the first transporting member 211 may be configured to return to the first position from the second position and start the first transporting operation again. At this point, the predetermined amount is set to a value with which the medium 50 having the lowest coefficient of friction among the media 50 used in the post-processing device 200 reaches the first transporting member 211.

In the present embodiment, the post-processing mechanism 240 is a stapler. When the medium 50 is the last medium in units of copies, the post-processing mechanism 240 performs the stapling processing on the media bundle while the side-end alignment members 215 press the side ends of the media bundle on the intermediate tray 210 from both sides. A nip motor 229 is set to ON during the stapling processing and during discharge of the media bundle to the discharge stacker 231. The discharge roller pair 230 nips the media bundle from upward and downward directions. The discharge motor 232 is set to ON at the same as finish of the stapling processing, and the media bundle is discharged to the discharge stacker 231.

Next, the motion of each portion of the post-processing device 200 when the plurality of media 50 are being aligned and stacked on the intermediate tray 210 in a case of regulating the first transporting operation using the output of the first current detection portion 251 will be described with reference to the timing chart illustrated in FIG. 11. Times t2 to t7 illustrated in FIG. 11 indicate states corresponding to FIG. 2 to FIG. 7, respectively. Descriptions of parts already described using FIG. 10 will not be repeated.

Figure 11:
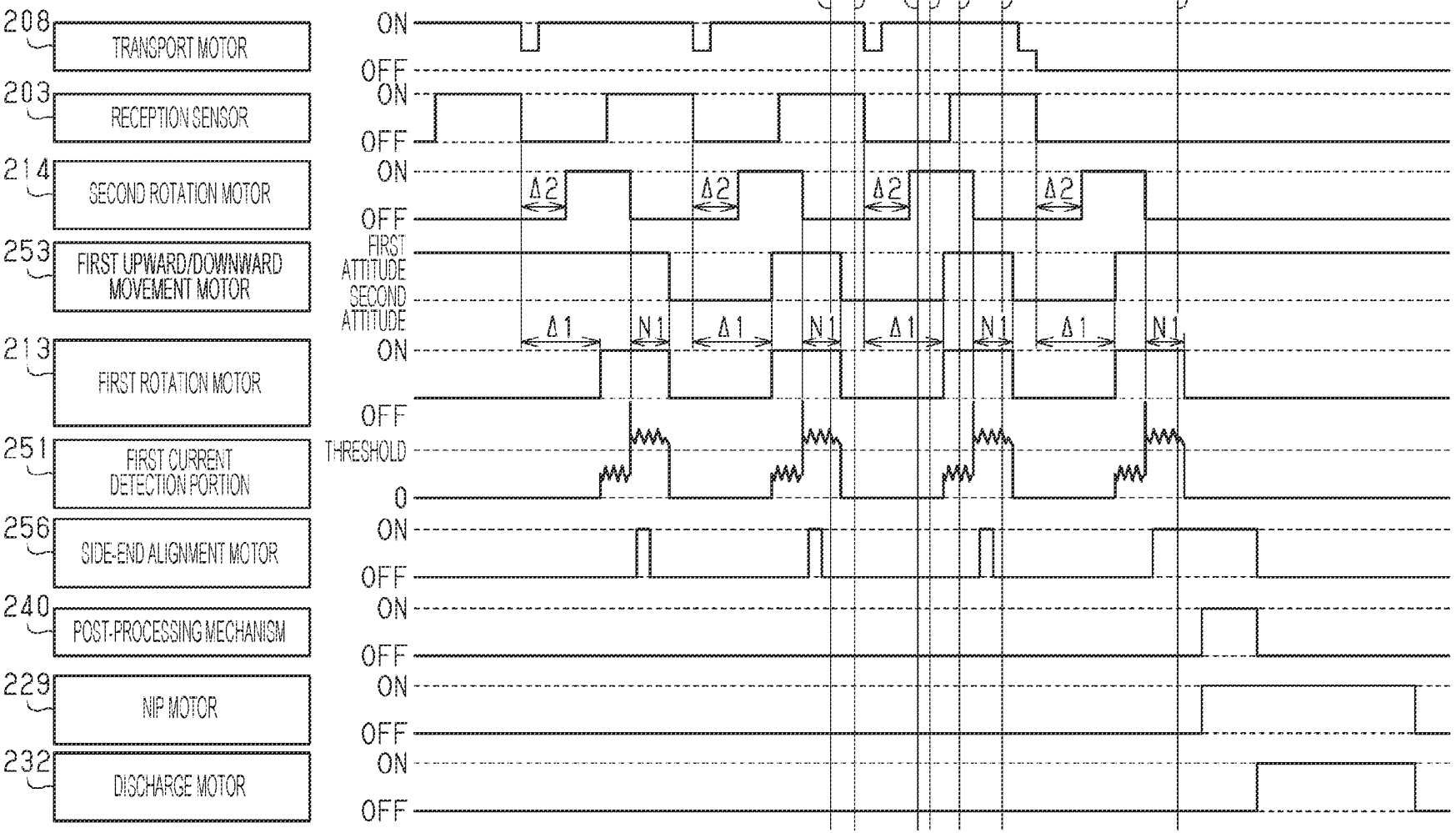
FIG. 11 is a timing chart illustrating the operation of the post-processing device when the first transporting operation is regulated using an output of a first current detection portion in the first embodiment.

As illustrated in FIG. 11, when the first rotation motor 213 is ON, the first current detection portion 251 outputs a value. The current value is low until the rear end 51*c* of the first medium 51 reaches the rear-end alignment portion 210*a*. When the rear end 51*c* of the first medium 51 reaches the rear-end alignment portion 210*a*, the current value is instantaneously increased due to an impact of abutting the rear-end alignment portion 210*a* by the rear end 51*c*. After the rear end 51*c* of the first medium 51 reaches the rear-end alignment portion 210*a*, the current value is high due to a reaction force generated when the rear end 51*c* of the first medium 51 continues abutting the rear-end alignment portion 210*a*.

In the present embodiment, when the value of the first current detection portion 251 exceeds the threshold, the control portion 250 determines that the rear end 51*c* of the first medium 51 has reached the rear-end alignment portion 210*a*, and sets the second rotation motor 214 to OFF and sets the side-end alignment motor 256 to ON. That is, when the rear end 51*c* of the first medium 51 reaches the rear-end alignment portion 210*a*, the control portion 250 stops rotation of the second transporting member 212 and starts the alignment operation for side end portions. After the alignment operation for the side end portions is finished and a state of the medium 50 is stable, the control portion 250 sets the first rotation motor 213 to OFF. That is, when the value of the first current detection portion 251 exceeds the threshold and becomes stable, rotation of the first transporting member 211 is stopped, and alignment of the medium 50 is finished.

Effects of the present embodiment will be described.

First, a case where 50 sheets are stacked on the intermediate tray 210 and discharged to the discharge stacker 231 using the state detection sensor 217 as the detection portion 300 detecting the transporting state of the medium 50 will be described.

When the first medium 51 of the first sheet is discharged onto the intermediate tray 210, a state where the medium 50 is not present on the intermediate tray 210 in the state illustrated in FIG. 2 is set. The capturing portion 217*b* of the state detection sensor 217 captures the front surface of the intermediate tray 210. Since the front surface states of the medium 50 and the surface of the intermediate tray 210 are significantly different, the control portion 250 distinguishes between the medium surface of the medium 50 and the surface of the intermediate tray 210 and determines that the medium 50 is not present on the intermediate tray 210.

When the intermediate discharge roller pair 202 discharges the first medium 51, the first medium 51 crosses between the state detection sensor 217 and the front surface of the intermediate tray 210. This state is a state where the state detection sensor 217 is hidden. Since the medium 50 is present at a significantly short distance from the state detection sensor 217, the capturing portion 217*b* is not focused on the medium 50. Small roughness or shades detected when the front surface of the intermediate tray 210 or the medium 50 is present at a position on which the capturing portion 217*b* is focused are not clearly captured by the capturing portion 217*b*. Thus, the control portion 250 distinguishes the front surface of the intermediate tray 210 or the front surface of the medium 50 stacked on the intermediate tray 210 from others. This state continues until the first medium 51 falls onto the intermediate tray 210.

When the first medium 51 falls onto the intermediate tray 210, the second transporting operation of the second transporting member 212 is started. The state illustrated in FIG. 4 is a state where one sheet of the first medium 51 that has just fallen is present on the intermediate tray 210. Since a falling position of the rear end 51*c* of the first medium 51 is present downstream of the capturing area in the transport direction Y1, the capturing portion 217*b* captures the front surface of the intermediate tray 210. The first medium 51 is transported upstream in the transport direction Y1 by the second transporting operation of the second transporting member 212. Thus, when the rear end 51*c* of the first medium 51 passes through the capturing area, the state detection sensor 217 detects the position and the skew amount of the rear end 51*c* of the first medium 51 and notifies the control portion 250 of the position and the skew amount.

The control portion 250 calculates a time at which the rear end 51*c* of the first medium 51 reaches the first transporting member 211, from the movement amount and the movement direction of the rear end 51*c* of the first medium 51 output at a time interval by the state detection sensor 217. When the time is reached, the first transporting member 211 rotates, and the first transporting operation of the first transporting member 211 is started. The state illustrated in FIG. 6 is a state where one sheet of the first medium 51 being subjected to the transporting operation is present on the intermediate tray 210.

The control portion 250 can determine, from the output of the state detection sensor 217, that the rear end 51*c* of the first medium 51 has reached the first transporting member 211. When the rear end 51*c* of the first medium 51 reaches the first transporting member 211, the control portion 250 can start the first transporting operation of the first transporting member 211.

The control portion 250 calculates the skew amount of the rear end 51*c* of the first medium 51 when reaching the rear-end alignment portion 210*a*. When the rear end 51*c* of the first medium 51 reaches the rear-end alignment portion 210*a*, the second transporting member 212 stops at an angle at which the second transporting member 212 does not abut the front surface 51*a* of the first medium 51, and the side-end alignment members 215 align the side ends of the first medium 51 in the width direction X. The state illustrated in FIG. 7 is a state where one sheet of the medium 50 being subjected to side end alignment is present on the intermediate tray 210. The control portion 250 can confirm the actual skew amount when the rear end 51*c* of the first medium 51 reaches the first transporting member 211.

When the side-end alignment members 215 finish the side-end alignment operation, a skew of the first medium 51 when reaching the rear-end alignment portion 210*a* may be corrected in an image captured by the capturing portion 217*b*, and the control portion 250 may delay a time at which the first transporting operation of the first transporting member 211 is to be stopped, until the control portion 250 determines that the skew of the first medium 51 has been corrected. The skew of the first medium 51 when reaching the rear-end alignment portion 210*a* may be corrected in the image captured by the capturing portion 217*b*, and the control portion 250 may increase the number of times the side ends of the first medium 51 in the width direction X are aligned by the side-end alignment members 215, until the control portion 250 determines that the skew of the first medium 51 has been corrected.

The control portion 250 continues monitoring, using the image captured at a time interval by the capturing portion 217*b*, the skew amount from when the rear end 51*c* of the first medium 51 passes through the capturing area of the capturing portion 217*b* until the rear end 51*c* of the first medium 51 reaches the first transporting member 211 and the first transporting member 211 stops. When the skew amount continues to be increased after the rear end 51*c* of the first medium 51 reaches the first transporting member 211, the control portion 250 can immediately stop the first transporting operation and determine that non-alignment of the medium 50 or buckling or jamming of the medium 50 has occurred in the intermediate tray 210. The control portion 250 may notify the user or perform processing for when jamming occurs.

When the alignment operation for the first medium 51 is finished, the control portion 250 changes the position of the first transporting member 211 to the second position for pressing the first medium 51 by causing the first transporting member 211 to stop the first transporting operation and decreasing the height of the first transporting member 211.

The control portion 250 continues monitoring, using the image captured at a time interval by the capturing portion 217*b*, the position of the rear end 51*c* of the first medium 51 from when the rear end 51*c* of the first medium 51 passes through the capturing area of the capturing portion 217*b* until the rear end 51*c* of the first medium 51 reaches the first transporting member 211 and the first transporting member 211 stops. Thus, the control portion 250 can suppress non-alignment of the medium 50 or buckling of the medium 50 caused by not transporting the first medium 51 or excessively transporting the first medium 51.

When the second sheet of the first medium 51 is discharged onto the intermediate tray 210, a state where one sheet of the second medium 52 is present on the intermediate tray 210 in the state illustrated in FIG. 2 is set. The capturing portion 217*b* of the state detection sensor 217 captures a medium surface of the second medium 52.

When the intermediate discharge roller pair 202 discharges the first medium 51, the first medium 51 crosses below the state detection sensor 217. Since the capturing portion 217*b* is not in focus, the control portion 250 determines, from the output of the state detection sensor 217, that the second sheet of the first medium 51 has been discharged to the intermediate tray 210. The state illustrated in FIG. 3 is a state where one sheet of the second medium 52 is present on the intermediate tray 210.

When the second sheet of the first medium 51 falls onto the intermediate tray 210, the second transporting operation of the second transporting member 212 is started. The state illustrated in FIG. 4 is a state where one sheet of the second medium 52 is present on the intermediate tray 210. Since the falling position of the rear end 51*c* of the first medium 51 is present downstream of the capturing area in the transport direction Y1, the capturing portion 217*b* captures the medium surface of the second medium 52. The first medium 51 is transported upstream in the transport direction Y1 by the second transporting operation of the second transporting member 212. When both of the area from which the movement amount and the movement direction are output, and the area from which the movement amount and the movement direction are not output are present in a pattern of the front surface of the medium 50 in the capturing area of the state detection sensor 217, the control portion 250 determines that the boundary between two areas is the rear end 51*c* of the second sheet of the first medium 51. The control portion 250 determines that the second sheet of the first medium 51 has reached the capturing area. The state illustrated in FIG. 5 is a state where one sheet of the second medium 52 is present on the intermediate tray 210. The control portion 250 acquires the position and the skew amount of the rear end 51*c* of the first medium 51.

When the rear end 51*c* of the first medium 51 reaches the first transporting member 211, the control portion 250 causes the first transporting member 211 to rotate and start the first transporting operation of the first transporting member 211. The state illustrated in FIG. 6 is a state where one sheet of the second medium 52 is present on the intermediate tray 210. When the control portion 250 determines, from the output of the state detection sensor 217, that the rear end 51*c* of the first medium 51 has reached the rear-end alignment portion 210*a*, the second transporting member 212 stops at a position at which the second transporting member 212 does not abut the front surface 51*a* of the first medium 51, and the side-end alignment members 215 align the side ends of the first medium 51 in the width direction X. The state illustrated in FIG. 7 is a state where two sheets of the first medium 51 and the second medium 52 are present on the intermediate tray 210.

When the side-end alignment members 215 finish the alignment operation, the time at which the first transporting operation of the first transporting member 211 is to be stopped is delayed in accordance with the skew amount obtained when the first medium 51 reaches the rear-end alignment portion 210*a*. When the alignment operation for the first medium 51 is finished, the control portion 250 determines, from the output of the state detection sensor 217, that the skew amount obtained when the first medium 51 reaches the rear-end alignment portion 210*a* has been corrected. The first transporting member 211 stops the first transporting operation, and the position of the first transporting member 211 is changed to the second position for pressing the first medium 51.

Then, the medium 50 is stacked on the intermediate tray 210 and aligned one sheet at a time. The number of sheets of the media 50 stacked on the intermediate tray 210 is increased. Regardless of the number of sheets of the media 50 on the intermediate tray 210, the control portion 250 performs control by acquiring the state of the first medium 51 when the first medium 51 is transported, and the state of the first medium 51 when the rear end 51*c* of the first medium 51 reaches the rear-end alignment portion 210*a*. The control portion 250 continues monitoring the position and the skew amount of the rear end 51*c* of the first medium 51 from when the rear end 51*c* of the first medium 51 passes through the capturing area of the capturing portion 217*b* until the first transporting member 211 stops. Thus, even when the number of stacked sheets is large, buckling of the medium 50 caused by not transporting the first medium 51 or excessively transporting the first medium 51 can be suppressed.

It may be difficult to transport the first medium 51 depending on a water content state, a basis weight, or a size of the first medium 51 or a temperature and humidity of a surrounding environment. Even at this point, the control portion 250 performs control by acquiring the state of the first medium 51 when the first medium 51 is transported, and the state of the first medium 51 when the rear end 51*c* of the first medium 51 reaches the rear-end alignment portion 210*a*. The control portion 250 continues monitoring the position and the skew amount of the rear end 51*c* of the first medium 51 from when the rear end 51*c* of the first medium 51 passes through the capturing area of the capturing portion 217*b* until the first transporting member 211 stops. Thus, even when the number of stacked sheets is large, buckling of the medium 50 caused by not transporting the first medium 51 or excessively transporting the first medium 51 can be suppressed.

The control portion 250 performs control in the same manner for the 50th sheet of the first medium 51. After the 50th sheet of the first medium 51 is appropriately aligned, the bundle of 50 sheets of the media 50 on the intermediate tray 210 is stapled at a position designated in the printing job by the user and is discharged to the discharge stacker. Non-alignment of the medium 50 or buckling of the medium 50 caused by not transporting the first medium 51 or excessively transporting the first medium 51 can be suppressed. An aligned and stapled book is discharged to the discharge stacker 231.

Next, a case where 50 sheets are stacked on the intermediate tray 210 and discharged to the discharge stacker 231 using the first current detection portion 251 as the detection portion 300 detecting the transporting state of the medium 50 will be described.

When the first medium 51 of the first sheet is discharged onto the intermediate tray 210, a state where the medium 50 is not present on the intermediate tray 210 in the state illustrated in FIG. 2 is set. When the first medium 51 falls onto the intermediate tray 210, the second transporting operation of the second transporting member 212 is started. When the first medium 51 reaches the first transporting member 211, the first transporting member 211 starts rotating.

When the first transporting member 211 starts rotating, the first current detection portion 251 detects the current value of the first rotation motor 213. The state illustrated in FIG. 6 is a state where one sheet of the first medium 51 being subjected to the transporting operation is present on the intermediate tray 210. The state of the front surface 51*a* of the first medium 51 is such that the entire surface is not uniform and has unevenness. Thus, a load generated when the first transporting member 211 transports the first medium 51 changes, and the value of the current value changes in conjunction with the load. When the rear end 51*c* of the first medium 51 reaches the rear-end alignment portion 210*a*, the current value instantaneously shows a high peak. The state illustrated in FIG. 7 is a state where one sheet of the medium 50 being subjected to side end alignment is present on the intermediate tray 210. Even after the rear end 51*c* of the first medium 51 is aligned to the rear-end alignment portion 210*a*, the value of the current value shows a higher value than before the rear end 51*c* of the first medium 51 reaches the rear-end alignment portion 210*a*, due to the reaction force generated when the rear end 51*c* of the first medium 51 continues abutting the rear-end alignment portion 210*a*. However, a change in current value is reduced, and the value becomes stable.

When the current value instantaneously shows a high peak, the control portion 250 determines that the rear end 51*c* of the first medium 51 has reached the rear-end alignment portion 210*a*, and stops the second transporting operation of the second transporting member 212 and executes the side-end alignment operation of the side-end alignment members 215.

When a plurality of high peaks of the current value consecutively occur, this means that the edge of the rear end 51*c* of the first medium 51 alternately repeats partial abutting. Thus, the value of the current value may not become stable even when the rear end 51*c* of the first medium 51 reaches the rear-end alignment portion 210*a*. The control portion 250 may determine that a state where the skew amount of the first medium 51 has been corrected is set, and delay the time at which the first transporting operation of the first transporting member 211 is to be stopped, until the value of the current value becomes stable. The number of times the side-end alignment members 215 align the side ends of the first medium 51 in the width direction X may be increased until the value of the current value becomes stable. The time at which the first transporting operation of the first transporting member 211 is to be stopped may be delayed from the beginning considering a time period for correcting the skew.

When the alignment operation for the first medium 51 is finished, the control portion 250 regulates the first transporting operation of the first transporting member 211. The control portion 250 changes the position of the first transporting member 211 to the second position for pressing the first medium 51 by causing the first transporting member 211 to stop the first transporting operation and decreasing the height of the first transporting member 211. Since the control portion 250 regulates the first transporting operation in accordance with the current value of the first rotation motor 213, the control portion 250 can suppress non-alignment of the medium 50 or buckling of the medium 50 caused by not transporting the first medium 51 or excessively transporting the first medium 51.

The control portion 250 performs the same operation when the second sheet of the first medium 51 is discharged onto the intermediate tray 210.

Then, the medium 50 is stacked on the intermediate tray 210 and aligned one sheet at a time. The number of sheets of the media 50 stacked on the intermediate tray 210 is increased. Regardless of the number of sheets of the media 50 on the intermediate tray 210, the control portion 250 controls the first transporting operation of the first transporting member 211 of the intermediate tray 210 by acquiring an output state of the current value of the first current detection portion 251 and determining that the rear end 51*c* of the first medium 51 has reached the rear-end alignment portion 210*a*. Thus, even when the number of stacked sheets is large, buckling of the medium 50 caused by not transporting the first medium 51 or excessively transporting the first medium 51 can be suppressed.

It may be difficult to transport the first medium 51 depending on a water content state, a basis weight, or a size of the first medium 51 or a temperature and humidity of a surrounding environment. Even at this point, the control portion 250 controls the first transporting operation of the first transporting member 211 of the intermediate tray 210 by acquiring the output state of the current value of the first current detection portion 251 and determining that the rear end 51*c* of the first medium 51 has reached the rear-end alignment portion 210*a*. Thus, even when the number of stacked sheets is large, buckling of the medium 50 caused by not transporting the first medium 51 or excessively transporting the first medium 51 can be suppressed.

The control portion 250 performs control in the same manner for the 50th sheet of the first medium 51. After the 50th sheet of the first medium 51 is appropriately aligned, the bundle of 50 sheets of the media 50 on the intermediate tray 210 is stapled at the position designated in the printing job by the user and is discharged to the discharge stacker 231. Non-alignment of the medium 50 or buckling of the medium 50 caused by not transporting the first medium 51 or excessively transporting the first medium 51 can be suppressed. An aligned and stapled book is discharged to the discharge stacker 231.

Effects of the present embodiment will be described.

1. When the control portion 250 determines, from an output of the detection portion 300, that the medium 50 has reached the rear-end alignment portion 210*a*, the control portion 250 regulates the first transporting operation of the first transporting member 211. The control portion 250 controls the first transporting operation by acquiring the state of the first medium 51 when the first medium 51 is transported, and the state of the first medium 51 when the rear end 51*c* of the first medium 51 reaches the rear-end alignment portion 210*a*. The control portion 250 continues monitoring the position and the skew amount of the rear end 51*c* of the first medium 51 from when the rear end 51*c* of the first medium 51 passes through the capturing area of the capturing portion 217*b* until the first transporting member 211 stops. When the medium 50 printed with liquid ejected by the liquid ejecting portion 27 is aligned, a coefficient of friction between the first medium 51 transported by the first transporting member 211 in the intermediate tray 210 and the second medium 52 stacked earlier on the intermediate tray 210 changes in accordance with conditions of parameters. Even when a time period required for the rear end of the medium 50 to reach the rear-end alignment portion 210*a* changes due to a change in coefficient of friction between media, the control portion 250 regulates the first transporting operation when the control portion 250 determines, from the transporting state of the medium 50 detected by the detection portion 300, that the rear end of the medium 50 has reached the rear-end alignment portion 210*a*. Furthermore, the control portion 250 regulates the first transporting operation by acquiring the state of the first medium 51 from when the rear end 51*c* of the first medium 51 passes through the capturing area of the state detection sensor 217 until the rear end 51*c* of the first medium 51 reaches the rear-end alignment portion 210*a*. Thus, non-alignment of the medium 50 or buckling of the medium 50 caused by not transporting the medium 50 or excessively transporting the medium 50 can be suppressed.

A method of causing the control portion 250 to change the first transporting member 211 to the second position is present as a method of regulating the first transporting operation. When the control portion 250 determines, from the transporting state of the medium 50 detected by the detection portion 300, that the rear end of the medium 50 has reached the rear-end alignment portion 210*a*, the control portion 250 can suppress non-alignment of the medium 50 or buckling of the medium 50 by stopping rotation and causing the first transporting member 211 to press the first medium 51.

2. The detection portion 300 outputs the movement amount and the movement direction of the medium 50 from two patterns captured at a time interval by the capturing portion 217*b*.

The control portion 250 can calculate a time at which the rear end 51*c* of the first medium 51 reaches the first transporting member 211. The control portion 250 can determine that the rear end 51*c* of the first medium 51 has actually reached the first transporting member 211, by detecting the movement amount and the movement direction of the medium 50 from two patterns captured at a time interval. When the rear end 51*c* of the first medium 51 actually reaches the first transporting member 211, the first transporting operation of the first transporting member 211 can be started.

The control portion 250 can determine that the rear end of the medium 50 has reached the rear-end alignment portion 210*a*, by detecting the movement amount and the movement direction of the medium 50 from two patterns captured at a time interval. Thus, the control portion 250 can accurately regulate the first transporting operation of the first transporting member 211. When a position at which the detection portion 300 captures the image is a position downstream of the first transporting member 211 in the transport direction Y1, the control portion 250 can calculate the time at which the rear end of the medium 50 reaches the first transporting member 211. In addition, the control portion 250 can determine, from the images captured at a time interval, that the rear end of the medium 50 has actually reached the first transporting member 211. Furthermore, when the rear end of the medium 50 actually reaches the first transporting member 211, the first transporting operation of the first transporting member 211 can be started. In this case, the first transporting operation of the first transporting member 211 can be further accurately regulated.

When the movement amount and the movement direction are output from only a portion of the capturing area of the detection portion 300, the state detection sensor 217 can determine that the rear end of the medium 50 is within the capturing area. The position and the skew amount of the rear end of the medium 50 when the rear end of the medium 50 is within the capturing area can be detected from the boundary between the area from which the movement amount and the movement direction are output in the capturing area, and the area from which the movement amount and the movement direction are not output. The control portion 250 can calculate the skew amount of the first medium 51 by comparing a state, detected by the detection portion 300, where the rear end 51*c* of the first medium 51 passes through the capturing area, with a state where the rear end 51*c* of the first medium 51 reaches the rear-end alignment portion 210*a*.

3. When the control portion 250 determines, from the output of the detection portion 300, that the first medium 51 is skewed, the control portion 250 changes the transporting amount of the first transporting member 211 in accordance with the skew amount of the medium 50. When the first medium 51 on which the first transporting member 211 is performing the first transporting operation is skewed, a skew of the medium 50 is corrected by causing the control portion 250 to change the transporting amount of the first transporting member 211. Non-alignment of the medium 50 or buckling of the medium 50 caused by the skew of the medium 50 transported by the first transporting member 211 can be suppressed.

4. When the current value of the first rotation motor 213 detected by the detection portion 300 exceeds a predetermined threshold, a determination that the medium 50 has reached the rear-end alignment portion 210*a* is made. When the medium 50 printed with liquid ejected by the liquid ejecting portion 27 is aligned, the coefficient of friction between the first medium 51 transported by the first transporting member 211 in the intermediate tray 210 and the second medium 52 stacked earlier on the intermediate tray 210 changes in accordance with a condition of the printed medium 50. Even when the time period required for the rear end of the medium 50 to reach the rear-end alignment portion 210*a* changes due to a change in coefficient of friction between media, the control portion 250 determines that the rear end of the medium 50 has reached the rear-end alignment portion 210*a*, by detecting the transporting state of the medium 50. When the control portion 250 determines that the rear end of the medium 50 has reached the rear-end alignment portion 210*a*, the control portion 250 regulates the first transporting operation. Thus, the control portion 250 can accurately detect the transporting state of the medium 50 and can accurately determine that the rear end of the medium 50 has reached the first transporting member 211.

5. When the control portion 250 determines, from the transporting state of the medium 50, that the medium 50 has reached the rear-end alignment portion 210*a*, the control portion 250 changes the first transporting member 211 to the second position for pressing the medium 50 by the first transporting member 211, by stopping the first transporting operation of the first transporting member 211 and decreasing the height of the first transporting member 211. Since the already aligned second medium 52 is pressed, a motion of the already aligned second medium 52 can be suppressed.

6. When the first transporting member 211 is in the second position, the control portion 250 causes the second transporting member 212 to start the second transporting operation of transporting the first medium 51 upstream in the transport direction Y1. When the rear end of the first medium 51 reaches the first transporting member 211, the control portion 250 causes the first transporting member 211 to return to the first position from the second position and start the first transporting operation again. The first transporting member 211 can establish both of suppression of the motion of the already aligned second medium 52 by the second position of the first transporting member 211, and alignment of the first medium 51 by the first position of the first transporting member 211.

7. When the rear end of the first medium 51 reaches the first transporting member 211, the control portion 250 causes the first transporting member 211 to return to the first position from the second position and start the first transporting operation again. By the detection portion 300, the control portion 250 can accurately determine that the rear end 51*c* of the first medium 51 has reached the first transporting member 211. That is, when the rear end 51*c* of the first medium 51 actually reaches the first transporting member 211, the control portion 250 can start the first transporting operation of the first transporting member 211. In addition, the first transporting member 211 can establish both of suppression of the motion of the already aligned second medium 52 by the second position of the first transporting member 211, and alignment of the first medium 51 by the first position of the first transporting member 211.

8. When the control portion 250 determines, from the output of the detection portion 300, that the medium 50 has reached the rear-end alignment portion 210*a*, the control portion 250 regulates the first transporting operation of the first transporting member 211. The control portion 250 controls the first transporting operation by acquiring the state of the first medium 51 when the first medium 51 is transported, and the state of the first medium 51 when the rear end 51*c* of the first medium 51 reaches the rear-end alignment portion 210*a*. The control portion 250 continues monitoring the position and the skew amount of the rear end 51*c* of the first medium 51 from when the rear end 51*c* of the first medium 51 passes through the capturing area of the capturing portion 217*b* until the first transporting member 211 stops. When the medium 50 printed with liquid ejected by the liquid ejecting portion 27 is aligned, the coefficient of friction between the first medium 51 transported by the first transporting member 211 in the intermediate tray 210 and the second medium 52 stacked earlier on the intermediate tray 210 changes in accordance with a condition of the printed medium 50. Even when the time period in which the rear end of the medium 50 reaches the rear-end alignment portion 210*a* changes due to a change in coefficient of friction between media, the control portion 250 regulates the first transporting operation when the control portion 250 determines, from the transporting state of the medium 50 detected by the detection portion 300, that the rear end of the medium 50 has reached the rear-end alignment portion 210*a*. Furthermore, the control portion 250 regulates the first transporting operation by acquiring the state of the first medium 51 until the rear end 51*c* of the first medium 51 reaches the rear-end alignment portion 210*a*. Thus, the printing system 11 can suppress non-alignment of the medium 50 or buckling of the medium 50 caused by not transporting the first medium 51 or excessively transporting the first medium 51.

Second Embodiment

Hereinafter, a second embodiment of the post-processing device and the printing system will be described with reference to the drawings. The same configurations will be designated by the same reference signs, and descriptions thereof will not be repeated.

Configuration of Post-Processing Device and Flow of Medium Processing

A configuration of the post-processing device 200 and the flow of medium processing will be described.

As illustrated in FIG. 1, the post-processing device 200 includes the import portion 207 importing the medium 50 exported from the printing device 13, the intermediate tray 210 in which the post-processing is performed on the imported medium, and the discharge stacker 231 in which the medium 50 subjected to the post-processing is stacked.

The import portion 207 includes the reception roller pair 201 receiving the medium 50, the transport path 17 along which the medium 50 printed with liquid ejected by the liquid ejecting portion 27 included in the printing device 13 is transported to the intermediate discharge roller pair 202 from the reception roller pair 201, and the reception sensor 203 detecting the rear end of the medium 50. The transport path 17 is configured with an upper transport surface 204 and a lower transport surface 205. The medium 50 is transported between the upper transport surface 204 and the lower transport surface 205 by the reception roller pair 201 and the intermediate discharge roller pair 202.

As illustrated in FIG. 1, the intermediate tray 210 in which the medium 50 transported by the transport path 17 is stacked includes the first transporting member 211 and the second transporting member 212 that are disposed in the intermediate tray 210 and that start the transporting operation of transporting the rear end of the transported medium 50 upstream in the transport direction Y1. The second transporting member 212 is disposed downstream of the first transporting member 211 in the transport direction Y1. Furthermore, the intermediate tray 210 includes the rear-end alignment portion 210*a* (refer to FIG. 12) aligning the rear end of the medium 50, and the pair of side-end alignment members 215 aligning the pair of side ends that are edges orthogonal to the rear end of the medium 50. Furthermore, the intermediate tray 210 includes the post-processing mechanism 240 performing the post-processing on the aligned medium 50, and the discharge roller pair 230 discharging the medium 50 after the post-processing from the intermediate tray 210.

Figure 12:
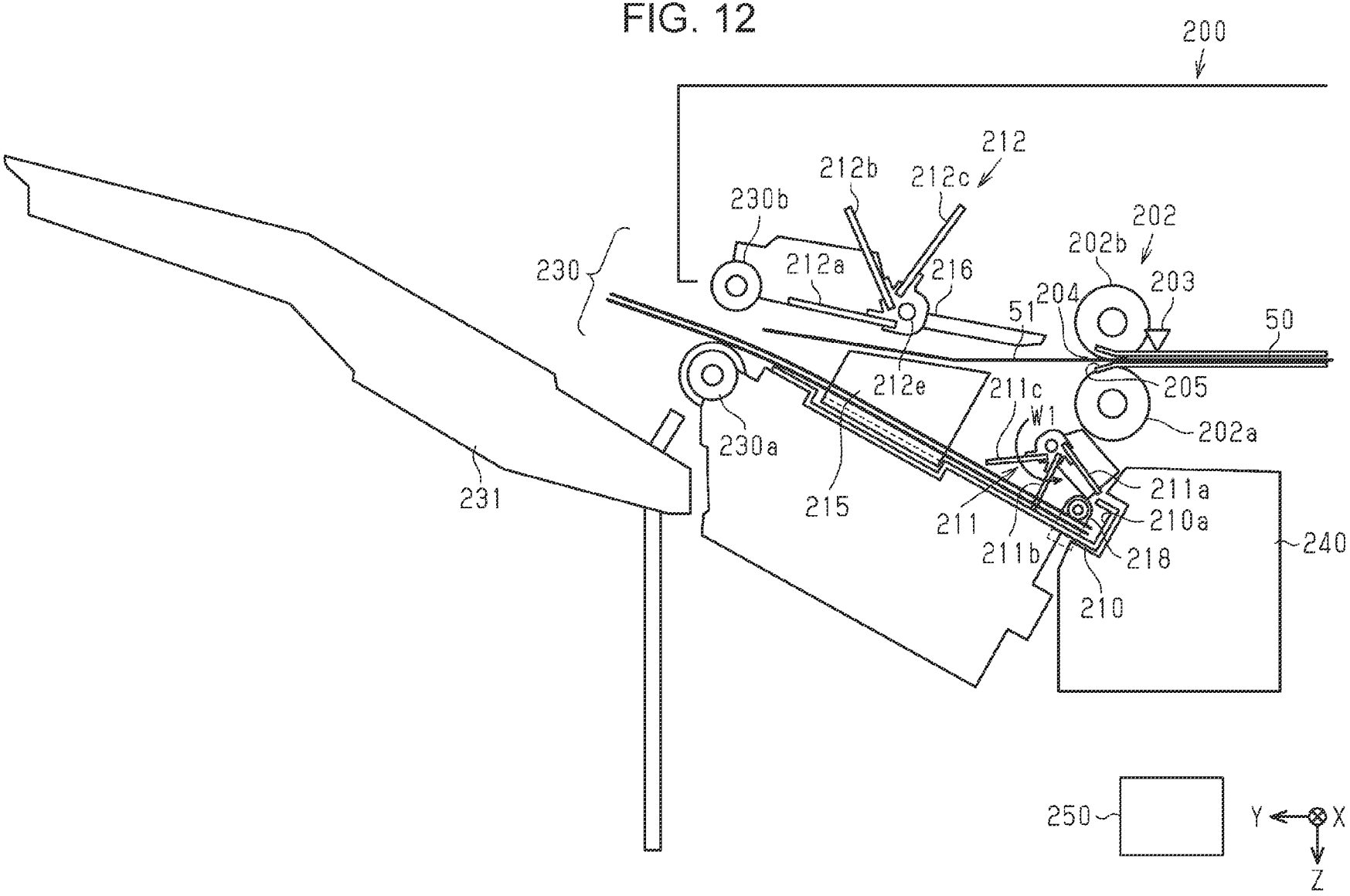
FIG. 12 is a schematic side view illustrating a state of a post-processing device when a medium is discharged to an intermediate tray in a second embodiment.

As illustrated in FIG. 12, the rear-end alignment portion 210*a* is a reference surface when the rear end of the medium 50 is aligned in the transport direction Y1. The pair of side-end alignment members 215 have reference surfaces at a time of aligning the side ends of the medium 50 and are arranged side by side in the width direction X to pinch the medium 50 transported to the intermediate tray 210. The pair of side-end alignment members 215 align the side ends of the medium 50 by repeating an operation of pinching the medium 50 in the width direction.

As illustrated in FIG. 12, the post-processing device 200 includes the control portion 250. The control portion 250 controls the operation of the first transporting member 211, the operation of the second transporting member 212, the operation of the side-end alignment members 215, and the operation of the post-processing mechanism 240.

The post-processing device 200 includes a thickness detection sensor 218 as an example of the detection portion 300 (refer to FIG. 20) detecting the transporting state of the medium 50 in the intermediate tray 210. The detection portion 300 (refer to FIG. 20) is a sensor detecting a cumulative thickness of the medium 50 stacked on the intermediate tray 210.

The thickness detection sensor 218 as an example of the detection portion 300 (refer to FIG. 20) is a sensor detecting passage of an end portion of the medium 50. The control portion 250 detects the transporting state of the medium 50 in the intermediate tray 210 based on information about the passage of the end portion of the medium 50 detected by the thickness detection sensor 218.

For example, the thickness detection sensor 218 is configured with a roller pressed against the medium 50 on the intermediate tray 210 with a significantly small force, and a linear sensor outputting a distance between a front surface of the intermediate tray 210 and a front surface of the roller. When the control portion 250 detects a discontinuous increase in output of the linear sensor, the control portion 250 determines that one sheet of the medium 50 is increased between the roller and the front surface of the intermediate tray 210.

The thickness detection sensor 218 is disposed at an end portion upstream in the transport direction Y1 above the intermediate tray 210. When the medium 50 is transported by the first transporting member 211, the control portion 250 detects the transporting state of the medium 50 based on an increase in cumulative thickness of the medium 50 stacked on the intermediate tray 210.

Figure 13:
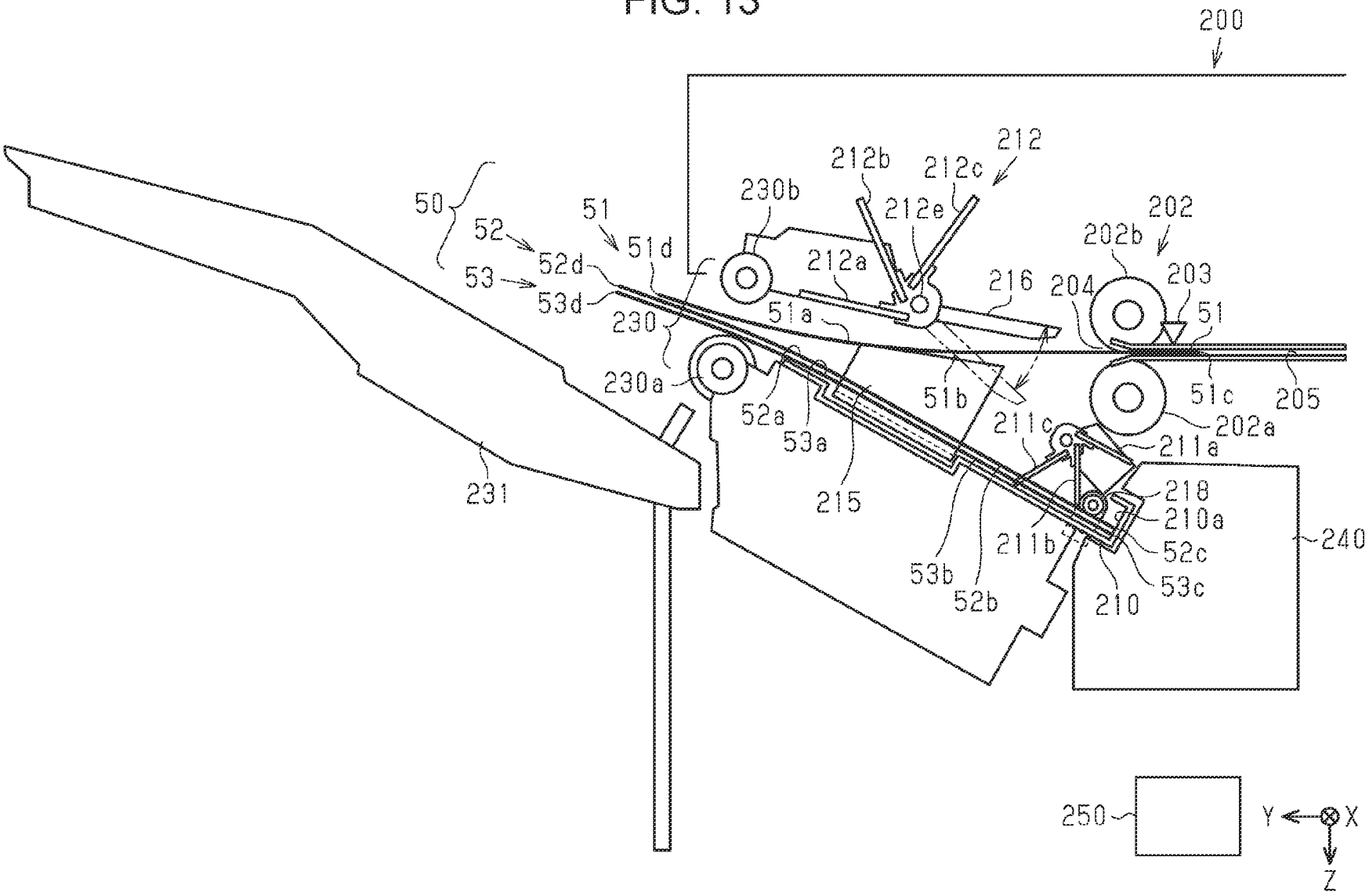
FIG. 13 is a schematic side view illustrating the state of the post-processing device immediately before completion of discharge of the medium to the intermediate tray in the second embodiment.

As illustrated in FIG. 13, the medium 50 on which the first transporting member 211 performs the first transporting operation will be referred to as the first medium 51. When the first medium 51 is transported and the first transporting operation is performed, the medium 50 stacked uppermost on the intermediate tray 210 will be referred to as the second medium 52. The transporting operation of the first transporting member 211 will be referred to as the first transporting operation.

The reception sensor 203 is arranged at a position slightly upstream of the intermediate discharge roller pair 202 in the transport direction Y1. The first medium 51 is transported by the intermediate discharge roller pair 202. A surface of the medium 50 on an intermediate tray 210 side when the medium 50 is stacked on the intermediate tray 210 will be referred to as a back surface, and a surface of the medium 50 on an opposite side from the rear surface will be referred to as the front surface. The front surface of the medium 50 and the back surface of the medium 50 will be collectively referred to as the medium surface. When a front end 51*d* of the first medium 51 passes through the intermediate discharge roller pair 202, the first medium 51 falls onto the second medium 52.

When the first medium 51 falls, the medium falling member 216 accelerates falling of the first medium 51 by causing the medium falling member 216 to pivot clockwise for a short time period by the electric motor 235 (refer to FIG. 20) and immediately pivot counterclockwise for a short time period to return to the original position.

Immediately after the first medium 51 falls to the intermediate tray 210, the first transporting member 211 and the second transporting member 212 stop at an angle at which the first transporting member 211 and the second transporting member 212 are not in contact with the first medium 51. Hereinafter, this angle will be referred to as the "standby angle".

Figure 14:
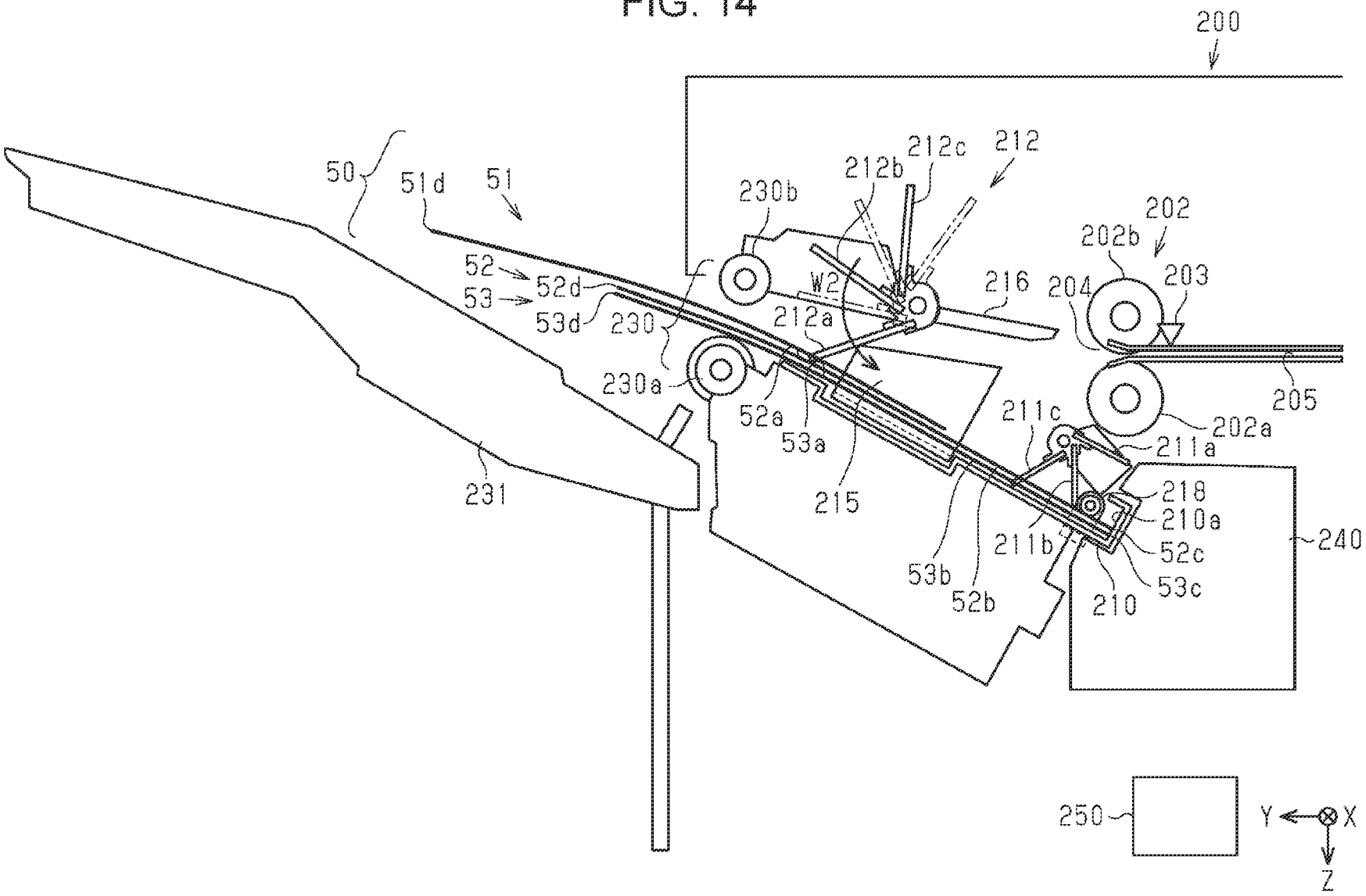
FIG. 14 is a schematic side view illustrating the state of the post-processing device when a second transporting member starts performing a transporting operation on the medium in the second embodiment.

As illustrated in FIG. 14, after an elapse of the second processing time period Δ2 (refer to FIG. 19) after the rear end 51*c* of the first medium 51 passes through the reception sensor 203, the control portion 250 starts controlling the operation of the second transporting member 212 arranged above the intermediate tray 210. That is, the second transporting member 212 starts rotating in the W2 direction and transports the first medium 51 in a direction of the rear-end alignment portion 210*a* present upstream in the transport direction Y1.

Figure 15:
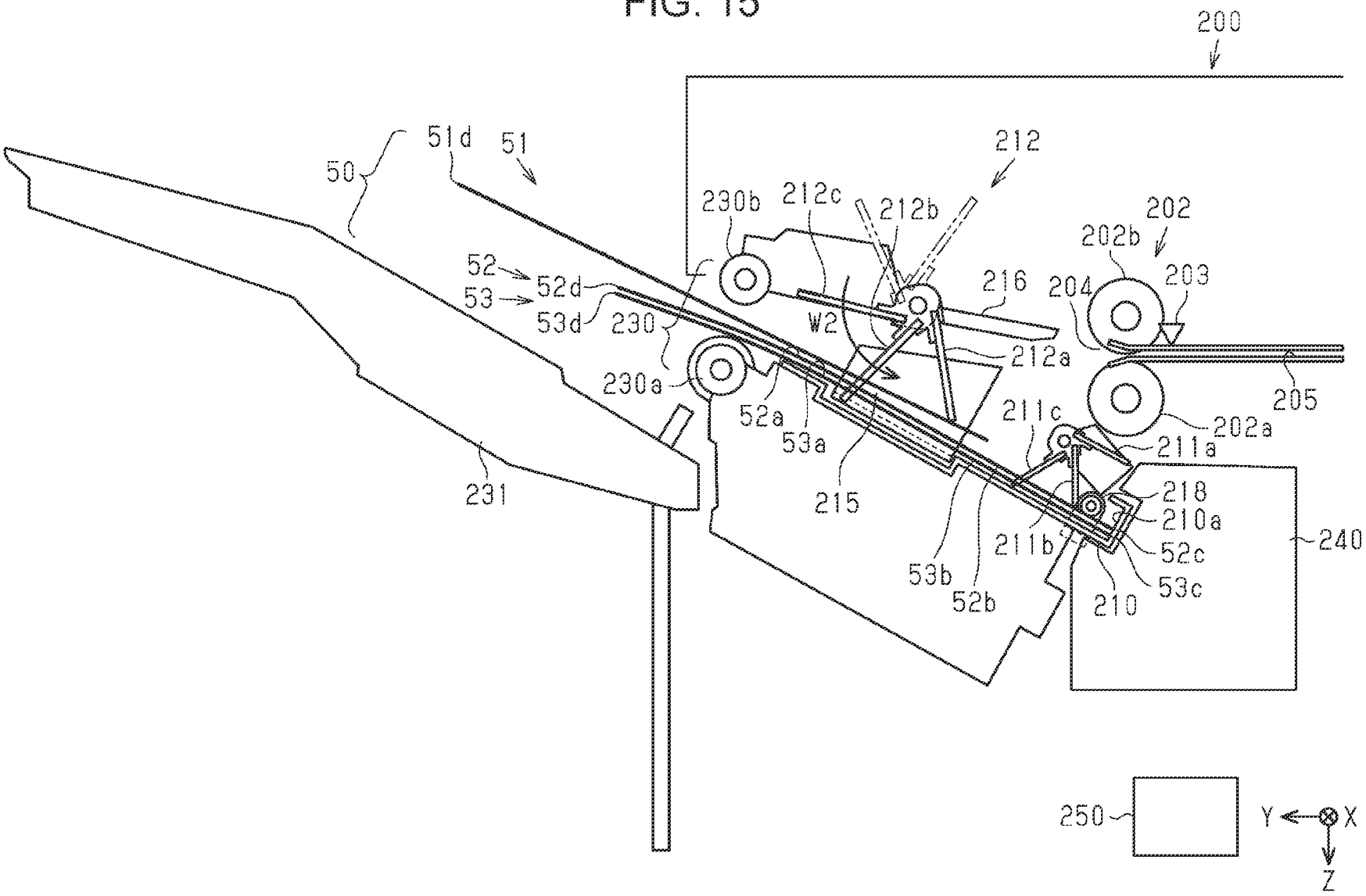
FIG. 15 is a schematic side view illustrating the state of the post-processing device when the second transporting member transports the medium in the second embodiment.

As illustrated in FIG. 15, the intermediate tray 210 is arranged in an inclined position in which the intermediate tray 210 is inclined in a direction in which the upstream end of the intermediate tray 210 in the transport direction Y1 is positioned below the downstream end of the intermediate tray 210 in the vertical direction Z. Thus, by the gravity, a force in a direction of sliding down along the upper surface of the intermediate tray 210 upstream in the transport direction Y1 acts on the first medium 51 that has fallen onto the intermediate tray 210. The second transporting member 212 rotates and transports the first medium 51 upstream in the transport direction Y1 along the upper surface of the intermediate tray 210. The transporting operation of the second transporting member 212 will be referred to as the second transporting operation.

Figure 16:
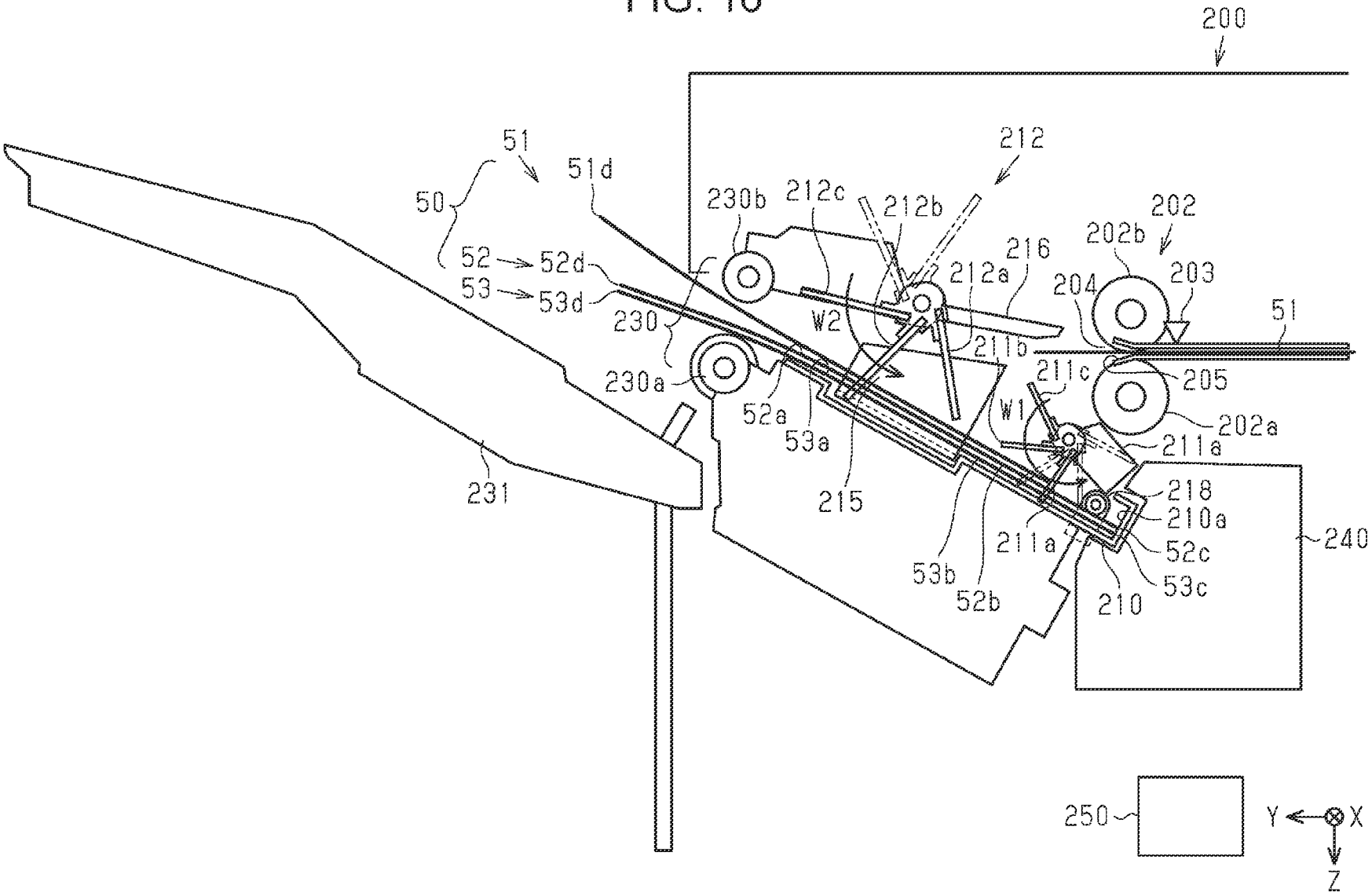
FIG. 16 is a schematic side view illustrating the state of the post-processing device when a first transporting member and the second transporting member transport the medium in the second embodiment.

As illustrated in FIG. 16, when the rear end 51*c* of the first medium 51 reaches the first transporting member 211, the control portion 250 starts controlling the first transporting operation of the first transporting member 211 arranged upstream in the transport direction Y1 above the intermediate tray 210. A time of reaching means a timing that is immediately before the rear end of the medium 50 abuts the first transporting member 211, and at which the first blade 211*a* transports the front surface 51*a* of the first medium 51 with the rear end of the medium 50 not abutting the first blade 211*c* of the first transporting member 211 when the first transporting member 211 is changed to the height of the first position and starts rotating (refer to FIG. 15). The first medium 51 is transported upstream in the transport direction Y1 by the first transporting operation. That is, after the rear end 51*c* of the first medium 51 passes through the transport path 17, the first transporting member 211 starts the first transporting operation of transporting upstream in the transport direction Y1 in the first position by the first rotation motor 213 (refer to FIG. 20).

The first position is a position in which the first transporting member 211 rotates in the W1 direction at a predetermined height and transports the rear end 51*c* of the first medium 51 to the rear-end alignment portion 210*a*. The height of the first transporting member 211 is a distance between the stacking bottom surface 210*b* of the intermediate tray 210 and the first rotation center 211*e* (refer to FIG. 24) of the first transporting member 211. The predetermined height is a height appropriate for the user to transport the medium 50 of a type recommended to be used in the printing device 13. The control portion 250 can change, by the first upward/downward movement motor 253 (refer to FIG. 20), the height of the first rotation center 211*e* (refer to FIG. 24) of the first transporting member 211 when the position of the first transporting member 211 is the first position.

Figure 17:
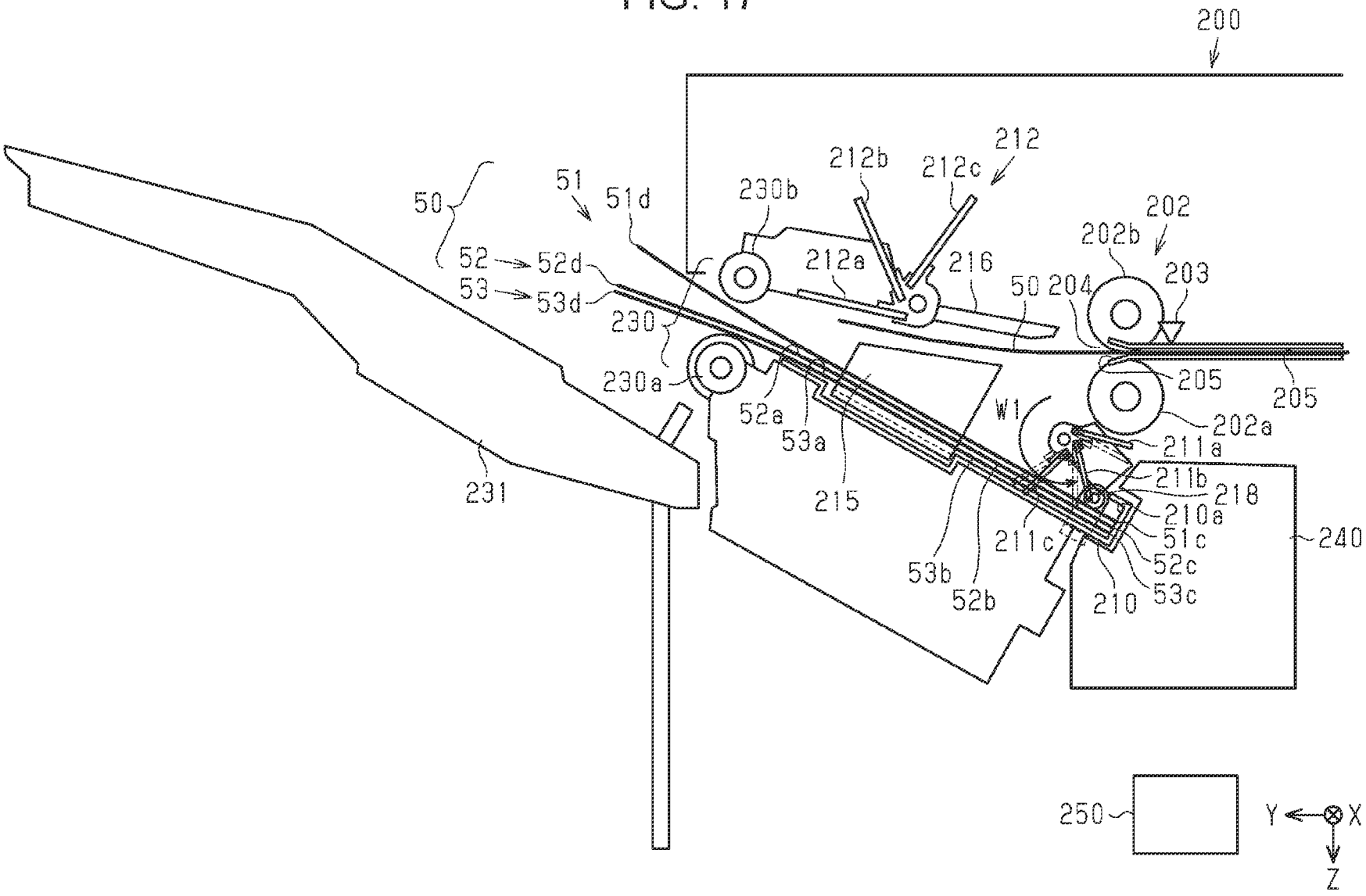
FIG. 17 is a schematic side view illustrating the state of the post-processing device when the first transporting member aligns the medium to a rear-end alignment portion in the second embodiment.

As illustrated in FIG. 17, the first transporting member 211 causes the rear end 51*c* of the first medium 51 to pass through the thickness detection sensor 218 by rotating in the W1 direction and generating a force of transporting the first medium 51. When the thickness detection sensor 218 detects a discontinuous change in cumulative thickness of the medium 50 stacked on the intermediate tray 210 by a thickness of one sheet of the medium 50, the control portion 250 determines that the rear end 51*c* of the first medium 51 has passed through the thickness detection sensor 218.

When the thickness detection sensor 218 detects a discontinuous change in cumulative thickness, an amount of the detected discontinuous change may be greater than a value of a thickness of one sheet of the medium 50. For example, when the amount of the detected discontinuous change is a value greater than a thickness of two sheets of the media 50, the control portion 250 may determine that the first medium 51 of which the front end is folded is transported, and may stop the post-processing device 200 and notify the user by display on a liquid crystal display or the like of the printing device 13. The control portion 250 may perform the processing for when jamming occurs. For example, when the amount of the detected discontinuous change is a value exceeding a thickness of one sheet of the medium 50 and then, the amount of change in cumulative thickness is immediately changed to a value of a thickness of one sheet of the medium 50, the control portion 250 may determine that the rear end 51*c* of the first medium 51 in a state where a front end part thereof is curled upward has passed through the thickness detection sensor 218, and continue a normal operation.

When the cumulative thickness is gradually increased immediately after the thickness detection sensor 218 detects a discontinuous change in cumulative thickness, the control portion 250 may determine that the rear end 51*c* of the first medium 51 in a state where the front end part thereof is curled downward has passed, and continue the normal operation. When the increase in cumulative thickness exceeds a predetermined thickness, the control portion 250 may determine that the intermediate tray is blocked by curling or buckling of the rear end 51*c* of the transported first medium 51, and may notify the user or perform the processing for when jamming occurs. For example, the predetermined thickness is approximately a thickness of 10 sheets of the media. The predetermined thickness varies depending on rigidity of the medium 50 or a force of pressing the medium 50 by the roller of the thickness detection sensor 218.

Even when the increase in cumulative thickness exceeds the predetermined thickness or the increase in cumulative thickness does not change at a timing at which the thickness detection sensor 218 detects a discontinuous change in cumulative thickness, the control portion 250 may notify the user or perform the processing for when jamming occurs.

The first transporting member 211 causes the rear end 51*c* of the first medium 51 to reach the rear-end alignment portion 210*a*. The first transporting member 211 causes the entire edge of the rear end 51*c* of the first medium 51 to abut the reference surface which is the rear-end alignment portion 210*a*, such that the rear end 51*c* of the first medium 51 is not buckled. The rear-end alignment portion 210*a* comes into contact with the rear end 51*c* of the first medium 51 transported by the first transporting member 211 and aligns the rear end 51*c* of the first medium 51.

A second cumulative number of rotations after the rear end 51*c* of the first medium 51 passes through the thickness detection sensor 218 reaches a second necessary number of rotations necessary for aligning the rear end 51*c* of the first medium 51 to the rear-end alignment portion 210*a*. At this point, the control portion 250 is configured to regulate the second transporting operation.

As a method of regulating the second transporting operation, the control portion 250 may stop rotation of the second transporting member 212 or slow the rotation. In the present embodiment, the control portion 250 stops the second transporting operation.

A timing at which the second transporting operation is stopped may be immediately before the rear end 51*c* of the first medium 51 is aligned to the rear-end alignment portion 210*a*, or may be a timing at which alignment is performed. However, the timing is earlier than a timing at which the first transporting member 211 stops the first transporting operation. The control portion 250, by the second rotation motor 214 (refer to FIG. 20), stops rotation of the second transporting member 212 at a timing at which the rotation position of the second transporting member 212 is the position of the standby angle.

As illustrated in FIG. 17, when the entire edge of the rear end 51*c* of the first medium 51 abuts the surface of the rear-end alignment portion 210*a*, the control portion 250 moves the side-end alignment members 215 in the +X direction or the −X direction. That is, the side-end alignment members 215 align the side ends of the first medium 51 by pinching both side ends of the first medium 51 between the reference surfaces of the pair of side-end alignment members 215 and separating from the first medium 51.

In the present embodiment, the control portion 250 continues rotating the first transporting member 211 at least while the side-end alignment members 215 align the side ends of the first medium 51. When the side ends of the first medium 51 are aligned and the first transporting member 211 aligns the rear end of the first medium 51 to the rear-end alignment portion 210*a*, all media 50 stacked on the intermediate tray 210 are aligned to the rear-end alignment portion 210*a*.

That is, when the side ends of the first medium 51 are aligned and alignment of the side ends of the first medium 51 is finished, a first cumulative number of rotations after the rear end 51*c* of the first medium 51 passes through the thickness detection sensor 218 reaches a first necessary number of rotations necessary for aligning the rear end 51*c* of the first medium 51 to the rear-end alignment portion 210*a*. At this point, the control portion 250 is configured to regulate the first transporting operation.

As a method of regulating the first transporting operation, the control portion 250 may stop rotation of the first transporting member 211 or slow the rotation.

As a method of regulating the first transporting operation, the control portion 250 may change the first transporting member 211 to the second position. In a state where the first transporting member 211 is abutting the first medium 51, the control portion 250 can change the first transporting member 211 to the second position for pressing the first medium 51 by the first transporting member 211, by stopping the transporting operation of the first transporting member 211 and decreasing the height of the first transporting member 211.

The first transporting member 211 and the second transporting member 212, by rotating by the first necessary number of rotations and the second necessary number of rotations, respectively, can securely cause the rear end 51*c* of the first medium 51 to abut the rear-end alignment portion 210*a* and align the rear end 51*c* of the first medium 51. Thus, when the first cumulative number of rotations and the second cumulative number of rotations that are cumulative numbers of rotations of the first transporting member 211 and the second transporting member 212 reach the first necessary number of rotations and the second necessary number of rotations, a determination that the rear end 51*c* of the first medium 51 has reached the rear-end alignment portion 210*a* can be made. The first necessary number of rotations and the second necessary number of rotations can be changed in accordance with the state of the medium. Above is the alignment and stacking operation for the medium 50.

Figure 18:
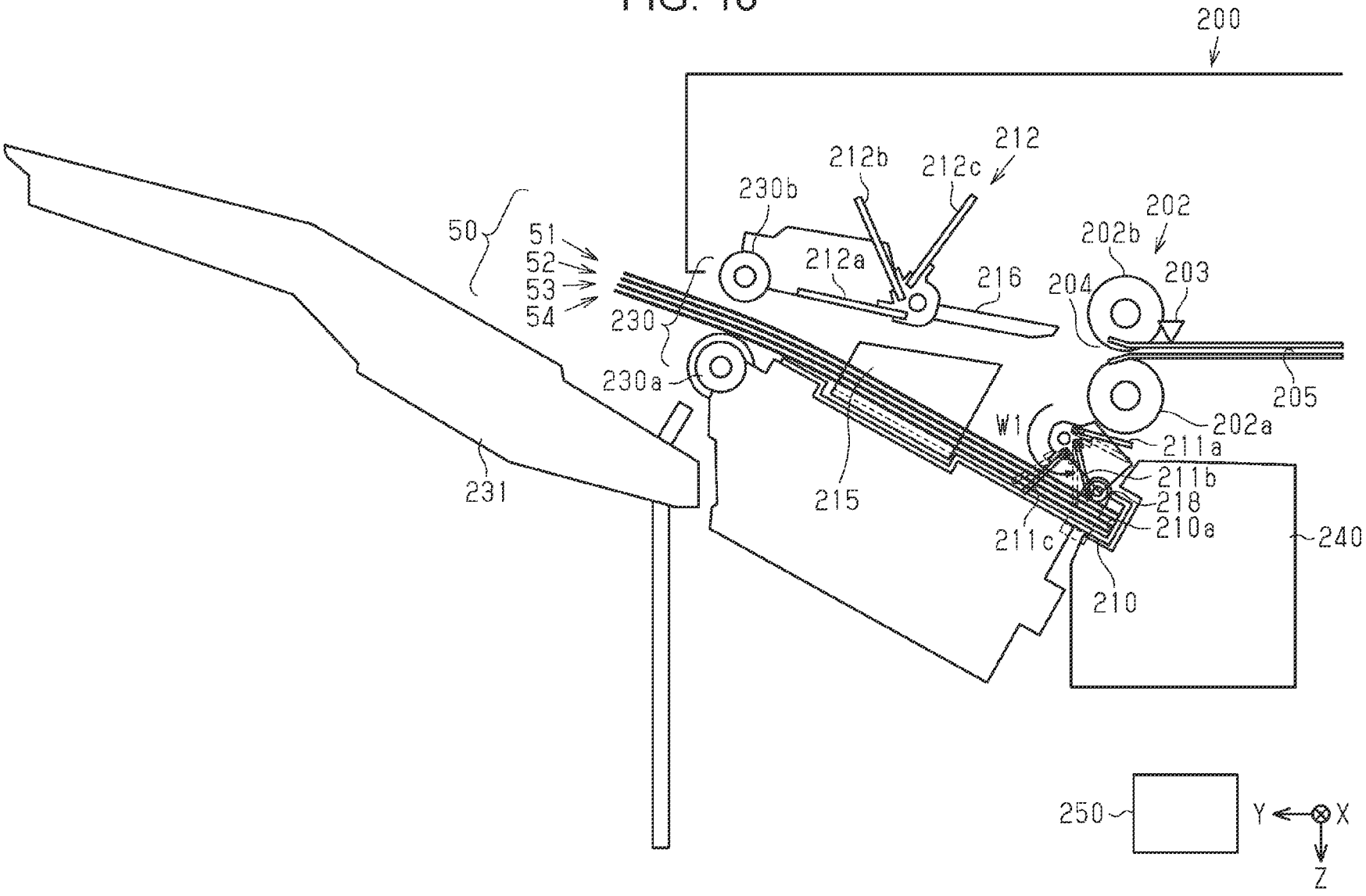
FIG. 18 is a schematic side view illustrating the state of the post-processing device when alignment of the medium is finished in the second embodiment.

As illustrated in FIG. 18, the medium 50 that has passed through the intermediate discharge roller pair 202 is stacked on the intermediate tray 210 one sheet at a time. When the media 50 in number designated by the user are stacked on the intermediate tray 210, the post-processing mechanism 240 performs the post-processing on a bundle of the stacked media 50. The bundle of the media 50 on which the post-processing is performed is discharged, by the discharge roller pair 230, onto the discharge stacker 231 arranged to be movable upward and downward along a front surface of the post-processing device 200.

Motion of Each Portion of Post-Processing Device

Next, the motion of each portion of the post-processing device 200 when the plurality of media 50 are being aligned and stacked on the intermediate tray 210 in a case of changing the position of the first transporting member 211 to the second position from the first position will be described with reference to the timing chart illustrated in FIG. 19. Times t2 to t8 illustrated in FIG. 19 indicate states corresponding to FIG. 12 to FIG. 18, respectively.

The reception sensor 203 detects the presence or the absence of the medium 50. The output of the reception sensor 203 is set to ON when the medium 50 passes, and is set to OFF when the medium does not pass. The rotation speed of the transport motor 208 may be configured to be maintained even when the output of the reception sensor 203 is set to OFF.

The second rotation motor 214 rotates the second transporting member 212. When the second processing time period Δ2 elapses from a timing at which the output of the reception sensor 203 is set to OFF from ON, the second rotation motor 214 is set to ON. That is, the second transporting member 212 starts rotating. When the second transporting member 211 rotates for the second rotation time period N2 after a value of the thickness detection sensor 218 changes, the second rotation motor 214 is set to OFF, and the second transporting member 212 stops rotating. That is, the control portion 250 is configured to regulate the second transporting operation when the second cumulative number of rotations after the rear end 51*c* of the first medium 51 passes through the thickness detection sensor 218 reaches the second necessary number of rotations necessary for aligning the rear end of the first medium 51 to the rear-end alignment portion 210*a*.

The first upward/downward movement motor 253 changes the height of the first transporting member 211. It is possible to switch between the height of the first position that is a position in which the medium 50 is transported, and the height of the second position that is a position in which the medium 50 is pressed. In addition, the first upward/downward movement motor 253 can change the height of the first position. FIG. 19 illustrates a state where the position of the first transporting member 211 is changed between the first position and the second position.

The first rotation motor 213 rotates the first transporting member 211. When a first processing time period Δ1 elapses from a timing at which the output of the reception sensor 203 is set to OFF from ON, the first rotation motor 213 is set to ON. That is, the first transporting member 211 starts rotating.

The side-end alignment motor 256 is set to ON for a short time period after the rear end of the medium 50 reaches the rear-end alignment portion 210*a*, and performs the side-end alignment operation on the medium 50. When the medium 50 is the last medium in units of copies, the side-end alignment members 215 press the side ends of the media bundle on the intermediate tray 210 until the stapling processing is finished. Thus, when the medium 50 is the last paper sheet, a time period in which the side-end alignment motor 256 is ON is lengthened.

When the motion of the medium 50 becomes stable after the side-end alignment operation for the medium 50, the alignment operation for the rear end and the side ends of the medium 50 is completed, and the first rotation motor 213 is set to OFF. That is, the first transporting member 211 stops rotating. At this point, the first transporting member 211 stops rotating by causing the first rotation motor 213 to rotate for N1 after the rear end 51*c* of the first medium 51 passes through the thickness detection sensor 218, and stop rotating. At the same time, the first upward/downward movement motor 253 changes the height of the first transporting member 211 to the height of the second position from the height of the first position. That is, when the first cumulative number of rotations reaches the first necessary number of rotations, the control portion 250 stops the first transporting operation of the first transporting member 211 in a state where the first transporting member 211 is abutting the first medium 51. The control portion 250 changes the first transporting member 211 to the second position for pressing the first medium 51 by the first transporting member 211, by decreasing the height of the first transporting member 211.

When the subsequent medium 50 is discharged onto the intermediate tray 210 with the height of the first transporting member 211 set to the height of the second position by the first upward/downward movement motor 253, the second rotation motor 214 is set to ON, and the second transporting member 212 starts rotating. That is, when the first transporting member 211 is in the second position, the control portion 250 starts the second transporting operation of causing the second transporting member 212 to transport the first medium 51 upstream in the transport direction Y1.

When the rear end of the subsequent medium 50 reaches the first transporting member 211, the first upward/downward movement motor 253 changes the height of the first transporting member 211 to the height of the first position from the height of the second position, and the first rotation motor 213 rotates the first transporting member 211 again. That is, the control portion 250 is configured to cause the first transporting member 211 to return to the first position from the second position and start the first transporting operation again after the second transporting member 212 transports the first medium 51 by a predetermined amount. The predetermined amount is an amount with which the rear end 51*c* of the first medium 51 reaches the first transporting member 211.

In the present embodiment, the post-processing mechanism 240 is a stapler. When the medium 50 is the last medium in units of copies, the post-processing mechanism 240 performs the stapling processing on the media bundle while the side-end alignment members 215 press the side ends of the media bundle on the intermediate tray 210 from both sides.

The nip motor 229 is set to ON during the stapling processing and during discharge of the media bundle to the discharge stacker 231. The discharge roller pair 230 nips the media bundle from upward and downward directions. The discharge motor 232 is set to ON at the same as finish of the stapling processing, and the media bundle is discharged to the discharge stacker 231.

Block Diagram of Printing System Related to Alignment of Medium

Figure 20:
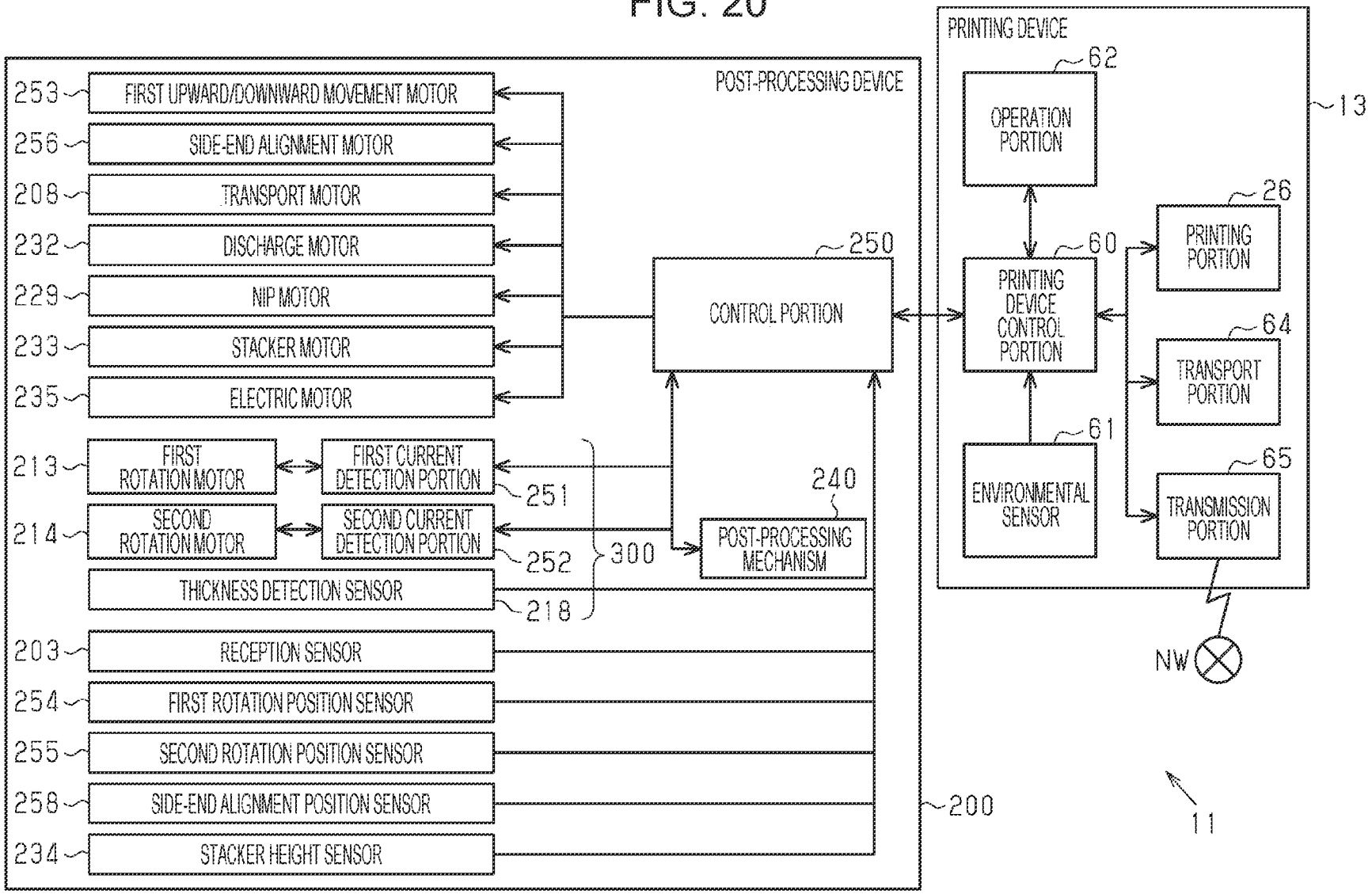
FIG. 20 is a block diagram illustrating a part of a printing system related to alignment of the medium in the second embodiment.

As illustrated in FIG. 20, the printing system 11 is configured with the printing device 13 and the post-processing device 200. The post-processing device 200 includes the plurality of detection portions 300 detecting the transporting state of the medium 50 in the intermediate tray 210. In the present embodiment, the post-processing device 200 includes the thickness detection sensor 218 as an example of the detection portion 300.

The printing device 13 is controlled by a printing device control portion 60. The printing device 13 includes the printing device control portion 60, a transmission portion 65, a printing portion 26, a transport portion 64, an operation portion 62, and an environmental sensor 61. While the printing device 13 may include other elements depending on functions of the printing device 13, elements not related to alignment of the medium 50 in the post-processing device 200 are not illustrated in FIG. 20.

As illustrated in FIG. 20, the transmission portion 65 is connected to an external network NW and receives a printing command from a server, a computer, or the like connected to the network NW. The printing command includes a size of the medium 50, a basis weight of the medium 50, the number of printing pages and printing data in each page, designation of single-sided printing or double-sided printing, the number of printing copies, a type of post-processing, and other printing information necessary for printing.

When the medium 50 of the size and the basis weight designated by the server, the computer, or the like is accommodated in the cassette 21 (refer to FIG. 1) of the printing device 13, the transmission portion 65 receives the printing command. The transmission portion 65 notifies the printing device control portion 60 of the printing information. The printing device control portion 60 performs printing by controlling operations of the printing portion 26 and the transport portion 64 in accordance with the printing command received from the printing device control portion 60 by the transmission portion 65.

As illustrated in FIG. 20, the environmental sensor 61 measures a temperature and humidity of a position at which the environmental sensor 61 is installed, and notifies the printing device control portion 60 of the temperature and the humidity. A purpose of the environmental sensor 61 is to measure a temperature and humidity of an environment of the printed medium 50. Thus, the environmental sensor 61 is installed close to the printing portion 26.

The operation portion 62 is, for example, a touch panel that doubles as a liquid crystal display. Even when the printing system 11 does not receive the printing command through the network NW, the printing system 11 can perform printing in accordance with the printing command from the operation portion 62.

As illustrated in FIG. 20, the printing device control portion 60 included in the printing device 13, and the control portion 250 included in the post-processing device 200 exchange information with each other. When the medium 50 is transported to the post-processing device 200 from the printing device 13, the printing device control portion 60 notifies the control portion 250 of the size of the medium 50 and the basis weight of the medium 50 to be transported. When the medium 50 is the last medium in units of copies, a signal indicating the last medium in units of copies, and the type of post-processing for the units of copies are notified.

For example, when 10 sheets of the media 50 are bound by the stapling processing and discharged to the discharge stacker 231, the printing device control portion 60 notifies the control portion 250 of the size of the medium 50 and the basis weight of the medium 50 to be transported for the first sheet to the ninth sheet. In the case of the 10th sheet, the signal indicating the last medium of a medium set and the stapling processing as the post-processing are notified in addition to the size of the medium 50 and the basis weight of the medium 50 to be transported. Accordingly, 10 sheets of the media 50 are bound by the stapling processing and discharged to the discharge stacker 231. The control portion 250 notifies the printing device control portion 60 that all processing has been normally finished. The transmission portion 65, through the network NW, notifies the server, the computer, or the like from which the printing command is received, that printing and the post-processing have been normally finished.

As illustrated in FIG. 20, in the present embodiment, as water content information affecting a medium surface state of the medium 50, the control portion 250 of the post-processing device 200 acquires, from the printing device control portion 60 of the printing device 13, information about a printing duty of the medium 50 and information related to a printing time period of the medium 50. Furthermore, as the water content information affecting the medium surface state of the medium 50, the control portion 250 acquires, from the printing device control portion 60 of the printing device 13, the temperature of the environment in which the printing device 13 is installed, and the humidity of the environment in which the printing device 13 is installed, which are obtained by the environmental sensor 61. The medium surface state includes not only a water content ratio but also rippling, partial deformation, and curling of the medium 50 generated by a water content or a partial water content.

The printing duty refers to a liquid ejecting amount per area of the medium 50. The printing duty is indicated by 0% to 100%. In the present embodiment, for example, the liquid ejecting portion 27 performs printing in three types of dot sizes including large, medium, and small sizes. The liquid ejecting amount per area of the medium 50 at a time of solid printing of performing printing by ejecting liquid droplets of large dots of the maximum dot size using all nozzles is set to a printing duty of 100%. That is, the printing duty is a parameter that is set to 100% for the liquid ejecting amount per area at the time of solid printing. When dot sizes of liquid ejected using all nozzles of the liquid ejecting portion 27 are the same, the printing duty is increased as printing resolution is increased. The liquid ejecting portion 27 may be configured to eject liquid of one type of dot size.

The information related to the printing time period of the medium 50 includes a printing time period in the medium 50 printed with liquid ejected by the liquid ejecting portion 27, and a standby time period after printing in the medium 50 printed with liquid ejected by the liquid ejecting portion 27. The information related to the printing time period of the medium 50 may include an in-printing device transport time period in the medium 50 printed with liquid ejected by the liquid ejecting portion 27. The information related to the printing time period of the medium 50 includes both of information related to the front surface of the medium and information related to the back surface of the medium.

In the following description, the printing time period in the medium 50 printed with liquid ejected by the liquid ejecting portion 27 will be referred to as the "printing time period", and the standby time period after printing in the medium 50 printed with liquid ejected by the liquid ejecting portion 27 will be referred to as the "standby time period".

The standby time period is a time period in which the medium 50 stands by in the printing device 13 when the printing duty is high. The standby time period is set for preventing a state where the medium 50 cannot be normally transported through the transport path 17 due to a significant increase in water content ratio of the medium 50 when the basis weight of the medium 50 is small and the printing duty is high. By setting the standby time period, the water content ratio of the medium 50 is decreased, and the medium 50 can be transported.

The standby time period is a time period for decreasing the water content ratio of the medium 50 until the medium 50 can be transported, by adjusting a time period in which the medium 50 stands by after printing in accordance with the printing duty of the medium 50. Thus, the water content ratio of the medium 50 almost does not change by the standby time period. However, as the printing duty is increased, the standby time period is lengthened. Thus, as the standby time period is lengthened, the medium surface state is degraded by contraction of the medium surface during drying of the medium 50 in the standby time period. That is, the standby time period does not affect improvement of the medium surface state.

The printing duty includes a front surface duty that is a duty of liquid ejected to the front surface of the medium 50 transported by the transport path 17, and a back surface duty that is a duty of liquid ejected to the back surface of the medium 50 transported by the transport path 17.

The printing duty in a contact region between the first transporting member 211 and the medium 50 or a region overlapping with the contact region on the front surface of the medium 50 will be referred to as a contact portion front surface duty. The printing duty in a region overlapping with a contact region between the first transporting member 211 and the medium 50 on the back surface of the medium 50 will be referred to as a contact portion back surface duty. The contact portion front surface duty and the contact portion back surface duty will be collectively referred to as a contact portion duty.

As illustrated in FIG. 20, in the present embodiment, when the medium 50 is transported to the post-processing device 200 from the printing device 13, the printing device control portion 60 notifies the control portion 250 of the front surface duty, the back surface duty, the contact portion front surface duty, and the contact portion back surface duty.

For any of the contact portion front surface duty and the contact portion back surface duty, a region that is not completely the same as the contact region between the first transporting member 211 and the medium 50 or the region overlapping with the contact region may be used. A region including the contact region between the first transporting member 211 and the medium 50 or the region overlapping with the contact region may be used. For example, the medium 50 may be divided into three regions in the transport direction Y1, and a region of ⅓ of the medium 50 on a rear end side of the medium 50 may be used. Alternatively, for example, the medium 50 may be divided into a plurality of regions more than or equal to three in the width direction X, and two regions with which the first transporting member 211 comes into contact among the plurality of regions may be used. A region not including the contact region between the first transporting member 211 and the medium 50 or the region overlapping with the contact region may also be used as long as the region is nearby.

The transport time period after printing in the medium 50 printed with liquid ejected by the liquid ejecting portion 27 is calculated by the control portion 250 based on a job content of which the control portion 250 is notified by the printing device control portion 60. A time period in which the medium 50 is transported through the transport path 17 of the printing device 13 is calculated by the control portion 250 using a transport speed of the medium 50 in the transport path 17 of the printing device 13 and a transport distance of the transport path 17 of the printing device 13. A time period in which the medium 50 is transported through the transport path 17 of the post-processing device 200 is calculated by the control portion 250 using the transport speed of the medium 50 in the transport path 17 of the post-processing device 200 and a transport distance of the transport path 17 of the post-processing device 200. The printing device control portion 60 may calculate the time period in which the medium 50 is transported through the transport path 17 of the printing device 13, and notify the control portion 250 of the time period, and the control portion 250 may calculate the time period in which the medium 50 is transported through the transport path 17 of the post-processing device 200.

The control portion 250 calculates the transport time period after printing in the medium 50 printed with liquid ejected by the liquid ejecting portion 27, by adding the time period in which the medium 50 is transported through the transport path 17 of the printing device 13, to the time period in which the medium 50 is transported through the transport path 17 of the post-processing device 200. Hereinafter, the transport time period after printing in the medium 50 printed with liquid ejected by the liquid ejecting portion 27 will be referred to as the "transport time period after printing".

The control portion 250 further uses, in calculation, a transport pitch time period of the medium 50 from the start of the first transporting operation until the subsequent start of the first transporting operation. Hereinafter, a time period from the start of the first transporting operation until the subsequent start of the first transporting operation will be referred to as the "transport pitch time period". The control portion 250 calculates an elapsed time period from when the first medium 51 is printed with liquid ejected by the liquid ejecting portion 27 until the first transporting member 211 starts the first transporting operation. Hereinafter, a time period from when the first medium 51 is printed with liquid ejected by the liquid ejecting portion 27 until the first transporting member 211 starts the first transporting operation will be referred to as the "elapsed time period". At least one of the printing time period, the transport time period after printing, and the transport pitch time period may be used as the elapsed time period.

The control portion 250 may use, as the elapsed time period, only a time period that significantly affects improvement of the medium surface state among time periods constituting the elapsed time period. For example, when the transport time period is significantly long and the transport time period after printing is dominant in the elapsed time period, the control portion 250 may use only the transport time period after printing as the elapsed time period. That is, when the transport time period after printing is dominant in improvement of the medium surface state, the control portion 250 may use only the transport time period after printing as the elapsed time period.

In the present embodiment, the control portion 250 calculates the elapsed time period for a back surface of the first medium 51 and the elapsed time period for the front surface of the second medium 52. In a case of double-sided printing, the elapsed time period is different between the front surface and the back surface of the medium 50. In the present embodiment, in the case of double-sided printing, the surface of the medium 50 printed earlier is the back surface, and the surface of the medium 50 printed later is the front surface. That is, the elapsed time period for the back surface is longer than the elapsed time period for the front surface. Hereinafter, the elapsed time period for the front surface will be referred to as a "front surface elapsed time period", and the elapsed time period for the back surface will be referred to as a "back surface elapsed time period" for distinction.

The back surface elapsed time period of the first medium 51 is calculated using the printing time period for the back surface, the standby time period for the back surface, the printing time period for the front surface, the standby time period for the front surface, and the transport time period after printing. The front surface elapsed time period of the second medium 52 is calculated using the printing time period for the front surface, the standby time period for the front surface, the transport time period after printing, and the transport pitch time period.

The elapsed time period is also affected by the printing duty. For example, when the printing time period and the standby time periods are compared between a high printing duty and a low printing duty, the printing time period and the standby time period are shorter when the printing duty is low. That is, the elapsed time period is short when the printing duty is low.

Relationship Between Medium Surface State of Medium and Parameters

Figure 21:
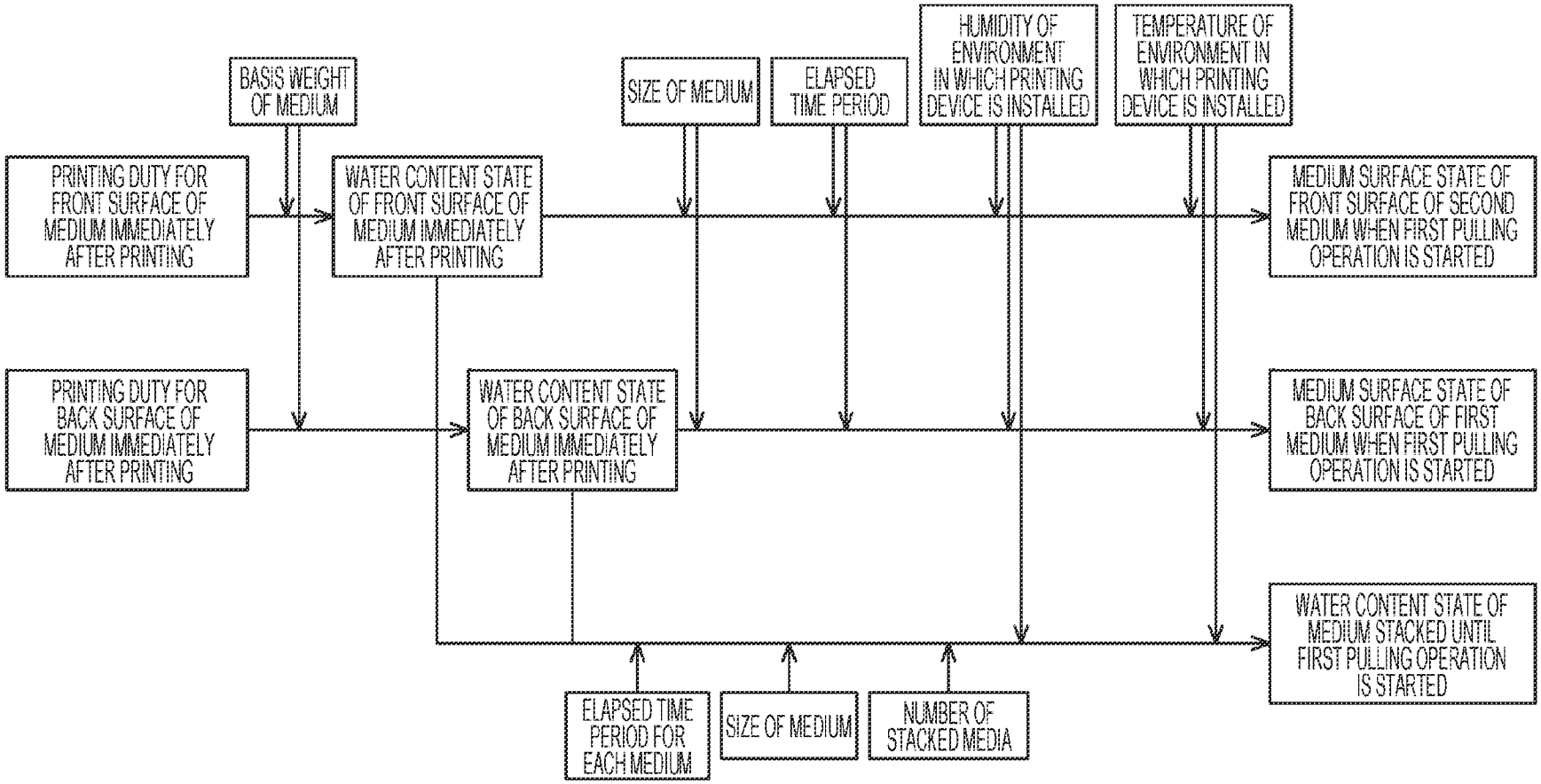
FIG. 21 is a correlation diagram illustrating a relationship between a medium surface state of the medium and parameters.

As illustrated in FIG. 21, a medium surface state of a back surface 51*b* of the first medium 51, a medium surface state of the front surface 52*a* of the second medium 52, and a water content state of the medium 50 including the second medium 52 stacked on the intermediate tray 210 when the first transporting operation is started are affected by a plurality of parameters.

The water content state of the medium 50 immediately after printing is mainly decided by the printing duty of the medium 50 and the basis weight of the medium 50. When the basis weight of the medium 50 is small and the printing duty of the medium 50 is high, a water content amount is increased, and rippling or curling is also increased.

The water content state of the back surface of the medium 50 immediately after printing is mainly decided by the printing duty of the back surface of the medium 50 and the basis weight of the medium 50. When the basis weight of the medium 50 is small and the printing duty of the back surface of the medium 50 is high, the water content amount is increased, and rippling or curling is also increased.

As illustrated in FIG. 21, a medium surface state of the back surface of the first medium 51 when the first transporting operation is started is affected by a medium surface state of the back surface of the medium 50 immediately after printing, the elapsed time period from printing the medium 50, the size of the medium 50, the temperature of the environment in which the printing device 13 is installed, and the humidity of the environment in which the printing device 13 is installed. Hereinafter, the temperature of the environment in which the printing device is installed will be referred to as an "environmental temperature", and the humidity of the environment in which the printing device is installed will be referred to as "environmental humidity".

When the medium surface state of the back surface of the medium 50 immediately after printing is bad, the medium surface state of the back surface 51*b* of the first medium 51 when the first transporting operation is started is degraded. A bad medium surface state means that the water content ratio is high and rippling or curling is large.

When the elapsed time period from printing is long, a drying time period is lengthened. Thus, the water content ratio is decreased. However, most of the case where the elapsed time period is long is a case where printing with a high printing duty is performed and the standby time period is lengthened. Thus, even when the elapsed time period is long and the water content ratio of the medium is decreased, the water content ratio of the medium for which the elapsed time period is greater than or equal to a certain time period is an upper limit water content ratio with which the transport path 17 can transport the medium.

A way the medium surface is changed varies depending on the type of medium. The type of medium 50 includes materials or ingredients of the medium 50, the size of the medium 50, and a grain direction, the basis weight, and the like of the medium 50 when the medium 50 is a paper sheet.

When the environmental humidity is high, the medium 50 does not easily dry, and the medium surface state is degraded, compared to when the environmental humidity is low. When the environmental temperature is low, the medium 50 does not easily dry, and the medium surface state is degraded, compared to when the environmental temperature is high. However, an effect of the environmental temperature is lower than an effect of the environmental humidity.

As illustrated in FIG. 21, the medium surface state of the front surface 52*a* of the second medium 52 when the first transporting operation is started is affected by a water content state of the front surface of the medium 50 immediately after printing, the elapsed time period from printing the medium 50, the size of the medium 50, the environmental temperature, and the environmental humidity. That is, the front surface of the second medium 52 is affected by the same parameters as the back surface of the first medium 51.

As illustrated in FIG. 21, the water content state of the medium 50 stacked until the first transporting operation is started is affected by the water content state of the front surface of the medium 50 immediately after printing, the water content state of the back surface of the medium 50 immediately after printing, the elapsed time period from printing for each medium 50, the size of the medium 50, the number of stacked media 50, the environmental temperature, and the environmental humidity.

In the medium surface state of the medium 50 stacked until the first transporting operation is started, a shorter elapsed time period from printing for each medium 50 shortens the drying time period and improves the water content state, but is not effective as much as in the case of the first medium 51 or the second medium 52.

When the size of the medium 50 is large, the water content ratio of the medium 50 stacked on the intermediate tray 210 is not easily decreased. The stacked medium 50 starts drying from a location in contact with air. The location in contact with air corresponds to the front surface 52*a* of the second medium 52 stacked uppermost, and four edges of all stacked media 50. That is, the four edges include an edge of the front end, an edge of the rear end, and edges of two side ends.

When the size of the medium 50 is large, a distance from a center of the medium 50 to the four edges is long. Thus, it takes long time to dry the medium 50, and the water content ratio of the stacked medium 50 is not easily decreased. That is, when the size of the medium 50 is large, a difference in water content ratio of the medium 50 stacked on the intermediate tray 210 between a center portion and an end portion is large. Thus, rippling tends to easily occur. This effect is increased as the number of stacked media 50 is increased. Likelihood of occurrence of rippling varies depending on the type of medium 50.

In the water content state of the medium 50 stacked until the first transporting operation is started, higher environmental humidity causes the medium 50 to not dry and rather worsens rippling and degrades the water content state. In addition, a lower environmental temperature does not improve the water content state during drying and degrades the water content state. However, the effect of the environmental temperature is lower than the effect of the environmental humidity.

That is, all of the front surface duty, the back surface duty, the front surface elapsed time period, the back surface elapsed time period, the environmental temperature, the environmental humidity, the size of the medium 50, and the basis weight of the medium 50 are parameters of the water content state of the medium 50 when the first transporting operation is started. Hereinafter, the printing duty in the first medium 51 will be referred to as a "first front surface duty" and a "first back surface duty". Similarly, the printing duty in the second medium 52 will be referred to as a "second front surface duty" and a "second back surface duty".

In FIG. 21, replacing the "front surface of the medium" with the "contact region between the first transporting member 211 and the medium or the region overlapping with the contact region on the front surface of the medium" shows the same relationship. In addition, replacing the "back surface of the medium" with the "contact region between the first transporting member 211 and the medium or the region overlapping with the contact region on the back surface of the medium" shows the same relationship. That is, both of the contact portion front surface duty and the contact portion back surface duty in each medium 50 are parameters of the water content state of the medium when the first transporting operation is started.

Hereinafter, a "first contact portion front surface duty" and a "first contact portion back surface duty" will be used in the contact region between the first transporting member 211 and the medium 50 or the region overlapping with the contact region. Similarly, a "second contact portion front surface duty" and a "second contact portion back surface duty" will be used in a contact region between the second transporting member 212 and the medium 50. The same applies to the printing duty in the medium 50 stacked below the second medium 52.

The basis weight and the number of stacked media 50 prescribe the height of the media 50 stacked on the intermediate tray 210 and change a distance from each of centers of the transporting members 211 and 212 to the front surface of the first medium 51. These distances change strength of a force of pressing the front surface of the first medium 51 in a vertical direction during the transporting operation performed by the transporting members 211 and 212. A frictional force received by the first medium 51 when the first medium 51 is caused to slide on the front surface of the second medium 52 is given as a product of reaction received from the front surface of the second medium 52 by the first medium 51 and the coefficient of friction between the first medium 51 and the second medium 52. The reaction is increased as the force of pressing the front surface of the first medium 51 by the transporting members 211 and 212 is increased. From this point, the basis weight and the number of stacked media 50 affecting the reaction may be a parameter for deciding the operations of the transporting members 211 and 212 independently of a parameter for deciding the water content state of the medium affecting the coefficient of friction.

Figure 22:
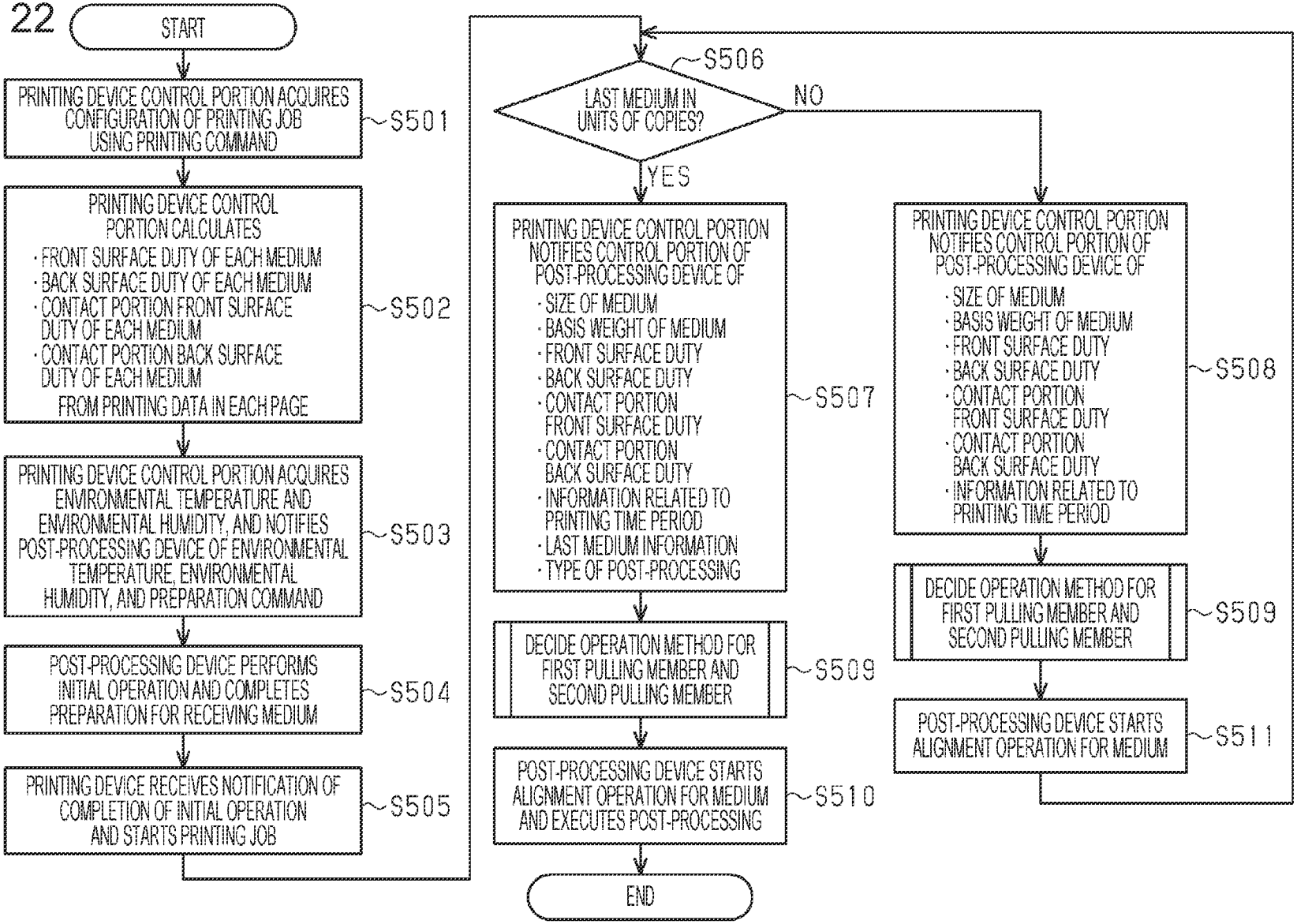
FIG. 22 is a flowchart illustrating a flow of deciding operations of the first transporting member and the second transporting member.

Method of Deciding Operations of First Transporting Member and Second Transporting Member In the post-processing device 200, the medium 50 is aligned on the intermediate tray 210 by causing the control portion 250 to control the operations of the first transporting member 211 and the second transporting member 212. A flow of deciding the operations of the first transporting member 211 and the second transporting member 212 by the control portion 250 will be described with reference to the flowchart illustrated in FIG. 22. FIG. 22 illustrates a case where the number of printing copies is one.

As illustrated in FIG. 22, in step S501, the printing device control portion 60 acquires a configuration of the printing job using the printing command. The configuration of the printing job includes the size of the medium 50 to be used, the basis weight of the medium 50 to be used, the number of printing pages and the printing data in each page, the designation of single-sided printing or double-sided printing, the number of printing copies, and the type of post-processing.

In step S502, the printing device control portion 60 calculates the front surface duty of each medium 50, the back surface duty of each medium 50, the contact portion front surface duty of each medium 50, and the contact portion back surface duty of each medium 50 from the printing data in each page. For example, when the printing job is double-sided printing of 100 pages, four types of duties are calculated in 50 sheets of the media 50 constituting an output matter.

In step S503, the printing device control portion 60 acquires the environmental temperature and the environmental humidity from the environmental sensor 61. The printing device control portion 60 notifies the control portion 250 of the post-processing device 200 of the environmental temperature and the environmental humidity along with a preparation command for the post-processing.

In step S504, the post-processing device 200 performs an initial operation and completes preparation for performing the post-processing by receiving the medium 50.

In step S505, the printing device control portion 60 is notified of completion of the initial operation of the post-processing device 200 by the control portion 250 of the post-processing device 200. The printing device 13 starts the printing job.

In step S506, the printing device control portion 60 determines whether the medium 50 forwarded to the post-processing device 200 after printing is finished is the last medium in units of copies or not the last medium in units of copies. A content of which the control portion 250 is notified by the printing device control portion 60 is different between when the medium 50 is the last medium in units of copies and when the medium 50 is not the last medium in units of copies.

When the medium 50 forwarded to the post-processing device 200 is the last medium in units of copies, step S506 results in YES, and the printing device control portion 60 transitions processing to step S507. When the medium 50 forwarded to the post-processing device 200 is not the last medium in units of copies, step S506 results in NO, and the printing device control portion 60 transitions processing to step S508. Even when the medium 50 forwarded to the post-processing device 200 is the first medium 50 of the printing job, the medium 50 is the last medium in units of copies when only one sheet is printed. Generally, when only one sheet is printed, the discharge portion 104 of the printing device 13 is selected as a discharge destination. When the post-processing device 200 is selected as the discharge destination, the units of copies are configured as a plurality of sheets. Thus, when the first sheet of the medium 50 is forwarded to the post-processing device 200, step S506 results in NO, and the printing device control portion 60 transitions processing to step S508.

In step S508, the printing device control portion 60, when forwarding the medium 50 to the post-processing device, notifies the control portion 250 of the size of the medium 50, the basis weight of the medium 50, the front surface duty, the back surface duty, the contact portion front surface duty, the contact portion back surface duty, and information related to the printing time period. Generally, the sizes and the basis weights of the media 50 are completely the same in units of copies. On rare occasions, a few sheets of media of A3 size may be mixed in units of copies of media of A4 size. In addition, on rare occasions, when stapling is performed in units of copies, the user may designate only two sheets of a cover and a back cover as a medium having a large basis weight.

Figure 23:
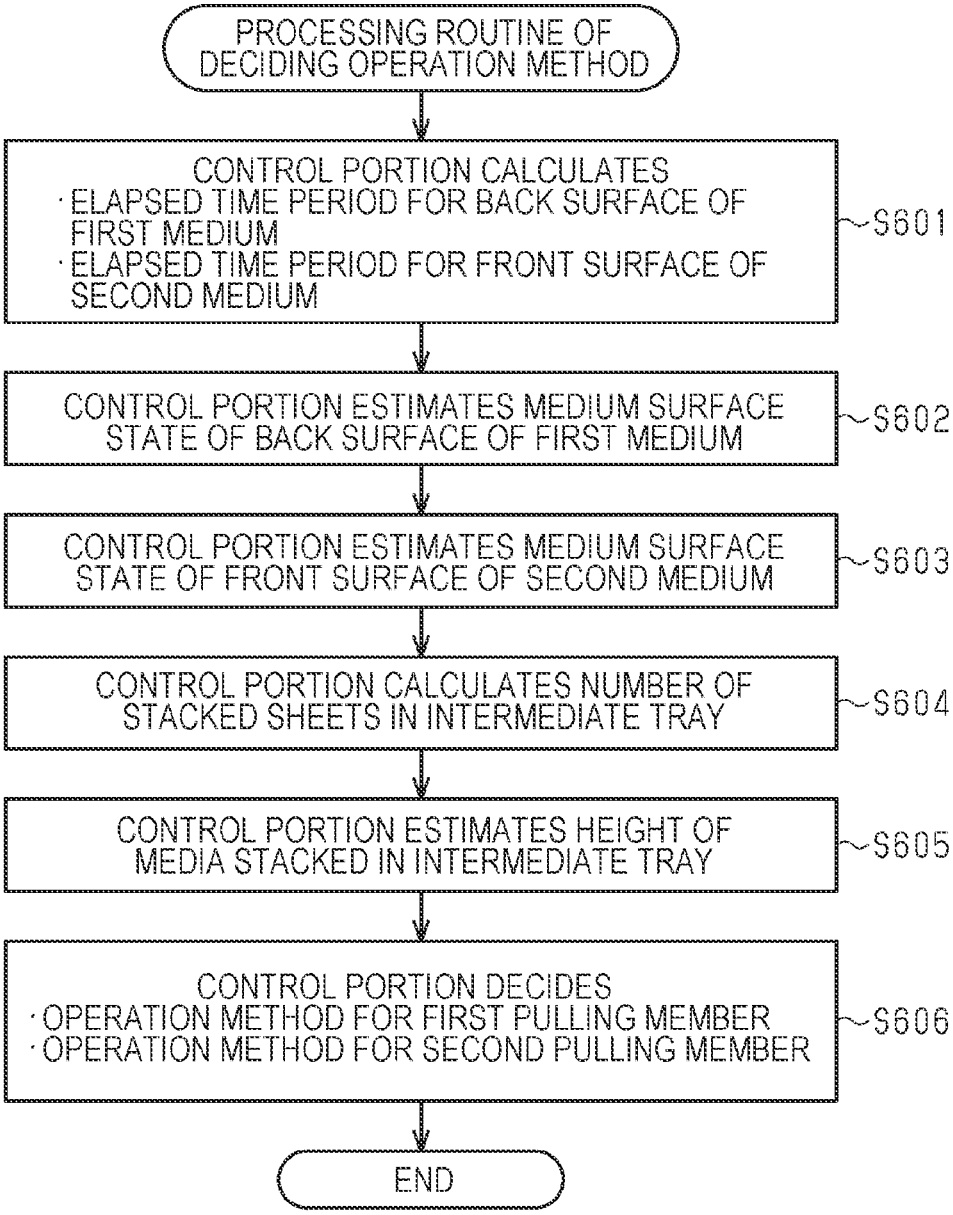
FIG. 23 is a flowchart illustrating a subroutine of deciding operation methods for the first transporting member and the second transporting member.

In step S509, a subroutine illustrated in FIG. 23 for deciding operation methods for the first transporting member 211 and the second transporting member 212 is executed.

In step S511, the post-processing device 200 starts the alignment operation for the medium 50 using the operation methods decided in step S509. When the alignment operation is started, a return is made to step S506, and a transition is made to processing of the second sheet of the medium 50. When the medium 50 forwarded to the post-processing device 200 is the last medium in units of copies, step S506 results in YES, and the printing device control portion 60 transitions processing to step S507.

In step S507, the printing device control portion 60, when forwarding the medium 50 to the post-processing device, notifies the control portion 250 of last medium information and the type of post-processing in addition to the information of which the control portion 250 is notified in step S508.

In step S509, a subroutine illustrated in FIG. 23 for deciding operation methods for the first transporting member 211 and the second transporting member 212 is executed.

In step S510, the post-processing device 200 executes the alignment operation for the medium 50, a post-processing operation, and a discharge operation using the operation methods decided in step S509. When the control portion 250 acquires the type of post-processing, the control portion 250 performs the designated post-processing before the bundle of the media 50 stacked on the intermediate tray 210 is discharged to the discharge stacker. For example, the stapling processing is performed at a designated position on the bundle of the media 50 stacked on the intermediate tray 210. When the control portion 250 acquires the last medium information, the control portion 250 determines that the medium 50 is the last medium in units of copies, and discharges the bundle of the media 50 stacked on the intermediate tray 210 to the discharge stacker 231. The printing device control portion 60 and the control portion 250 of the post-processing device 200 finish processing.

Next, a subroutine of deciding the operation methods for the first transporting member 211 and the second transporting member 212 will be described with reference to the flowchart illustrated in FIG. 23. A case of double-sided printing is illustrated below.

As illustrated in FIG. 23, in step S601, the control portion 250 calculates, from the information related to the printing time period acquired from the printing device control portion 60, the elapsed time period from printing until the transporting operation. In the present embodiment, the control portion 250 calculates the back surface elapsed time period of the first medium 51 and the front surface elapsed time period of the second medium 52.

In step S602, the control portion 250 estimates the medium surface state of the back surface 51*b* of the first medium 51 from a plurality of conditions. The plurality of conditions include the size of the medium 50, the basis weight of the medium 50, the back surface duty, the contact portion back surface duty, and the back surface elapsed time period. As illustrated in FIG. 21, the medium surface state of the back surface 51*b* of the first medium 51 changes depending on the plurality of conditions.

In step S603, similarly, the control portion 250 estimates the medium surface state of the front surface 52*a* of the second medium 52 from a plurality of conditions. The plurality of conditions include the size of the medium 50, the basis weight of the medium 50, the front surface duty, the contact portion front surface duty, and the front surface elapsed time period. As illustrated in FIG. 21, the medium surface state of the front surface 52*a* of the second medium 52 changes depending on the plurality of conditions.

In step S604, the control portion 250 calculates the number of sheets stacked on the intermediate tray 210 when the first transporting member 211 starts the first transporting operation, by counting the medium 50 transported from the printing device 13.

In step S605, the control portion 250 estimates the height of the media 50 stacked on the intermediate tray 210 from a plurality of conditions. The plurality of conditions include the size of each medium 50 stacked on the intermediate tray 210, the basis weight of each medium 50, the front surface duty of each medium 50, the back surface duty of each medium 50, the front surface elapsed time period of each medium 50, the back surface elapsed time period of each medium 50, and the number of stacked sheets in the intermediate tray 210.

As illustrated in FIG. 21, the water content state of the medium 50 stacked on the intermediate tray 210 changes depending on the plurality of conditions. Not all of the plurality of conditions may be used, or the plurality of conditions may be manipulated and then used. For example, the control portion 250 may estimate the height of the media 50 stacked on the intermediate tray 210 using the basis weight of the medium 50, an average value of the duties of the stacked media 50, and an average value of the standby time periods after printing for the stacked media 50. Furthermore, the height of the media 50 may be estimated using only the basis weight of the medium 50 and the number of stacked media 50.

In step S606, the control portion 250 decides the operation methods for the first transporting member 211 and the second transporting member 212 using the size of the medium 50, the basis weight of the medium 50, the medium surface state of the back surface 51*b* of the first medium 51, the medium surface state of the front surface 52*a* of the second medium 52, and the height of the media 50 stacked on the intermediate tray 210.

As illustrated in FIGS. 22 and 23, the front surface duty, the back surface duty, the contact portion front surface duty, the contact portion back surface duty, the front surface elapsed time period, the back surface elapsed time period, the environmental temperature, and the environmental humidity are parameters for the control portion 250 to decide the operation methods for the first transporting member 211 and the second transporting member 212. Furthermore, the size of the medium 50, the basis weight of the medium 50, and the number of stacked sheets in the intermediate tray 210 are parameters for the control portion 250 to decide the operation methods for the first transporting member 211 and the second transporting member 212. At least one of the environmental temperature, the environmental humidity, the size of the medium 50, the basis weight of the medium 50, and the number of sheets of the media 50 stacked on the intermediate tray 210 may be used as a parameter.

As the operation methods for the first transporting member 211 and the second transporting member 212, the control portion 250 decides the first necessary number of rotations of the first transporting member 211, the height of the first transporting member 211, and the second necessary number of rotations of the second transporting member 212 in accordance with the conditions of the parameters.

The control portion 250 regulates the first transporting operation of the first transporting member 211 based on the conditions of the parameters and a detection result of the transporting state of the medium 50 provided by the state detection sensor 217.

The control portion 250 is configured to regulate the first transporting operation when the first cumulative number of rotations after the rear end 51*c* of the first medium 51 passes through the detection portion 300 reaches the first necessary number of rotations necessary for aligning the rear end of the medium 50 to the rear-end alignment portion 210*a*. The control portion 250 decides the first necessary number of rotations in accordance with the detection result of the transporting state of the medium 50 and the conditions of the parameters.

The control portion 250 is configured to regulate the second transporting operation when the second cumulative number of rotations after the rear end 51*c* of the first medium 51 passes through the detection portion 300 reaches the second necessary number of rotations necessary for aligning the rear end of the medium 50 to the rear-end alignment portion 210*a*. The control portion 250 decides the second necessary number of rotations in accordance with the detection result of the transporting state of the medium 50 and the conditions of the parameters.

The printing device control portion 60 and the control portion 250 of the post-processing device 200 finish processing of deciding the operations of the first transporting member and the second transporting member. In a case of single-sided printing, calculation and notification of each parameter of the back surface duty, the contact portion back surface duty, and the back surface elapsed time period are not performed. Thus, the control portion 250 decides the operation methods for the transporting members 211 and 212 without using the parameters related to back surface printing.

Configuration of First Transporting Member

Figure 24:
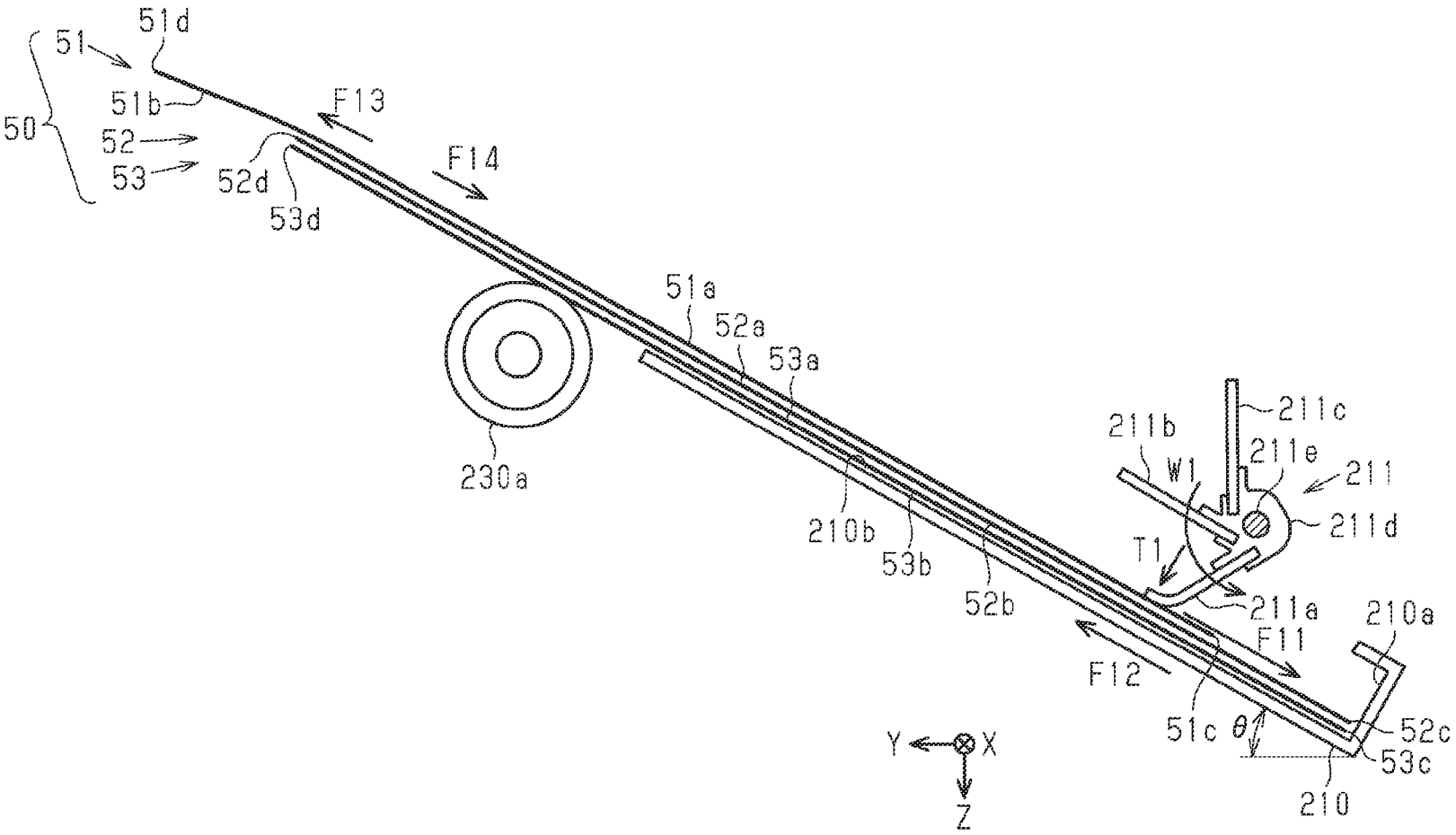
FIG. 24 is a schematic diagram illustrating forces generated when the first transporting member transports the medium.

As illustrated in FIG. 24, first blades 211*a*, 211*b*, and 211*c* included in the first transporting member 211 are formed of a material having a high coefficient of friction and have shapes that are easily bent with a small force. By doing so, it is configured that a change in force of transporting the first medium 51 is decreased even when the height of the stacked media 50 is changed. For example, elongated blades of a rubber material are fixed to a plurality of parts of a first core 211*d*. In the present embodiment, the first blades 211*a*, 211*b*, and 211*c* are fixed to three parts of the first core 211*d*.

The control portion 250 rotates the first transporting member 211 at a constant speed by the first rotation motor 213 (refer to FIG. 20). A transporting force F11 that is a force of transporting the medium 50 by the first blade 211*a* is generated by causing the first blade 211*a* to abut the front surface 51*a* of the first medium 51.

When the first transporting member 211 continues rotating, the transporting force F11 by the first blade 211*b* is generated by causing the first blade 211*b* to abut the front surface 51*a* of the first medium 51. The first blade 211*a* is separated from the front surface 51*a* of the first medium 51 at a timing close to when the first blade 211*b* starts abutting the front surface 51*a* of the first medium 51.

Furthermore, when the first transporting member 211 continues rotating, the transporting force F11 is generated by causing the first blade 211*c* to abut the front surface 51*a* of the first medium 51. The first blade 211*b* is separated from the front surface 51*a* of the first medium 51 at a timing close to when the first blade 211*c* starts abutting the front surface 51*a* of the first medium 51.

Furthermore, when the first transporting member 211 continues rotating, the first blade 211*c* is separated from the front surface 51*a* of the first medium 51. Furthermore, when the first transporting member 211 continues rotating, the first transporting member 211 is set to a position at which all of the first blades 211*a*, 211*b*, and 211*c* do not abut the front surface 51*a* of the first medium 51, and a period in which the transporting force F11 is not generated is present.

As illustrated in FIG. 24, the intermediate tray 210 includes the first rotation position sensor 254 (refer to FIG. 20), and the control portion 250 is configured to recognize positions of the first blades 211*a*, 211*b*, and 211*c*. For example, an optical sensor of a photo-interrupter type is used as the first rotation position sensor 254 (refer to FIG. 20), and a blocking plate, not illustrated, blocking a space between a light emission portion and a light reception portion of the first rotation position sensor is disposed in a rotation shaft of the first transporting member 211.

When the first transporting member 211 rotates once, the blocking plate, not illustrated, of the first transporting member 211 is configured to block the space between the light emission portion and the light reception portion of the first rotation position sensor 254 when the first transporting member 211 is at a predetermined angle. For example, the predetermined angle is an angle when a root of the first blade 211*c* is at a right angle with the stacking bottom surface 210*b* of the intermediate tray 210.

By using when the blocking plate, not illustrated, blocks the space between the light emission portion and the light reception portion of the first rotation position sensor 254 (refer to FIG. 20) as a reference, the control portion 250 can recognize the positions of the first blades 211*a*, 211*b*, and 211*c* from a time period in which the first transporting member 211 rotates, or the number of rotations of the first transporting member 211. That is, the control portion 250 can set a state where the transporting force F11 is not generated, by stopping rotation of the first transporting member 211 in a state where all of the first blades 211*a*, 211*b*, and 211*c* do not abut the front surface 51*a* of the first medium 51.

Furthermore, when the first transporting member 211 continues rotating, the transporting force F11 by the first blade 211*a* is generated again by causing the first blade 211*a* to abut the front surface 51*a* of the first medium 51. This cycle is repeated when the first transporting member 211 continues rotating.

Figure 25:
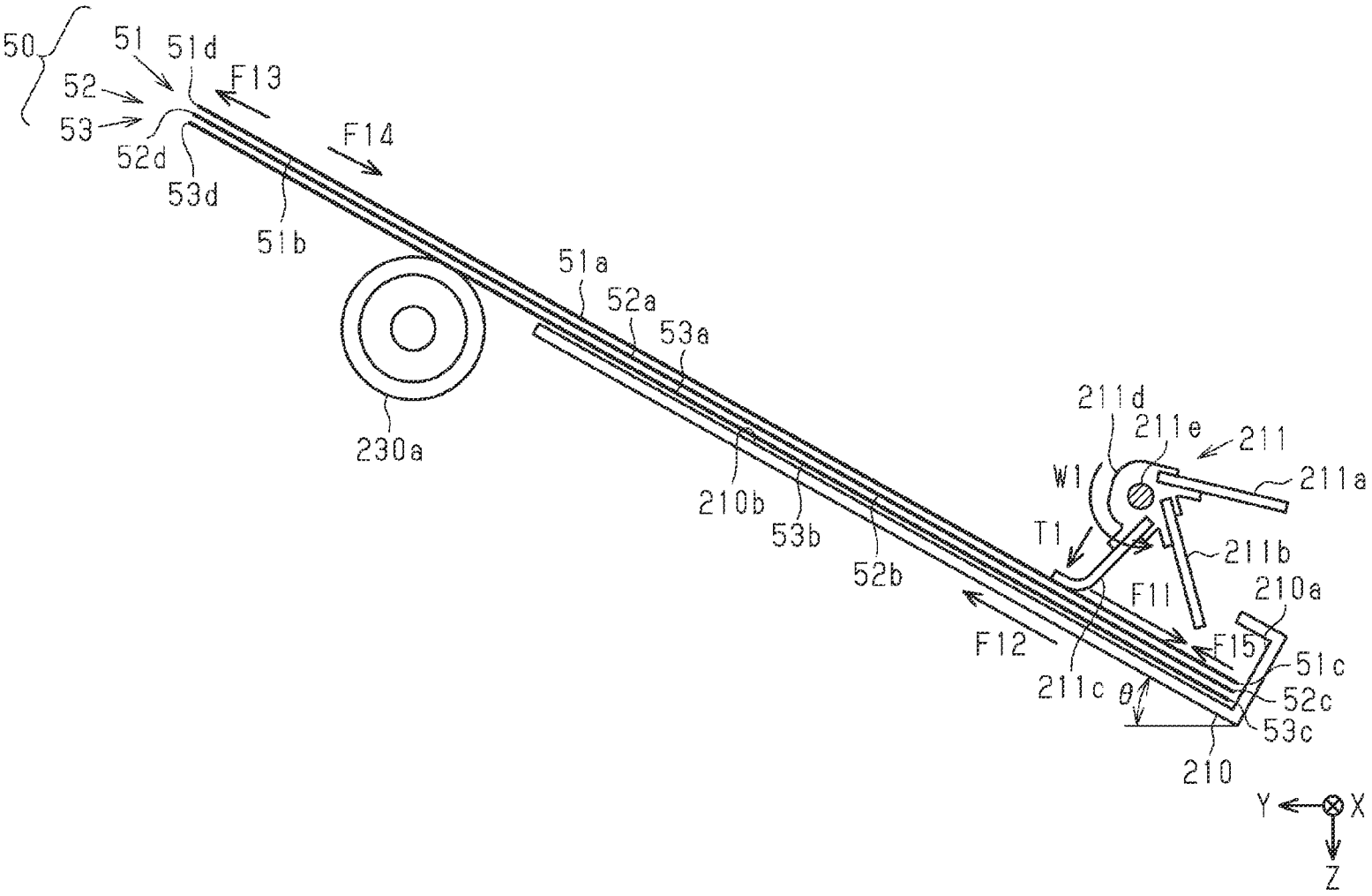
FIG. 25 is a schematic diagram illustrating forces generated when the first transporting member aligns the medium to the rear-end alignment portion.

As illustrated in FIG. 25, when the first transporting member 211 continues the first transporting operation from the state illustrated in FIG. 24, the rear end 51*c* of the first medium 51 reaches the rear-end alignment portion 210*a*. However, when the first medium 51 falls onto the intermediate tray 210, the rear end 51*c* of the first medium 51 rarely falls in a parallel state with the rear-end alignment portion 210*a*. In addition, since the first transporting member 211 is not a roller, the first medium 51 is rarely transported straight. Thus, when the first transporting member 211 causes the rear end 51*c* of the first medium 51 to reach the rear-end alignment portion 210*a* by the first transporting operation, any rear-end corner portion of the rear end 51*c* in the X direction comes into contact with the rear-end alignment portion 210*a* first. However, the edge of the rear end 51*c* of the first medium 51 securely comes into contact with the rear-end alignment portion 210*a* by causing the first transporting member 211 to rotate by the first necessary number of rotations. In addition, in order to cause the rear end 51*c* of the first medium 51 to be more securely in contact with the rear-end alignment portion 210*a*, it may be configured that a predetermined amount of transporting is performed after the first cumulative number of rotations of the first transporting member 211 reaches the first necessary number of rotations.

Force Generated when First Transporting Member Transports First Medium

FIG. 24 illustrates forces generated when the first transporting member 211 transports the first medium 51 in a state of the intermediate tray 210 illustrated in FIG. 16. When the first transporting member 211 is driven, five forces are mainly generated in the transport direction Y1.

As illustrated in FIG. 24, a first force is the transporting force F11 acting on the first transporting member 211. The transporting force F11 is a force of transporting the first medium 51 upstream in the transport direction Y1.

The transporting force F11 is decided by a coefficient of friction μ1*a* between the first transporting member 211 and the front surface 51*a* of the first medium 51, and a pressing force T1 that is a force of pressing the front surface 51*a* of the first medium 51 by the first transporting member 211. When any of the coefficient of friction μ1*a* and the pressing force T1 is increased, the transporting force F11 is increased. The pressing force T1 is decided by the height of the first transporting member 211 and a stack height of the media 50 stacked on the intermediate tray 210. When the pressing force T1 is increased, the transporting force F11 is increased.

When the transporting force F11 is large, a time period in which the rear end 51*c* of the first medium 51 reaches the rear-end alignment portion 210*a* is shortened. Conversely, when the transporting force F11 is small, a time period in which the rear end 51*c* of the first medium 51 reaches the rear-end alignment portion 210*a* is lengthened.

As illustrated in FIG. 24, a second force is a frictional force F12 acting between the first medium 51 and the second medium 52. The frictional force F12 is a frictional force generated by a close contact between the first medium 51 and the second medium 52, and is a force hindering the transporting force F11.

The frictional force F12 is decided by the coefficient of friction μ1*b* between the back surface 51*b* of the first medium 51 and the front surface 52*a* of the second medium 52, and the pressing force T1 that is a force of pressing the front surface 51*a* of the first medium 51 by the first transporting member 211. When any of the coefficient of friction μ1*b* and the pressing force T1 is increased, the frictional force F12 is increased.

As illustrated in FIG. 24, the frictional force F12 is a force generated in the region overlapping with the contact region between the first transporting member 211 and the medium 50. The frictional force F12 acts between the back surface 51*b* of the first medium 51 and the front surface 52*a* of the second medium 52. That is, the frictional force F12 is affected by the medium surface state of the back surface 51*b* of the first medium 51 and the medium surface state of the front surface 52*a* of the second medium 52 when the first transporting member 211 performs the first transporting operation. Particularly, the frictional force F12 is affected by the medium surface state of the back surface 51*b* of the first medium 51 and the medium surface state of the front surface 52*a* of the second medium 52 in the region overlapping with the contact region between the first transporting member 211 and the first medium 51.

The frictional force F12 is more affected by the medium surface state of the medium 50 than the transporting force F11 is. When the medium 50 contains water, a rate of increase in coefficient of friction of the medium 50 is higher than a rate of increase in coefficient of friction of the material of the first blades 211*a*, 211*b*, and 211*c*. Thus, when the medium 50 contains water, it is difficult for the first transporting member 211 to transport the first medium 51.

When the frictional force F12 is large, a time period in which the rear end 51*c* of the first medium 51 reaches the rear-end alignment portion 210*a* is lengthened. When the frictional force F12 is significantly large, the first medium 51 may not be moved at all depending on a magnitude of the transporting force F11. Conversely, when the frictional force F12 is small, a time period in which the rear end 51*c* of the first medium 51 reaches the rear-end alignment portion 210*a* is shortened.

As illustrated in FIG. 24, a third force and a fourth force are a resistance force F13 and a falling force F14 acting between the first medium 51 and the second medium 52. The resistance force F13 is a force as resistance when the first medium 51 is transported. The falling force F14 is a force causing the first medium 51 to slide down along an inclined surface by the gravity.

When the first transporting member 211 transports the first medium 51 by the transporting force F11, the first medium 51 is placed on the second medium 52. A dead weight of the first medium 51 is applied to the front surface 52*a* of the second medium 52 even outside the contact region between the first transporting member 211 and the first medium 51. That is, when the size of the medium 50 is large or the basis weight of the medium 50 is large, the resistance force F13 and the falling force F14 are increased. The falling force F14 is a force assisting the transporting force F11, and the resistance force F13 is a force hindering the transporting force F11 like the frictional force F12. That is, as the length in the transport direction Y1 and the basis weight of the paper sheet are increased, the resistance force F13 is increased. Thus, it is necessary to set the transporting force F11 of the first transporting member 211 to be large.

As illustrated in FIG. 25, a fifth force is a restraining force F15 acting between the rear end 51*c* of the first medium 51 and the rear-end alignment portion 210*a*. The restraining force F15 is a force of restraining the first medium 51 in a state where the rear end 51*c* is in contact with the rear-end alignment portion 210*a*, when the first transporting member 211 causes the rear end 51*c* of the first medium 51 to reach the rear-end alignment portion 210*a* by the first transporting operation. When the rear end 51*c* of the first medium 51 abuts the rear-end alignment portion 210*a* of the intermediate tray 210 by the restraining force F15, the second medium is not moved by rigidity of the first medium 51.

When the dead weight of the first medium 51 is large and the falling force F14 is large at the time of contact between the first medium 51 between the rear-end alignment portion 210*a*, the medium 50 having a small basis weight is likely to be buckled even when the first transporting member 211 does not perform the first transporting operation.

When the water content ratio of the first medium 51 at the time of performing the first transporting operation by the first transporting member 211 is increased, the rigidity of the first medium 51 is decreased and is likely to be bent, and the restraining force F15 is decreased. Even after the rear end 51*c* of the first medium 51 is in contact with the rear-end alignment portion 210*a*, the rear end 51*c* of the first medium 51 is likely to be buckled when the first transporting member 211 continues the first transporting operation.

When the restraining force F15 cannot withstand a force of acceleration of the transporting force F11 anymore, a part of the first medium 51 close to the rear end 51*c* temporarily rises upward in a convex shape with the rear end 51*c* of the first medium 51 being in contact with the rear-end alignment portion 210*a*. A state where the part of the first medium 51 close to the rear end 51*c* is bent is a state where the part of the first medium 51 is likely to be further bent. Thus, the restraining force F15 is decreased. Thus, the rear end 51*c* of the first medium 51 gradually curls, and there is a concern that the rear end 51*c* of the first medium 51 is folded and stacked, or a concern that buckling of the medium 50 occurs. This concern is increased as the time period of rotation is lengthened.

Force Generated when Second Transporting Member Transports First Medium

Figure 26:
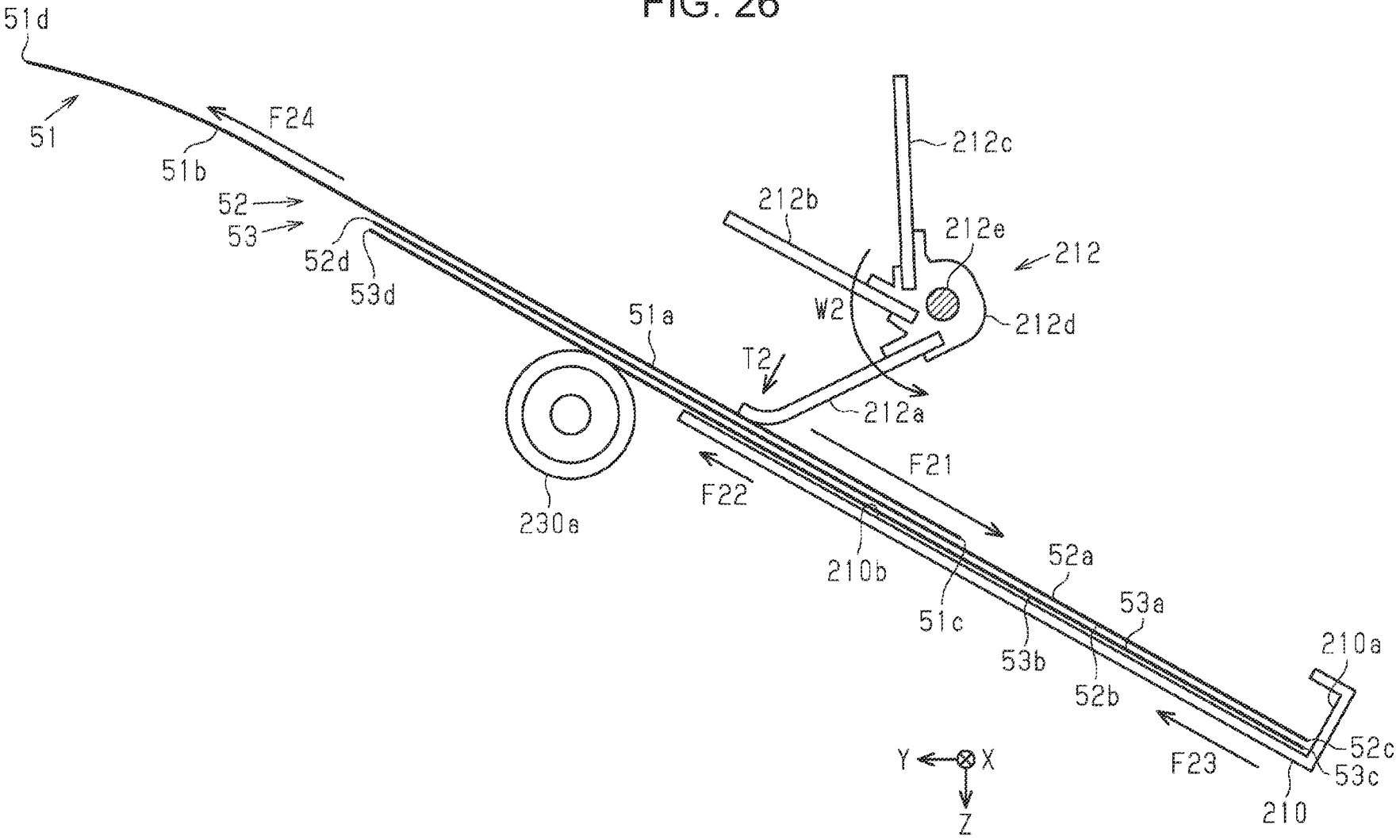
FIG. 26 is a schematic diagram illustrating forces generated when the second transporting member transports the medium.

FIG. 26 illustrates forces generated when the second transporting member 212 transports the first medium 51 in a state of the intermediate tray 210 illustrated in FIG. 14.

When the second transporting member 212 is driven, four forces are mainly generated in the transport direction Y1.

As illustrated in FIG. 26, the transporting force F21, the frictional force F22, and the falling force F24 are described in the same manner as a case of the first transporting member. Thus, descriptions of the transporting force F21, the frictional force F22, and the falling force F24 will not be repeated. Hereinafter, a pressing force will be referred to as a "pressing force T2" in the same manner as the case of the first transporting member 211. A resistance force F23 is different from the case of the first transporting member 211. Only parts different from the case of the first transporting member 211 will be described.

When the second transporting member 212 starts the second transporting operation, a distance between the rear end 51*c* of the first medium 51 and a rear end 52*c* of the second medium 52 is increased. However, a weight of a part of the first medium 51 sticking out of a front end 52*d* of the second medium 52 is concentrated on a part of the front end 52*d* of the second medium 52. Thus, even when an overlapping area is small, the resistance force F23 that is substantially the same as the case of the first transporting member 211 is generated. That is, as the length in the transport direction Y1 and the basis weight of the paper sheet are increased, the resistance force F23 is increased. Thus, it is necessary to set the transporting force F21 of the second transporting member 212 to be large.

Force Generated when Intermediate Discharge Roller Pair Discharges Medium

Figure 27:
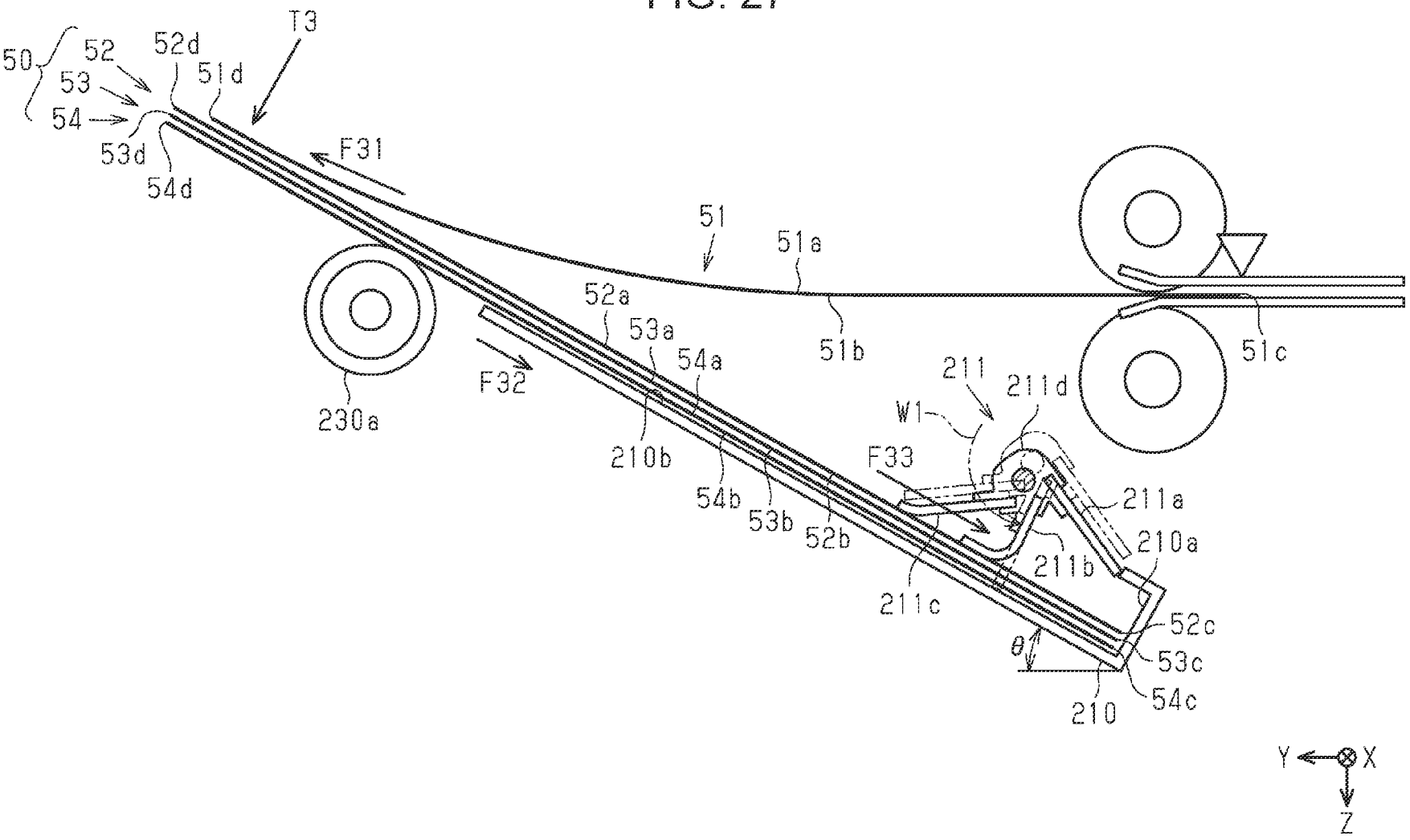
FIG. 27 is a schematic diagram illustrating forces generated when the medium is discharged to the intermediate tray in a state where the first transporting member is in a second position.

As illustrated in FIG. 27, when the intermediate discharge roller pair discharges the first medium, three forces are mainly generated in the transport direction Y1. FIG. 27 illustrates forces generated when the intermediate discharge roller pair 202 discharges the first medium 51 to the intermediate tray 210 in a state of the intermediate tray 210 illustrated in FIG. 13.

A first force is a pushing force F31 that is a force acting between the first medium 51 and the second medium 52. The pushing force F31 is generated when the intermediate discharge roller pair 202 discharges the first medium 51 to the intermediate tray 210. The pushing force F31 is a force of pushing the second medium by the first medium.

The pushing force F31 is decided by the coefficient of friction μ1*b* between the back surface 51*b* of the first medium 51 and the front surface 52*a* of the second medium 52, and a pressing force T3 that is a force of pressing the front surface 52*a* of the second medium 52 by the back surface 51*b* of the first medium 51. When any of the pressing force T3 and the coefficient of friction μ1*b* is increased, the pushing force F31 is increased.

The pressing force T3 is large when the rigidity of the first medium 51 is high. When the size or the basis weight of the first medium 51 is large at a time of discharging the first medium 51 by the intermediate discharge roller pair 202, the rigidity of the first medium 51 is high. Thus, the pressing force T3 is large. When a length of transport from the intermediate discharge roller pair 202 in the transport direction Y1 at a time of discharging the rear end 51*c* of the first medium 51 to the intermediate tray 210 is long, an area of a part of the first medium 51 pressing the second medium 52 is increased. Thus, the pressing force T3 is large. When the stack height of the media 50 stacked on the intermediate tray 210 is high, an amount of bending of the medium 50 is increased. Thus, the pressing force T3 is large.

The coefficient of friction μ1*b* is described in the same manner as a case of the frictional force F12 of the first transporting member. Thus, a description of the coefficient of friction μ1*b* will not be repeated.

As illustrated in FIG. 27, a second force is a resistance force F32 acting between the first medium 51 and the second medium 52. The resistance force F32 is a combined force including a frictional force as resistance when the back surface 51*b* of the first medium 51 pushes the front surface 52*a* of the second medium 52 while sliding, and a falling force causing the rear end 52*c* of the second medium 52 to maintain a state of abutting the rear-end alignment portion 210*a* by the gravity.

A direction in which the first transporting member 211 and the second transporting member 212 transport the first medium 51 is a direction following the gravity. Meanwhile, a direction in which the first medium 51 pushes the second medium 52 is a direction opposite to the gravity. Accordingly, since the resistance force and the falling force are forces in the same direction, a combined force of two forces is the resistance force F32. The resistance force F32 is a force in an opposite direction to the pushing force F31 causing the second medium 52 to move, and is a force holding the second medium 52 at an aligned position.

As illustrated in FIG. 27, a third force is a holding force F33 acting between the first transporting member 211 and the front surface of the second medium 52.

As illustrated in FIG. 27, in the present embodiment, the control portion 250 decreases the height of the first transporting member 211 by the first upward/downward movement motor (refer to FIG. 20) 253 and stops rotation of the first transporting member 211 in a state where both of the first blade 211*b* and the first blade 211*c* are abutting the front surface 51*a* of the first medium 51. That is, in a state where the first transporting member 211 is abutting the first medium 51, it is configured to change the first transporting member 211 to the second position for pressing the first medium 51 by the first transporting member 211, by stopping the first transporting operation of the first transporting member 211 and decreasing the height of the first transporting member 211. With this configuration, the first transporting member 211 can prevent misalignment caused by the pushing force F31.

When the position of the first transporting member 211 is changed to the second position, it may be configured to decrease a speed of rotation without stopping rotation of the first transporting member 211. Even in this case, misalignment caused by the pushing force F31 can be prevented.

The first transporting member 211 can continue pressing the medium 50 in the first position by continuing rotation without decreasing the speed. However, the rear end 52*c* of the second medium 52 gradually curls by continuously applying the transporting force F11, and there is a concern that the rear end 52*c* of the second medium 52 is folded and stacked, a concern that buckling occurs in the intermediate tray 210, or a concern that a rub mark, a press mark, or the like is made. This concern is increased as the time period of rotation is lengthened.

Figure 19:
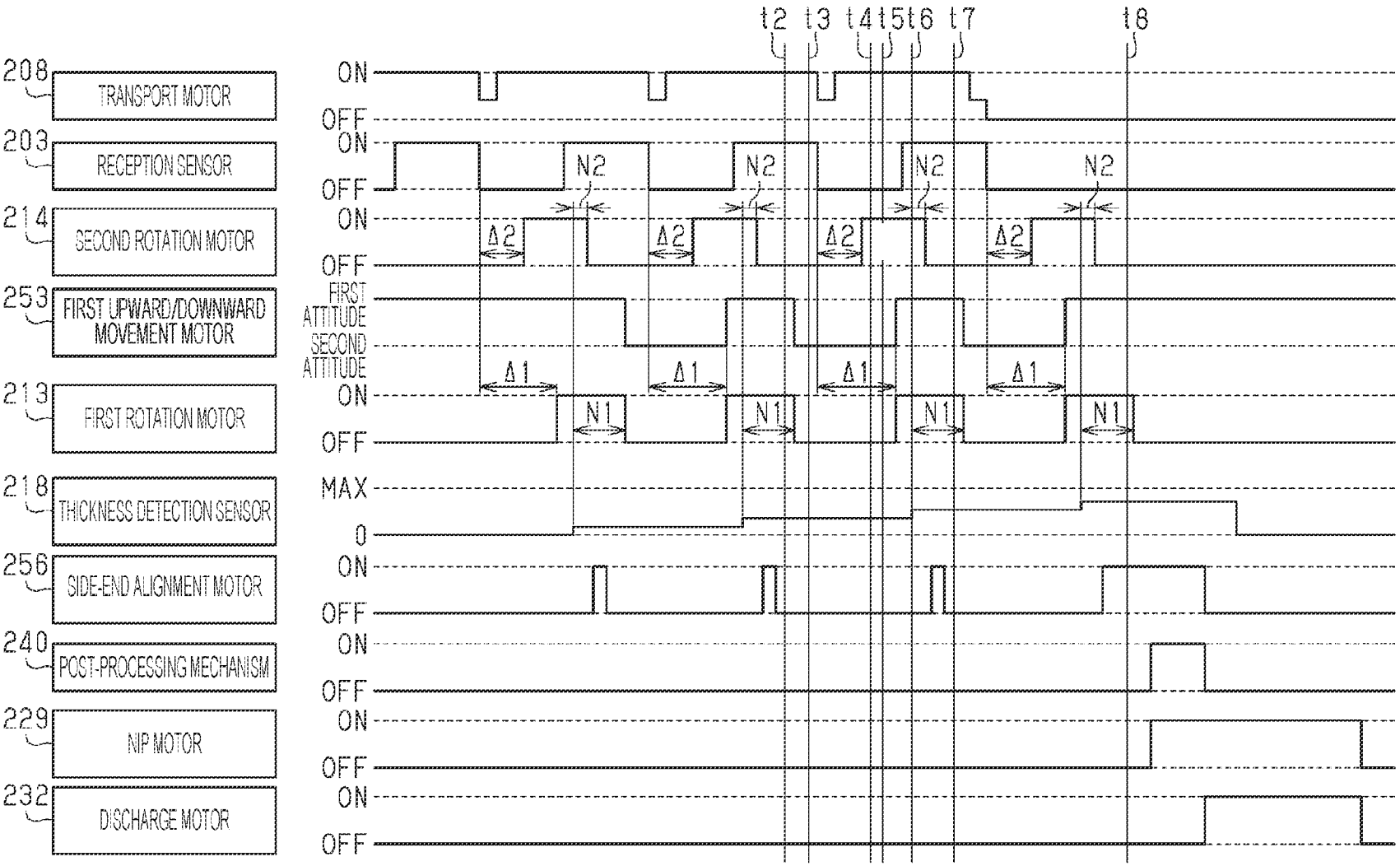
FIG. 19 is a timing chart illustrating an operation of the post-processing device when a first transporting operation is regulated using an output of a thickness detection sensor in the second embodiment.

Thus, as illustrated in FIG. 19, when the first cumulative number of rotations reaches the first necessary number of rotations, the control portion 250 is configured to be capable of moving the first transporting member 211 from the first position to a third position for separation from the first medium in accordance with the conditions of the parameters. The control portion 250 sets a state where the first transporting member 211 does not abut the front surface 51*a* of the first medium 51. By doing so, it is configured that a rub mark, a press mark, or the like is not easily made.

Depending on conditions of the first medium 51 and the second medium 52, the pushing force F31 can be suppressed by only the resistance force F32 that is a force holding the second medium 52 at the aligned position. However, when water content ratios of the first medium 51 and the second medium 52 are high, the coefficient of friction μ1*b* between media is increased. Thus, the pushing force F31 may move the second medium 52 already aligned on the intermediate tray 210. When the pushing force F31 separates the rear end 52*c* of the second medium 52 from a range in contact with the first transporting member 211, there is no unit returning the rear end 52*c* of the second medium 52 to the rear-end alignment portion 210*a*, and the first transporting operation for the first medium is started in a state where the rear end 52*c* of the second medium 52 is separated from the rear-end alignment portion 210*a*. Thus, such misalignment can be prevented by changing the position of the first transporting member 211 in accordance with the conditions of the parameters affecting the medium surface states of the back surface 51*b* of the first medium 51 and the front surface 52*a* of the second medium 52.

Control Table for Increase in Necessary Number of Rotations Using Parameters

When the printing system 11 is operated at the environmental temperature and the environmental humidity in a standard operation environment of the printing system 11, the first necessary number of rotations of the first transporting member 211 and the second necessary number of rotations of the second transporting member when the post-processing device is operated on a standard medium not printed at all will be referred to as a first standard number of rotations and a second standard number of rotations. For example, the standard medium is a medium of A4 LEF size and 70 gsm and is a medium of a type recommended to the user to be used in the printing device. LEF is the abbreviation for long edge feed, and the medium 50 is transported with a long edge as the front end. SEF is the abbreviation for short edge feed, and the medium 50 is transported with a short edge as the front end.

Due to an effect of an increase in water content ratio of the medium 50 and subsequent rippling occurring during drying, the first necessary number of rotations and the second necessary number of rotations are increased, compared to the first standard number of rotations and the second standard number of rotations when the post-processing device 200 is operated on the medium 50 not printed at all.

FIG. 28 is a control table for an increase in necessary number of rotations applied to the first transporting member 211 and the second transporting member 212 when the length of the medium 50 in the transport direction is less than or equal to 210 mm. When an installation environment is under a condition of a normal temperature and normal humidity, the control portion 250 decides the increase in necessary number of rotations in accordance with the conditions of the parameters. The increase in necessary number of rotations at a time of each condition of the parameters is described in the control table. An increase in number of rotations by one step from the standard number of rotations is denoted by "+1".

The number of rotations corresponding to one step varies depending on a configuration of the device. For example, the configuration of the device is a factor deciding the transporting force F11 and the frictional force F12 like the type of liquid used in the liquid ejecting portion 27 or a material or a shape of the first transporting member 211. Values of F %, H, and Jsec are decided depending on the configuration of the device. The number of rotations corresponding to one step may be changed for each of the first necessary number of rotations and the second necessary number of rotations.

In the control table in FIG. 28, the printing duty is described in two divisions or three divisions, and the standby time period corresponding to the elapsed time period is described in two divisions in the present embodiment. However, the printing duty and the standby time period may be described in any number of divisions. The basis weight of the medium 50 and the number of stacked sheets may also be described in any number of divisions. However, when a change in medium surface state is significant due to a wide range of the printing duty or the like, a range of the coefficient of friction μ1*b* is increased. Thus, as the number of divisions of the conditions of the parameters is increased, more accurate control can be performed.

Easiness of transporting of the first medium 51 is decided by the coefficient of friction μ1*b* between the back surface 51*b* of the first medium 51 and the front surface 52*a* of the second medium 52 when the first transporting member 211 transports the first medium 51. Thus, the increase in necessary number of rotations of the first transporting member 211 can be decided by the conditions of the parameters of the back surface 51*b* of the first medium 51 and the conditions of the parameters of the front surface 52*a* of the second medium 52.

As illustrated in FIG. 28, for example, when double-sided printing is performed on a medium having A4 LEF size and a basis weight of 90 gsm, the front surface duty of the second medium is greater than or equal to F %, and the number of stacked sheets exceeds H. At this point, when the back surface duty of the first medium 51 is greater than or equal to F % and the standby time period exceeds Jsec, the first necessary number of rotations and the second necessary number of rotations are set to be greater than the first standard number of rotations and the second standard number of rotations by six steps.

In the medium 50 having a small basis weight, the back surface is affected by the water content of the front surface, and the front surface is affected by the water content of the back surface. Thus, in this table, numerical values may be adjusted by additionally considering the water content state of the front surface for the back surface and the water content state of the back surface for the front surface as the conditions of the parameters. Particularly, when the number of sheets of the media 50 stacked on the intermediate tray 210 is large, the medium surface state of the second medium 52 is affected by the water content state of the media 50 stacked so far, and ripping is increased, and the height is changed. Thus, the numerical values may be adjusted by additionally considering an effect of the water content state of the media 50 stacked so far as the conditions of the parameters.

FIG. 29 is a control table for an increase in necessary number of rotations applied to the first transporting member 211 and the second transporting member 212 when the length of the medium 50 in the transport direction exceeds 210 mm. When the installation environment is under a condition of a normal temperature and normal humidity, the control portion 250 decides the increase in necessary number of rotations in accordance with the conditions of the parameters. Even in the control table in FIG. 29, the printing duty and the standby time period may be described in any number of divisions. The basis weight of the medium 50 and the number of stacked sheets may also be described in any number of divisions.

When the length of the medium 50 in the transport direction Y1 is increased, there may be a difference between the printing duty of the entire medium 50 and the printing duty of locations in contact with the first transporting member 211 and the second transporting member 212. Thus, in the present embodiment, the control portion 250 uses the contact portion duty instead of the printing duty when the length of the medium 50 in the transport direction Y1 is long.

In FIG. 28 and FIG. 29, the control portion 250 uses the control tables under a condition of a normal temperature and normal humidity. However, control tables of a high temperature and high humidity, a low temperature and low humidity, a high temperature and low humidity, and a low temperature and high humidity are used in accordance with an environmental condition. Generally, the standby time period is the most dominant in the elapsed time period. Thus, the standby time period is used as the elapsed time period in the control tables in FIG. 28 and FIG. 29. However, when the transport speed is low or the printing time period is long, the transport speed or the printing time period may be added to the control tables as parameters. When the transport pitch time period is long, the transport pitch time period may be added to the control tables as a parameter.

In addition, the number of parameters used in the control tables may be decreased. The control portion 250 may use at least one of the standby time period, the printing duty, and the size of the medium 50 as a parameter. As illustrated in FIG. 28 and FIG. 29, when any of the standby time period, the printing duty, and the size of the medium 50 is used as a parameter, the first necessary number of rotations of the first transporting member 211 is increased as a value of the parameter is increased.

In the post-processing device 200 processing the medium 50 printed with liquid ejected by the liquid ejecting portion 27, the rear end 52*c* of the second medium 52 gradually curls by continuously applying the transporting force F11 by the first transporting member 211, and there is a concern that the rear end 52*c* of the second medium 52 is folded and stacked, or a concern that buckling of the medium 50 occurs. This concern is increased as the time period of rotation is lengthened.

When the coefficient of friction μ1*b* between media is high due to degradation of the medium surface state caused by the water content, the rear end 51*c* of the first medium 51 does not reach the rear-end alignment portion 210*a* when a time period in which the first transporting member 211 continues applying the transporting force F11 is short. Thus, the control portion 250 needs to rotate the first transporting member 211 up to an appropriate first standard number of rotations.

Effects of the present embodiment will be described.

Effects in Printing Job

First, effects in the printing job when the post-processing device 200 processes the medium 50 printed with liquid ejected by the liquid ejecting portion 27 will be described.

A case where 50 sheets of the media 50 of A4 LEF size and a basis weight of 90 gsm are subjected to double-sided printing and are stacked on the intermediate tray 210 and discharged to the discharge stacker 231 will be described. The control table in FIG. 28 will be used.

In the first sheet of the first medium 51, the front surface duty is greater than or equal to F %, the standby time period exceeds Jsec, and the back surface duty is less than F %.

When the first sheet of the first medium 51 is discharged onto the intermediate tray 210, there is no medium 50 on the intermediate tray 210. The first transporting member 211 stops rotating at the standby angle and stands by. At this point, since the length of the first medium 51 in the transport direction Y1 is short, the first medium 51 falls onto the intermediate tray 210 in a state where the front end 51*d* of the first medium 51 almost does not abut the intermediate tray 210. That is, the pushing force F31 and the resistance force F32 are almost not generated. Since there is no medium 50 on the intermediate tray 210, a state where the second medium 52 is not present in a state illustrated in FIG. 12 is set.

When the first medium 51 falls onto the intermediate tray 210, the operation of the second transporting member 212 is started. A state where one sheet of the medium 50 of A4 LEF size has fallen onto the intermediate tray 210 is illustrated in FIG. 26. At this point, the frictional force F22 acts between the back surface of the first medium 51 and the front surface of the intermediate tray 210. Thus, an effect of the water content state is not large. Since the length of the medium 50 in the transport direction Y1 is short, an effect of the resistance force F13 is also small. That is, the second necessary number of rotations is set to be the same as the second standard number of rotations. After the second transporting member 212 rotates by the second necessary number of rotations, the control portion 250, by the second rotation motor 214 (refer to FIG. 20), stops rotation of the second transporting member 212 at a timing at which the rotation position of the second transporting member 212 is the position of the standby angle.

When the first medium 51 reaches the first transporting member 211, the position of the first transporting member 211 is set to the first position, and the first transporting member 211 starts rotating. For the same reason as a case of the second transporting member 212, the first necessary number of rotations of the first transporting member 211 is set to be the same as the first standard number of rotations. When the subsequent second sheet of the medium 50 is discharged onto the intermediate tray 210, the first transporting member 211 and the second transporting member 212 stop rotating, and the position of the first transporting member 211 is changed to the second position (refer to FIG. 27).

A timing at which the second transporting operation is stopped may be immediately before the rear end 51*c* of the first medium 51 is aligned to the rear-end alignment portion 210*a*, or may be a timing at which alignment is performed. However, the timing is earlier than a timing at which the first transporting member 211 stops the first transporting operation.

Even in the second sheet of the first medium 51, the front surface duty is greater than or equal to F %, the standby time period exceeds Jsec, and the back surface duty is less than F %.

When the second sheet of the first medium 51 is discharged onto the intermediate tray 210, a state where one sheet of the medium 50 of A4 LEF size is present on the intermediate tray 210 in FIG. 19 is set. The first transporting member 211 stands by in a state of the second position (refer to FIG. 27).

When the second sheet of the first medium 51 is discharged onto the intermediate tray 210 by the intermediate discharge roller pair 202, the back surface 51*b* of the first medium 51 comes into contact with the front surface 52*a* of the second medium 52. Thus, the pushing force F31 is generated. A state where one sheet of the medium 50 of A4 LEF size is present on the intermediate tray 210 is illustrated in FIG. 27. Since the holding force F33 is generated by the second position of the first transporting member 211, the second medium 52 is not moved even when the pushing force F31 is generated.

When the first medium 51 falls onto the intermediate tray 210, the second transporting operation of the second transporting member 212 is started. A state where two sheets of the media 50 of A4 LEF size are present on the intermediate tray 210 is illustrated in FIG. 26. The back surface 51*b* of the first medium 51 comes into contact with the front surface 51*a* of the second medium 52. The water content states of both medium surfaces are slightly degraded, and the coefficient of friction μ1*b* is increased. Thus, the frictional force F22 and the resistance force F23 are increased. However, the medium 50 has a size of A4 LEF and a short length in the transport direction Y1, and an area to which a dead weight of the second medium 52 is applied is small. Thus, the resistance force F23 is small. The control portion 250 sets the second necessary number of rotations to be greater than the second standard number of rotations by one step with reference to the control table in FIG. 28. After the second transporting member 212 rotates by the second necessary number of rotations, the control portion 250 stops rotation of the second transporting member 212.

When the first medium 51 reaches the first transporting member 211, the first transporting member 211 starts rotating. For the same reason as the case of the second transporting member 212, the first necessary number of rotations of the first transporting member 211 is set to be greater than the first standard number of rotations by one step. After the first transporting member 211 rotates by the first necessary number of rotations, the first transporting member 211 and the second transporting member 212 stop rotating, and the position of the first transporting member 211 is changed to the second position (refer to FIG. 27). Non-alignment of the medium 50 or buckling of the medium 50 caused by not transporting the first medium 51 or excessively transporting the first medium 51 can be suppressed.

In the third sheet of the first medium 51, the front surface duty is less than F %, the back surface duty is greater than or equal to F %, and the standby time period exceeds Jsec.

When the third sheet of the first medium 51 is discharged onto the intermediate tray 210, the position of the first transporting member 211 is the second position (refer to FIG. 27) in the same manner as a case of the second sheet of the first medium 51.

When the third sheet of the first medium 51 is discharged onto the intermediate tray 210, the pushing force F31 is generated. A state where two sheets of the media 50 of A4 LEF size are present on the intermediate tray 210 is illustrated in FIG. 27. The second medium 52 is not moved due to the holding force F33.

When the first medium 51 falls onto the intermediate tray 210, the second transporting operation of the second transporting member 212 is started. A state where three sheets of the media 50 of A4 LEF size are present on the intermediate tray 210 is illustrated in FIG. 26.

When the third sheet of the first medium 51 is transported, both of the back surface duty of the back surface 51*b* of the first medium 51 and the front surface duty of the front surface 52*a* of the second medium 52 are greater than or equal to F %. Thus, the coefficient of friction μ1*b* is increased compared to when the second sheet of the first medium 51 is transported. That is, the frictional force F22 is significantly increased. Since the medium 50 has a size of A4 LEF and a short length in the transport direction Y1, the resistance force F23 is increased. However, the effect of the resistance force F23 is smaller than the frictional force F22. The control portion 250 sets the second necessary number of rotations to be greater than the second standard number of rotations by five steps with reference to the control table in FIG. 28. After the second transporting member 212 rotates by the second necessary number of rotations, the control portion 250 stops rotation of the second transporting member 212.

When the first medium 51 reaches the first transporting member 211, the first transporting member 211 starts rotating. For the same reason as the case of the second transporting member 212, the first necessary number of rotations of the first transporting member 211 is set to be greater than the first standard number of rotations by five steps. After the first transporting member 211 rotates by the first necessary number of rotations, the first transporting member 211 stops rotating, and the position of the first transporting member 211 is changed to the second position (refer to FIG. 27). Non-alignment of the medium 50 and buckling of the medium 50 can be suppressed.

In the fourth sheet of the first medium 51, the front surface duty is greater than or equal to F %, the standby time period is less than or equal to Jsec, and the back surface duty is less than F %.

When the fourth sheet of the first medium 51 is discharged onto the intermediate tray 210, the position of the first transporting member 211 is the second position (refer to FIG. 27) in the same manner as a case of the third sheet of the first medium 51.

When the fourth sheet of the first medium 51 is discharged onto the intermediate tray 210, the pushing force F31 is generated. A state where three sheets of the media 50 of A4 LEF size are present on the intermediate tray 210 is illustrated in FIG. 27. Since the holding force F33 is generated, the second medium 52 is not moved.

When the first medium 51 falls onto the intermediate tray 210, the second transporting operation of the second transporting member 212 is started. A state where four sheets of the media 50 of A4 LEF size are present on the intermediate tray 210 is illustrated in FIG. 26.

Since both of the printing duties of the back surface 51*b* of the first medium 51 and the front surface 52*a* of the second medium 52 are less than F %, the frictional force F22 and the resistance force F23 are almost not increased. The control portion 250 sets the second necessary number of rotations to be the same as the second standard number of rotations with reference to the control table in FIG. 28. After the second transporting member 212 rotates by the second necessary number of rotations, the control portion 250 stops rotation of the second transporting member 212.

When the first medium 51 reaches the first transporting member 211, the first transporting member 211 starts rotating. For the same reason as the case of the second transporting member 212, the first necessary number of rotations of the first transporting member 211 is set to be the same as the first standard number of rotations. After the first transporting member 211 rotates by the first necessary number of rotations, the first transporting member 211 stops rotating and is changed to the second position (refer to FIG. 27). Non-alignment of the medium 50 and buckling of the medium 50 can be suppressed.

Then, the medium 50 is stacked on the intermediate tray 210 and aligned one sheet at a time. The number of sheets of the media 50 stacked on the intermediate tray 210 is increased. The height of the media 50 stacked on the intermediate tray 210 is estimated using the number of stacked sheets in the intermediate tray 210, the front surface duty of each medium 50, the back surface duty of each medium 50, the front surface elapsed time period of each medium 50, and the back surface elapsed time period of each medium 50.

When an estimated stack height of the media 50 stacked on the intermediate tray 210 is greater than a standard stack height, the transporting force F11 of the first transporting member 211 and the transporting force F21 of the second transporting member 212 are increased. Thus, the control portion 250 may appropriately adjust values of the first necessary number of rotations and the second necessary number of rotations. Thus, buckling of the medium 50 caused by not transporting the first medium 51 or excessively transporting the first medium 51 can be suppressed.

When the height of the media 50 stacked on the intermediate tray 210 is increased, the back surface 51*b* of the first medium 51 strongly abuts the front surface 52*a* of the second medium 52 when the first medium 51 is discharged onto the intermediate tray 210 by the intermediate discharge roller pair 202. Thus, the pushing force F31 is increased. A case where the length of the medium 50 in the transport direction Y1 is short and the number of sheets of the media 50 stacked on the intermediate tray 210 is large is illustrated in FIG. 27.

When the stack height is low, the second medium 52 is not moved due to the resistance force F32. However, when the stack height is high, the pushing force F31 becomes greater than the resistance force F32. However, after the first transporting member 211 rotates by the first necessary number of rotations, the first transporting member 211 stops rotating, and the position of the first transporting member 211 is changed to the second position (refer to FIG. 27). Thus, the second medium 52 is not moved.

The holding force F33 causing the second medium 52 already aligned on the intermediate tray 210 to be not moved is generated by changing the position of the first transporting member 211 to the second position (refer to FIG. 27). Even when the stack height is increased and the pushing force F31 is increased, disturbance of alignment due to movement of the already aligned second medium 52 can be suppressed by the holding force F33.

In the 49th sheet of the first medium 51 after the number of stacked media 50 is increased, the front surface duty is less than F %, the back surface duty is greater than or equal to F %, and the standby time period exceeds Jsec. In addition, in the 48th sheet of the second medium 52 already stacked on the intermediate tray 210, the front surface duty is less than F %. When the 49th sheet of the first medium 51 is discharged onto the intermediate tray 210, a state where 48 sheets of the media 50 are present on the intermediate tray 210 in the state illustrated in FIG. 27 is set. The first transporting member 211 stands by in the state of the second position.

Since the pushing force F31 is greater than the resistance force F32, the pushing force F31 causes the rear end 52*c* of the second medium 52 to be separated from the rear-end alignment portion 210*a*. However, the second medium 52 is not moved due to the holding force F33 of the first transporting member 211.

When the first medium 51 falls onto the intermediate tray 210, the operation of the second transporting member 212 is started. As illustrated in FIG. 28, the second necessary number of rotations of the second transporting member 212 is set to be greater than the second standard number of rotations by four steps, and the first necessary number of rotations of the first transporting member 211 is set to be greater than the first standard number of rotations by four steps. After the second transporting member 212 rotates by the second necessary number of rotations, the second transporting member 212 stops rotating. After the first transporting member 211 rotates by the first necessary number of rotations, the first transporting member 211 stops rotating, and the position of the first transporting member 211 is changed to the second position (refer to FIG. 27).

After the 49th sheet of the first medium 51 is appropriately aligned, the first transporting member 211 and the second transporting member 212 stop rotating. Thus, non-alignment of the medium 50 or buckling of the medium 50 caused by not transporting the first medium 51 or excessively transporting the first medium 51 can be suppressed.

The control portion 250 performs control in the same manner for the 50th sheet of the first medium 51. After the 50th sheet of the first medium 51 is appropriately aligned, the bundle of 50 sheets of the media 50 on the intermediate tray 210 is stapled at the position designated in the printing job by the user and is discharged to the discharge stacker 231. Non-alignment of the medium 50 and buckling of the medium 50 can be suppressed. An aligned and stapled book is discharged to the discharge stacker 231.

For the medium 50 of which the length in the transport direction Y1 exceeds 210 mm, the control portion 250 performs control in accordance with the conditions of the parameters using the control table illustrated in FIG. 29. In the present embodiment, since the length of the medium in the transport direction Y1 is long, the control portion 250 performs control using the contact portion duty instead of the printing duty of the entire medium 50.

The control portion 250 uses the control tables of the high temperature and high humidity, the low temperature and low humidity, the high temperature and low humidity, and the low temperature and high humidity in accordance with the environment. The control portion 250 may use more control tables by further dividing both of the temperature and the humidity.

The control portion 250 may increase the transporting force F11 by decreasing the height of the first transporting member 211 in the first position by a few steps instead of setting the first necessary number of rotations of the first transporting member 211 to be greater than the first standard number of rotations by a few steps. The control portion 250 controls the height of the first transporting member 211 using the tables illustrated in FIG. 28 and FIG. 29.

A distance in which the control portion 250 changes the height of the first transporting member 211 in one step varies depending on the configuration of the device. For example, the configuration of the device is a factor deciding the transporting force F11 and the frictional force F12 like the type of liquid or the material or the shape of the first transporting member 211. In addition, as lengths of the first blades 211*a*, 211*b*, and 211*c* of the first transporting member 211 are decreased, a rate of change in transporting force F11 by height is increased. Thus, detailed adjustment is needed. The control portion 250 may control both of the first necessary number of rotations of the first transporting member 211 and the height of the first transporting member 211 in the first position.

Effects of the present embodiment will be described.

9. The first transporting operation of the first transporting member 211 is regulated based on the transporting state of the printed medium 50 detected by the detection portion 300 and the conditions of the parameters of the medium 50. When the medium 50 printed with liquid ejected by the liquid ejecting portion 27 is aligned, the coefficient of friction μ1*b* between the first medium 51 transported by the first transporting member 211 in the intermediate tray 210 and the second medium 52 stacked earlier on the intermediate tray 210 changes in accordance with the conditions of the parameters. Thus, a time period required for the rear end 51*c* of the first medium 51 to reach the rear-end alignment portion 210*a* changes due to a change in coefficient of friction μ1*b*. Even when the time period required for the rear end 51*c* of the first medium 51 to reach the rear-end alignment portion 210*a* changes due to a change in coefficient of friction μ1*b* between media, the control portion 250 acquires the transporting state immediately before the rear end 51*c* of the first medium 51 reaches the rear-end alignment portion 210*a*. The control portion 250 regulates the first transporting operation of the first transporting member 211 based on the transporting state and the conditions of the parameters. Thus, when the medium 50 is aligned in the intermediate tray 210, non-alignment of the medium 50 caused by the rear end of the medium 50 not reaching the rear-end alignment portion 210*a* or buckling of the medium 50 caused by transporting the rear end of the medium 50 even after the rear end of the medium 50 reaches the rear-end alignment portion 210*a* can be suppressed.

The method of causing the control portion 250 to change the first transporting member 211 to the second position is present as a method of regulating the first transporting operation. Non-alignment of the medium 50 or buckling of the medium 50 caused by not transporting the first medium 51 or excessively transporting the first medium 51 can be suppressed by stopping rotation at an appropriate number of rotations and pressing the first medium 51 by the first transporting member 211.

10. The detection portion 300 detects the transporting state of the first medium 51 based on detected information about passage of a rear end portion of the first medium 51. The detection portion 300 acquires the transporting state by detecting passage of the rear end 51*c* of the first medium 51 near where the rear end 51*c* of the first medium 51 reaches the rear-end alignment portion 210*a*. The control portion 250 can detect the passage of the rear end 51*c* of the first medium 51 immediately before the rear end 51*c* of the first medium 51 reaches the rear-end alignment portion 210*a*.

11. When the first medium 51 is transported by the first transporting member 211, the detection portion 300 detects the transporting state of the first medium 51 based on an increase in cumulative thickness of the medium 50 stacked on the intermediate tray 210 near where the rear end 51*c* of the first medium 51 reaches the rear-end alignment portion 210*a*. When the output of the detection portion 300 is discontinuously increased, the control portion 250 determines that the number of sheets of the media 50 is increased by one. The passage of the rear end 51*c* of the first medium 51 can be accurately detected immediately before the rear end 51*c* of the first medium 51 reaches the rear-end alignment portion 210*a*.

When the amount of the discontinuous change detected by the detection portion 300 is a value greater than a thickness of two sheets of the media 50, the control portion 250 determines that the first medium 51 of which the front end is folded is transported. The control portion 250 can stop the post-processing device 200 before the post-processing such as stapling is performed, and notify the user by display on the liquid crystal display or the like of the printing device 13.

When the increase in cumulative thickness detected by the detection portion 300 exceeds the predetermined thickness, the control portion 250 determines that the intermediate tray 210 is blocked by curling or buckling of the rear end 51*c* of the transported first medium 51. The control portion 250 can stop the post-processing device 200 before the post-processing such as stapling is performed, and notify the user by display on the liquid crystal display or the like of the printing device 13.

12. The control portion 250 regulates the first transporting operation when the first cumulative number of rotations after the rear end 51*c* of the first medium 51 passes through the detection portion 300 reaches the first necessary number of rotations necessary for aligning the rear end 51*c* of the first medium 51 to the rear-end alignment portion 210*a*. When the medium 50 printed with liquid ejected by the liquid ejecting portion 27 is aligned, the coefficient of friction μ1*b* between the first medium 51 transported by the first transporting member 211 in the intermediate tray 210 and the second medium 52 stacked earlier on the intermediate tray 210 changes in accordance with the conditions of the parameters. Thus, a time period required for the rear end 51*c* of the first medium 51 to reach the rear-end alignment portion 210*a* changes due to a change in coefficient of friction μ1*b*. Thus, the control portion 250 sets an appropriate first necessary number of rotations in accordance with the conditions of the parameters. Thus, when the medium 50 is aligned in the intermediate tray 210, non-alignment of the medium 50 caused by the rear end of the medium 50 not reaching the rear-end alignment portion 210*a* or buckling of the medium 50 caused by transporting the rear end of the medium 50 even after the rear end of the medium 50 reaches the rear-end alignment portion 210*a* can be suppressed.

13. The control portion 250 uses the temperature of the environment in which the printing device 13 is installed, the humidity of the environment in which the printing device 13 is installed, the size of the medium 50, and the basis weight of the medium 50 as the conditions of the parameters. When the temperature of the environment is low, liquid that has clung to the medium 50 does not easily dry, and the coefficient of friction μ1*b* between media is increased. Thus, the frictional force F12 is increased. In addition, when the humidity of the environment is high, liquid that has clung to the medium 50 does not easily dry, and the coefficient of friction μ1*b* between media is increased. Thus, the frictional force F12 is increased. Furthermore, as the size of the medium 50 is increased, an area of contact between media is increased. Thus, when the length of the medium 50 in the transport direction Y1 is long, the resistance force F13 is increased when the first transporting member performs transporting. In addition, as the basis weight of the medium 50 is increased, the weight of the medium 50 is increased. Thus, the resistance force F13 is increased when the first transporting member 211 performs transporting. As the basis weight of the medium 50 is decreased, the rigidity of the medium 50 is decreased. Thus, since the restraining force F15 is decreased, the first medium 51 is easily buckled. In addition, as the number of sheets of the media 50 stacked on the intermediate tray 210 is increased, the stack height of the media bundle is increased, and the first medium 51 approaches the first transporting member 211. Accordingly, since the pressing force T1 when the first transporting member 211 transports the first medium 51 is increased, the frictional force F12 is increased. The control portion 250 appropriately changes the first necessary number of rotations in accordance with at least one of the parameters of the temperature of the environment, the humidity of the environment, the size of the medium 50, the basis weight of the medium 50, and the number of sheets of the media 50 stacked on the intermediate tray 210. Thus, when the medium 50 is aligned in the intermediate tray 210, non-alignment of the medium 50 or buckling of the medium 50 can be suppressed.

14. The control portion 250 uses, as a parameter, at least one of the parameters of the elapsed time period from when printing on the medium 50 is started by liquid ejected by the liquid ejecting portion 27 until the first transporting member 211 starts the first transporting operation of transporting the medium 50, the standby time period after printing in the medium 50, and the printing duty of liquid ejected to the medium 50. As the elapsed time period from printing on the medium 50 until the first transporting operation is started is shortened, the standby time period of the printed medium 50 is lengthened, or the printing duty is increased, dryness of liquid that has clung to or permeated the medium 50 is decreased, and the water content state of the medium surface tends to be degraded. When the water content state of the medium surface is degraded, the coefficient of friction μ1*b* between media is increased. Thus, the frictional force F12 is increased. The control portion 250 appropriately changes the first necessary number of rotations in accordance with at least one of the parameters of the elapsed time period, the standby time period, and the printing duty. Thus, when the medium 50 is aligned in the intermediate tray 210, non-alignment of the medium 50 or buckling of the medium 50 can be suppressed.

15. The elapsed time period is at least one of the printing time period in the medium 50 printed with liquid ejected by the liquid ejecting portion 27, the transport time period in the medium 50 printed with liquid ejected by the liquid ejecting portion 27, and the transport pitch time period of the medium 50 from the start of the first transporting operation until the subsequent start of the first transporting operation. As at least one of the printing time period, the transport time period, and the transport pitch time period is shortened, the water content state of the medium surface tends to be degraded. When the water content state of the medium surface is degraded, the coefficient of friction μ1*b* between media is increased. Thus, the frictional force F12 is increased. Thus, the control portion can suppress non-alignment of the medium 50 or buckling of the medium 50 by appropriately changing the first necessary number of rotations in accordance with at least one of the parameters of the printing time period, the transport time period, and the transport pitch time period.

16. The control portion 250 uses at least one of the standby time period, the printing duty of liquid, and the size of the medium 50 as a parameter. As a numerical value of the parameter is increased, the first necessary number of rotations is increased. When the standby time period is long, a long drying time period of the medium 50 needs to be secured. Thus, in a state where the water content state of the medium surface is still degraded, rippling of the medium surface is further increased, and the coefficient of friction μ1*b* between media is increased. Thus, the frictional force F12 is increased. In addition, when the printing duty is high, a state where the water content state of the medium surface is still degraded is set, and the coefficient of friction μ1*b* between media is increased. Thus, the frictional force F12 is increased. Furthermore, when the size of the medium 50 is large, the area of contact is large. Thus, the resistance force F13 is increased when the first transporting member 211 performs transporting. The control portion 250 can suppress non-alignment of the medium 50 or buckling of the medium 50 by increasing the first necessary number of rotations as a numerical value of at least one of the parameters of the standby time period, the printing duty, and the size of the medium 50 is increased.

17. The control portion 250 uses the printing duty of the back surface 51*b* of the first medium 51 and the size of the first medium 51 as parameters. When the printing duty is high, the coefficient of friction μ1*b* between media is increased due to degradation of the water content state of the medium surface. Thus, the frictional force F12 is increased. The printing duty is a parameter that most affects the medium surface state of the back surface 51*b* of the first medium 51. When the size of the first medium 51 is large, the resistance force F13 is increased. That is, even when the size of the first medium 51 changes, the control portion 250 can suppress non-alignment of the medium 50 or buckling of the medium 50 using a simple control table.

18. The control portion 250 uses the printing duty of the back surface 51*b* of the first medium 51 and the humidity of the environment as parameters. When the printing duty is high, the coefficient of friction μ1*b* between media is increased due to degradation of the water content state of the medium surface. Thus, the frictional force F12 is increased. The printing duty is a parameter that most affects the medium surface state of the back surface 51*b* of the first medium 51. When the environmental humidity is high, the coefficient of friction μ1*b* between media is increased. Thus, the frictional force F12 is increased. That is, even when the humidity of the environment changes, the control portion 250 can suppress non-alignment of the medium 50 or buckling of the medium 50 using a simple control table.

19. The control portion 250 can appropriately adjust the transporting force F11 by deciding the height of the first transporting member 211 in the first position in accordance with the conditions of the parameters. Non-alignment of the medium 50 or buckling of the medium 50 can be suppressed by appropriately deciding the transporting force F11.

20. When the control portion 250 determines, from the transporting state of the medium 50, that the medium 50 has reached the rear-end alignment portion 210*a*, the control portion 250 changes the first transporting member 211 to the second position for pressing the medium 50 by the first transporting member 211, by stopping the first transporting operation of the first transporting member 211 and decreasing the height of the first transporting member 211. Since the first transporting member 211 presses the already aligned second medium 52, a motion of the already aligned second medium 52 can be suppressed.

21. When the first transporting member 211 is in the second position, the control portion 250 causes the second transporting member 212 to start the second transporting operation of transporting the first medium 51 upstream in the transport direction Y1. When the rear end of the first medium 51 reaches the first transporting member 211, the control portion 250 causes the first transporting member 211 to return to the first position from the second position and start the first transporting operation again. The first transporting member 211 can establish both of suppression of the motion of the already aligned second medium 52 by the second position of the first transporting member 211, and alignment of the first medium 51 by the first position of the first transporting member 211.

22. The control portion 250 causes the first transporting member 211 to return to the first position from the second position and start the first transporting operation again after the second transporting member 212 transports the first medium 51 by the predetermined amount. The control portion 250 can start the first transporting operation again before the rear end 51*c* of the first medium 51 reaches the first transporting member 211.

23. The printing system 11 regulates the first transporting operation of the first transporting member 211 based on the transporting state of the medium 50 detected by the detection portion 300 and the conditions of the parameters of the medium 50. The detection portion 300 acquires the transporting state of the first medium 51 near where the rear end 51*c* of the first medium 51 reaches the rear-end alignment portion 210*a*. Even when the time period required for the rear end of the medium 50 to reach the rear-end alignment portion 210*a* changes due to a change in coefficient of friction μ1*b* between media compared to when the medium 50 not containing water is aligned, the transporting state immediately before the rear end 51*c* of the first medium 51 reaches the rear-end alignment portion 210*a* is acquired. Thus, non-alignment of the medium 50 or buckling of the medium 50 caused by not transporting the first medium 51 or excessively transporting the first medium 51 can be accurately suppressed.

The present embodiment can be modified as follows. The present embodiment and modification examples below can be combined with each other without causing technical contradiction.

The detection portion 300 detecting the transporting state may be a sensor of a contact type coming into contact with the medium surface of the medium 50 like the thickness detection sensor 218 of the present embodiment, or may be a sensor of a contact type coming into contact with another part. For example, in a case of the sensor of the contact type, a sensor of a pressure-sensitive type or a strain gauge type may be used. A detection part of the sensor of the contact type may be disposed on an alignment surface of the rear-end alignment portion 210*a*, and a pressure when the rear end of the medium 50 reaches the rear-end alignment portion 210*a* may be detected by the sensor. When the sensor detects an instantaneous peak of the pressure, a determination that the rear end of the medium 50 has reached the rear-end alignment portion 210*a* may be made.

The detection portion 300 detecting the transporting state may be a sensor of a contact type coming into contact with the medium 50 like the thickness detection sensor 218 of the present embodiment, or may be a sensor of a non-contact type not coming into contact with the medium 50 like an electrostatic capacitive type or an optical type.

When a speed at which the medium 50 detected by the detection portion 300 detecting the transporting state is transported by the first transporting member 211 or the second transporting member 212, or a distance in which the medium 50 advances in a certain time period is less than or equal to a predetermined value, the control portion 250 may decrease the height of the first transporting member 211 before the rear end of the medium 50 reaches the rear-end alignment portion 210*a*.

The detection portion 300 detecting the transporting state may be a sensor detecting sound. The detection portion 300 may include a sound detection portion and an analysis portion performing frequency analysis, and the control portion 250 may determine, from a result of the frequency analysis of the sound detected by the detection portion 300, that the medium 50 has reached the rear-end alignment portion 210*a*.

When the detection portion 300 detecting the transporting state does not detect the rear end of the medium 50 within a predetermined time period, the control portion 250 may determine that such a state is a state where the rear end of the medium 50 will not reach the rear-end alignment portion 210*a*. That is, the control portion 250 may determine that jamming has occurred in the intermediate tray 210.

In addition to regulation of the first transporting operation of the first transporting member 211 based on detection of the transporting state of the medium 50 by the detection portion 300, the control portion 250 may be configured to decide the height of the first transporting member 211 in the first position in accordance with the parameters including the printing duty.

After the control portion 250 determines that the rear end 51*c* of the first medium 51 has abutted the reference surface of the rear-end alignment portion 210*a*, the control portion 250 may determine, from the output of the state detection sensor 217, that the rear end 51*c* of the first medium 51 has moved further upstream in the transport direction Y1 from the reference surface of the rear-end alignment portion 210*a*. In accordance with an amount of movement of the rear end 51*c* of the first medium 51, the control portion 250 may determine that non-alignment of the medium 50 or buckling of the medium 50 has occurred in the intermediate tray 210, and notify the user before the post-processing such as stapling is performed. The control portion 250 may determine that jamming has occurred in the intermediate tray 210, and before the post-processing such as stapling is performed, perform the processing for when jamming occurs. That is, the control portion 250 can detect non-alignment of the medium 50 or buckling of the medium 50 in the intermediate tray 210 earlier.

The post-processing device 200 may not include the transport path 17, and the intermediate tray 210 may be coupled to a transport path on a printing device 13 side. In this case, a transport roller pair of the printing device 13 discharging the medium 50 to the post-processing device 200 may be used as the intermediate discharge roller pair 202. In addition, a paper sheet detection sensor of the printing device 13 may be used as the reception sensor 203.

While the first transporting member 211 includes the first blades 211*a*, 211*b*, and 211*c* in a range of a half periphery of the first rotation center 211*e* on a front surface of the first core 211*d*, the first transporting member 211 may include the first blades in a range of the entire periphery.

While the first transporting member 211 includes three first blades 211*a*, 211*b*, and 211*c*, the number of first blades is not limited. The number of first blades is normally in a range of three to six.

When the position of the first transporting member 211 is the second position, the angle of the first transporting member 211 is not limited to the angle of the present embodiment.

While the second transporting member 212 includes three second blades 212*a*, 212*b*, and 212*c*, the number of second blades is not limited. The number of second blades is normally in a range of three to six.

The first transporting member 211 and the second transporting member 212 may be rollers. The first medium 51 can be transported with a weak force by using a material such as sponge-shaped low-friction silicone of which a coefficient of friction can be set between coefficients of friction of resin and rubber. By causing the first medium 51 to slip between the medium surface of the first medium 51 and a roller front surface, the first medium 51 is not buckled when the rear end 51*c* of the first medium 51 abuts the rear-end alignment portion 210*a*.

While the second transporting member 212 includes the second blades 212*a*, 212*b*, and 212*c* in a range of a half periphery of a second rotation center 212*e*, the second transporting member 212 may include the second blades in a range of the entire periphery. When the second blades are included in the range of the entire periphery, any of the second blades comes into contact with the front surface 51*a* of the first medium 51 regardless of an angle of the second transporting member 212. Thus, a motor that changes a height of the second transporting member 212 upward and downward is added to the configuration. At this point, the second blades of the second transporting member 212 are configured to not come into contact with the front surface 51*a* of the first medium 51 by increasing the height of the second transporting member 212.

A transport belt along which the first medium 51 is transported while the first medium 51 clings by air suction may be included above the intermediate tray 210 on a line extended from the transport path 17. In this case, the transport belt transports the first medium 51 to a position at which the rear end 51*c* of the first medium 51 does not abut the first blades 211*a*, 211*b*, and 211*c* of the first transporting member 211, and the first medium 51 is caused to fall by stopping a flow of air for clinging of the medium.

As a method of regulating the first transporting operation, the first transporting member 211 may stop rotating at an appropriate number of rotations at a position at which the first transporting member 211 does not abut the first medium 51. Non-alignment of the medium 50 or buckling of the medium 50 caused by not transporting the first medium 51 or excessively transporting the first medium 51 can be suppressed.

As a method of regulating the first transporting operation, the height of the first transporting member 211 may be increased to a position at which the first transporting member 211 does not abut the first medium 51.

Regulation of the first transporting operation may be performed a plurality of times for the first medium 51. For example, when the rear end 51*c* of the first medium 51 reaches the rear-end alignment portion 210*a*, the control portion 250 slightly weakens a force of transporting the first medium 51 by the first transporting member 211 by slightly increasing a height of the first rotation center 211*e* of the first transporting member 211. This is first regulation of the first transporting operation. Accordingly, excessive transporting of the first medium 51 by the first transporting member 211 can be suppressed. Then, the side-end alignment members 215 align the side ends of the first medium 51. When alignment of the side ends of the first medium 51 is finished and alignment of the rear end 51*c* of the first medium 51 to the rear-end alignment portion 210*a* by the first transporting member 211 is finished, the first transporting member 211 changes the position of the first transporting member 211 to the second position. This is second regulation of the first transporting operation.

When the rear end of the medium 50 reaches the rear-end alignment portion 210*a*, the control portion 250 may change the first transporting member 211 from the first position to the third position for separation from the medium 50 on the intermediate tray 210, by increasing the height of the first transporting member 211.

Instead of changing the position of the first transporting member 211 to the second position, a member pressing a rear end part of the second medium 52 may be disposed, and the first transporting member 211 may be configured to be separated from the medium 50 while the member pressing the rear end part of the second medium 52 presses the rear end part of the second medium 52. Furthermore, when the detection portion 300 detecting the transporting state detects the front end of the medium 50, the member pressing the rear end part of the second medium 52 may stop a pressing operation and recede from a path of passage of the medium 50 on the intermediate tray 210, and the first transporting member 211 may start the first transporting operation again.

The post-processing device 200 may not include the control portion 250, and the printing device control portion 60 may be configured to perform the entire control.

The printing device 13 and the post-processing device 200 may not have separate casings and may be configured to have an integrated casing.

The control portion 250 measures a required time period from when the medium 50 on which a test pattern is printed is transported into the intermediate tray 210 and the second transporting operation of the second transporting member 212 is started until the state detection sensor 217 detects the rear end of the medium 50 reaching the rear-end alignment portion 210*a*. Based on a difference between the measured required time period and a standard time period, the control portion 250 may be configured to change at least one of the first necessary number of rotations, the height of the first transporting member 211, and the second necessary number of rotations with reference to a correction table set in advance. The standard time period is a time period set for the rear end of the medium 50 to exactly reach the rear-end alignment portion 210*a* when an item as a target of change is at a standard value thereof.

The front surface of the medium 50 may be divided into a plurality of areas, and water content ratios of the plurality of areas may be calculated. A magnitude of unevenness of the water content ratios of the plurality of areas may be used as a parameter. When the unevenness of the water content ratios of the plurality of areas is high, the medium 50 is easily warped or distorted in not only the transport direction Y1 but also the width direction X. Thus, when the medium 50 falls onto the intermediate tray 210, skewing is increased, and there is a concern that it takes time to align the rear end. When a convex portion occurs due to distortion of the medium 50, the pushing force F31 is increased due to concentration of a force on the convex portion. Thus, an effect of the second position for pressing the first medium 51 is increased.

As the information related to the printing time period of the medium 50, the printing device control portion 60 may notify the control portion 250 of the post-processing device 200 of a printing finish time for the front surface of the medium 50 and a printing finish time for the back surface of the medium 50. The control portion 250 can estimate a time period elapsing until an operation of transporting the medium 50 into the post-processing device 200, and calculate the elapsed time period from printing by adding the estimated time period. The information related to the printing time period of the medium 50 is not limited to this information as long as the information enables the control portion 250 to calculate the elapsed time period from printing. The control portion 250 may notify a printing start time of the medium 50 as the information related to the printing time period of the medium 50.

The printing device control portion 60 may not notify the control portion 250 of the transport time period in the medium 50 printed with liquid ejected by the liquid ejecting portion 27. The control portion 250 of the post-processing device 200 may calculate the transport time period by causing the printing device control portion 60 to notify the control portion 250 of the job content.

The printing device control portion 60 may notify the printing duty by dividing the front surface and the back surface of the medium 50 into a plurality of sections. In this case, the printing device control portion 60 may notify the printing finish time or the printing start time for printing in each section.

As the information related to the printing time period of the medium 50, the printing device control portion 60 may notify an elapsed time period from finish of printing on the front surface of the medium 50 and an elapsed time period from finish of printing on the back surface of the medium 50. The control portion 250 can estimate the time period elapsing until the operation of transporting the medium 50 into the post-processing device 200, and calculate the elapsed time period from printing by adding the estimated time period.

In the present embodiment, the control portion 250 uses the front surface duty and the back surface duty when the length of the medium 50 in the transport direction Y1 is short, and uses the contact portion front surface duty and the contact portion back surface duty when the length of the medium 50 in the transport direction Y1 is long. However, both of the duties of the entire medium surface and the contact portion of the medium 50 may be used.

The contact portion duty may be the printing duty of a part with which the first transporting member 211 comes into contact, or the printing duty of a part with which the second transporting member 212 comes into contact.

When the printing duty is high, the coefficient of friction $\mu 1b$ between the first medium 51 and the second medium 52 is increased, and the medium 50 is not easily transported. However, since high printing quality is required for the medium 50 having a high printing duty, the height of the first transporting member 211 may be set to be greater than a standard in order not to make a rub mark of the first transporting member 211 on the medium surface, and instead, a further large number of rotations of the first transporting member 211 may be set. While productivity is decreased due to a long time period for transporting the medium 50, the post-processing device 200 can output a printed matter having high printing quality.

In the present embodiment, the control portion 250 uses the control tables. However, the first necessary number of rotations, the second necessary number of rotations, and the height of the first transporting member 211 in the first position may be obtained using a calculation expression or a conditional expression having the parameters as variables.

The first necessary number of rotations and the second necessary number of rotations change depending on the type of medium 50. A plurality of control tables corresponding to a representative type of medium 50 may be prepared, and a service technician may switch the control tables by operating the operation portion 62.

The post-processing device 200 may include a mechanism enabling the service technician to change the height of the first transporting member 211.

Hereinafter, technical ideas and effects thereof recognized from the above embodiments and the modification examples will be described.

A. A post-processing device includes a transport path along which a medium printed by a liquid ejecting portion included in a printing device is transported, a processing tray on which the medium transported by the transport path is stacked, a first transporting member that is disposed in the processing tray and that starts a first transporting operation of transporting the medium upstream in a transport direction after a rear end of the medium passes through the transport path, a rear-end alignment portion that comes into contact with the rear end of the medium transported by the first transporting member and that aligns the medium, a control portion controlling an operation of the first transporting member, and a detection portion detecting a transporting state of the medium in the processing tray, in which when the control portion determines, from an output of the detection portion, that the medium reaches the rear-end alignment portion, the control portion regulates the first transporting operation of the first transporting member.

According to this configuration, the control portion controls the first transporting operation by acquiring a state of the medium when the medium is transported, and the state of the medium when the rear end of the medium reaches the rear-end alignment portion. In addition, the control portion continues detecting the transporting state of the medium from when the medium is transported until the first transporting operation is regulated. When the medium printed with liquid ejected by the liquid ejecting portion is aligned, frictional resistance between the medium transported by the first transporting member and the medium stacked earlier on the processing tray changes in the processing tray in accordance with the condition of the parameter. Even when a time period required for the rear end of the medium to reach the rear-end alignment portion changes due to a change in frictional resistance between media, the control portion regulates the first transporting operation when the control portion determines, from the transporting state of the medium detected by the detection portion, that the rear end of the medium reaches the rear-end alignment portion. Furthermore, the control portion 250 regulates the first transporting operation by acquiring the state of the first medium 51 from when the rear end 51*c* of the first medium 51 passes through the capturing area of the state detection sensor 217 until the rear end 51*c* of the first medium 51 reaches the rear-end alignment portion 210*a*. Thus, non-alignment of the medium or buckling of the medium caused by not transporting the medium or excessively transporting the medium can be suppressed.

B. In the post-processing device, the detection portion may include a light source irradiating a front surface of the medium and a capturing portion capturing a pattern of the front surface using reflected light from the medium, and the detection portion may output a movement amount and a movement direction of the medium from two patterns captured at a time interval by the capturing portion.

According to this configuration, the control portion can determine that the rear end of the medium reaches the rear-end alignment portion, by detecting the movement amount and the movement direction of the medium from two patterns captured at a time interval. Thus, the control portion can accurately regulate the first transporting operation of the first transporting member. When a position at which the detection portion captures an image is a position downstream of the first transporting member in the transport direction, the control portion can calculate a time at which the rear end of the medium reaches the first transporting member. In addition, the control portion can determine, from images captured at a time interval, that the rear end of the medium actually reaches the first transporting member. Furthermore, when the rear end of the medium actually reaches the first transporting member, the first transporting operation of the first transporting member can be started. In this case, the first transporting operation of the first transporting member can be further accurately regulated.

C. In the post-processing device, when the control portion determines, from the output, that the medium is skewed, the control portion may change a transporting amount of the first transporting member in accordance with a skew amount of the medium.

According to this configuration, when the first medium on which the first transporting member is performing the first transporting operation is skewed, a skew of the medium is corrected by causing the control portion to change the transporting amount of the first transporting member. Non-alignment of the medium or buckling of the medium caused by the skew of the medium transported by the first transporting member can be suppressed.

D. The post-processing device may further include a first rotation motor rotationally driving the first transporting member, in which the detection portion is a detection portion detecting a current value of the first rotation motor, and a determination that the medium reaches the rear-end alignment portion is made when the current value exceeds a predetermined threshold.

According to this configuration, when the medium printed with liquid ejected by the liquid ejecting portion is aligned, frictional resistance between the medium transported by the first transporting member and the medium stacked earlier on the processing tray changes in the processing tray in accordance with the condition of the parameter. Even when a time period required for the rear end of the medium to reach the rear-end alignment portion changes due to a change in frictional resistance between media, the control portion determines that the rear end of the medium reaches the rear-end alignment portion, by detecting the transporting state of the medium. When the control portion determines that the rear end of the medium reaches the rear-end alignment portion, the control portion regulates the first transporting operation. Thus, the control portion can accurately detect the transporting state of the medium and can accurately determine that the rear end of the medium reaches the first transporting member.

E. The post-processing device includes a transport path along which a medium printed by a liquid ejecting portion included in a printing device is transported, a processing tray on which the medium transported by the transport path is stacked, a first transporting member that is disposed in the processing tray and that starts a first transporting operation of transporting the medium upstream in a transport direction after a rear end of the medium passes through the transport path, a rear-end alignment portion that comes into contact with the rear end of the medium transported by the first transporting member and that aligns the medium, a control portion controlling an operation of the first transporting member, and a detection portion detecting a transporting state of the medium in the processing tray, in which the control portion regulates the first transporting operation of the first transporting member based on the transporting state of the medium and a condition of a parameter of the medium.

According to this configuration, the detection portion acquires the transporting state of the medium near where the rear end of the medium reaches the rear-end alignment portion. When the medium printed with liquid ejected by the liquid ejecting portion is aligned, frictional resistance between the medium transported by the first transporting member and the medium stacked earlier on the processing tray changes in the processing tray in accordance with the condition of the parameter. Even when a time period required for the rear end of the medium to reach the rear-end alignment portion changes due to a change in frictional resistance between media, the control portion acquires the transporting state immediately before the rear end of the medium reaches the rear-end alignment portion. The control portion regulates the first transporting operation of the first transporting member based on the transporting state and the condition of the parameter. Thus, non-alignment of the medium or buckling of the medium caused by not transporting the medium or excessively transporting the medium can be accurately suppressed.

F. In the post-processing device, the detection portion may be a sensor detecting passage of a rear end portion of the medium, and the control portion may detect the transporting state of the medium based on information about the passage of the end portion of the medium detected by the sensor.

According to this configuration, the detection portion acquires the transporting state of the medium by detecting passage of the rear end of the medium near where the rear end of the medium reaches the rear-end alignment portion. The passage of the rear end of the medium can be detected immediately before the rear end of the medium reaches the rear-end alignment portion.

G. In the post-processing device, the detection portion may be a sensor detecting a cumulative thickness of the medium stacked on the processing tray, the sensor may be disposed at an end portion upstream in the transport direction above the processing tray, and when the medium is transported by the first transporting member, the control portion may detect the transporting state of the medium based on an increase in cumulative thickness of the medium stacked on the processing tray.

According to this configuration, when the output of the detection portion is discontinuously increased, the control portion determines that the number of sheets of the medium is increased by one. Thus, the control portion can accurately detect the passage of the rear end of the medium immediately before the rear end of the medium reaches the rear-end alignment portion. When the output of the detection portion is discontinuously increased and the increase is greater than or equal to a thickness of two sheets of the medium, the control portion determines that a medium of which a front end is folded is transported. Thus, the post-processing device can be stopped before post-processing such as stapling is performed, and a user can be notified. When the output of the detection portion exceeds a predetermined thickness, the control portion determines that the processing tray is blocked due to curling or buckling of the transported medium. Thus, the post-processing device can be stopped before the post-processing such as stapling is performed, and the user can be notified.

H. In the post-processing device, the control portion may be configured to regulate the first transporting operation when a first cumulative number of rotations after the rear end of the medium passes through the detection portion reaches a first necessary number of rotations necessary for aligning the rear end of the medium to the rear-end alignment portion, and the control portion may decide the first necessary number of rotations in accordance with a detection result of the transporting state of the medium and the condition of the parameter.

According to this configuration, when the medium printed with liquid ejected by the liquid ejecting portion is aligned, frictional resistance between the medium transported by the first transporting member and the medium stacked earlier on the processing tray changes in the processing tray in accordance with the condition of the parameter. Thus, a time period required for the rear end of the medium to reach the rear-end alignment portion changes due to a change in frictional resistance between media. Thus, the control portion sets an appropriate first necessary number of rotations in accordance with the condition of the parameter. Thus, when the medium is aligned in the processing tray, non-alignment of the medium caused by the rear end of the medium not reaching the rear-end alignment portion or buckling of the medium caused by transporting the rear end of the medium even after the rear end of the medium reaches the rear-end alignment portion can be suppressed.

I. In the post-processing device, the control portion may use at least one of a temperature of an environment in which the printing device is installed, humidity of the environment in which the printing device is installed, a size of the medium, a basis weight of the medium, and the number of sheets of the medium stacked on the processing tray, as the parameter.

According to this configuration, when the temperature of the environment is low, liquid clinging to the medium does not easily dry, and the frictional resistance between media is increased. In addition, when the humidity of the environment is high, liquid clinging to the medium does not easily dry, and the frictional resistance between media is increased. Furthermore, as the size of the medium is increased, an area of contact between media is increased. Thus, the frictional resistance when the medium is moved is increased. In addition, as the basis weight of the medium is increased, a weight of the medium is increased. Thus, the frictional resistance between media is increased when the first transporting member performs transporting. In addition, as the number of sheets of the medium stacked on the processing tray is increased, a stack height of a media bundle is increased, and the medium as a transporting target approaches the first transporting member. Accordingly, since a pressing force when the first transporting member transports the medium is increased, the frictional resistance between media is increased. The control portion appropriately changes the first necessary number of rotations in accordance with at least one of the parameters of the temperature of the environment, the humidity of the environment, the size of the medium, the basis weight of the medium, and the number of sheets of the medium stacked on the processing tray. Thus, when the medium is aligned in the processing tray, non-alignment of the medium or buckling of the medium can be suppressed.

J. In the post-processing device, the control portion may use at least one of an elapsed time period from a start of printing on the medium by the liquid ejecting portion until the first transporting member starts the first transporting operation of transporting the medium, a standby time period after printing in the medium printed by the liquid ejecting portion, and a liquid ejecting amount, per area, of liquid ejected to the medium by the liquid ejecting portion, as the parameter.

According to this configuration, as the elapsed time period from printing on the medium until the first transporting operation is started is shortened, the standby time period of the printed medium is lengthened, or the liquid ejecting amount per area is increased, dryness of the liquid clinging to or permeating the medium tends to be decreased. When the dryness of the liquid is low, the frictional resistance between media is increased. The control portion appropriately changes the first necessary number of rotations in accordance with at least one of the parameters of the elapsed time period, the standby time period, and the liquid ejecting amount per area. Thus, when the medium is aligned in the processing tray, non-alignment of the medium or buckling of the medium can be suppressed.

K. In the post-processing device, the elapsed time period may be at least one of a printing time period in the medium printed by the liquid ejecting portion, a transport time period in the medium printed by the liquid ejecting portion, and a transport pitch time period of the medium from a start of the first transporting operation until a subsequent start of the first transporting operation.

According to this configuration, as at least one of the printing time period, the transport time period, and the transport pitch time period is shortened, a state where dryness of the medium is low and a water content state of a medium surface is still degraded is set, and the frictional resistance between media is high. Thus, the control portion can suppress non-alignment of the medium or buckling of the medium by appropriately changing the first necessary number of rotations in accordance with at least one of the parameters of the printing time period, the transport time period, and the transport pitch time period.

L. In the post-processing device, the control portion may use at least one of the standby time period, the liquid ejecting amount of the liquid per area, and a size of the medium, as the parameter, and as a numerical value of the parameter is increased, the first necessary number of rotations may be increased.

According to this configuration, when the standby time period is long, a long drying time period of the medium needs to be secured. Thus, a state where the water content state of the medium surface is still degraded is set, and the frictional resistance between media is high. In addition, when the liquid ejecting amount per area is large, a state where the water content state of the medium surface is still degraded is set, and the frictional resistance between media is high. Furthermore, when the size of the medium is large, the area of contact is large. Thus, the frictional resistance between media is high. The control portion can suppress non-alignment of the medium or buckling of the medium by increasing the first necessary number of rotations as a numerical value of at least one of the parameters of the standby time period, the liquid ejecting amount per area, and the size of the medium is increased.

M. In the post-processing device, when a surface on the processing tray side in a case where the medium is stacked on the processing tray is a back surface, and the medium on which the first transporting member performs the first transporting operation is a first medium, the control portion may use the liquid ejecting amount per area for a back surface of the first medium and a size of the first medium, as the parameter.

According to this configuration, when the liquid ejecting amount per area is large, the frictional resistance between media is increased due to degradation of the water content state of the medium surface. Thus, a force of close contact between media is increased. The liquid ejecting amount per area is a parameter most affecting a state of the medium surface. When the size of the medium is large, resistance when the medium is moved is increased. That is, even when the size of the medium changes, the control portion can suppress non-alignment of the medium or buckling of the medium using a small number of parameters.

N. In the post-processing device, when a surface on the processing tray side in a case where the medium is stacked on the processing tray is a back surface, and the medium on which the first transporting member performs the first transporting operation is a first medium, the control portion may use the liquid ejecting amount per area for a back surface of the first medium and humidity of an environment in which the printing device is installed, as the parameter.

According to this configuration, when the liquid ejecting amount per area is large, the frictional resistance between media is increased due to degradation of the water content state of the medium surface. Thus, a force of close contact between media is increased. The liquid ejecting amount per area is a parameter most affecting the water content state of the medium surface. When environmental humidity is high, the force of close contact between media is increased. That is, even when the environmental humidity changes, the control portion can suppress non-alignment of the medium or buckling of the medium using a small number of parameters.

O. In the post-processing device, when a surface on an opposite side from the surface on the processing tray side in a case where the medium is stacked on the processing tray is a front surface, the medium on which the first transporting member performs the first transporting operation is a first medium, and the medium stacked uppermost on the processing tray in a case where the first transporting member performs the first transporting operation is a second medium, the control portion may use the liquid ejecting amount per area for a back surface of the first medium, the liquid ejecting amount per area for a front surface of the second medium, a back surface elapsed time period of the first medium, and a front surface elapsed time period of the second medium, as the parameter.

According to this configuration, the control portion can perform control by accurately recognizing a change in force of close contact between media that is generated between a water content state of the back surface of the first medium and a water content state of the front surface of the second medium when the first transporting member performs the first transporting operation. That is, the control portion can suppress non-alignment of the medium or buckling of the medium by accurate control corresponding to water content states of both contact surfaces of the medium and an area to which the liquid is ejected.

P. In the post-processing device, when the medium on which the first transporting member performs the first transporting operation is a first medium, and a position in which the first transporting member transports the first medium is a first position, the control portion may decide, in accordance with the condition of the parameter, a height of the first transporting member that is a distance between a rotation center of the first transporting member and a bottom surface of the processing tray on which the medium is stacked.

According to this configuration, the control portion can appropriately adjust a force of transporting the first medium by deciding the height of the first transporting member in the first position in accordance with the condition of the parameter. Non-alignment of the medium or buckling of the medium can be suppressed by appropriately deciding the force of transporting the first medium.

Q. In the post-processing device, when the control portion determines, from the transporting state of the medium, that the medium reaches the rear-end alignment portion, the control portion may change the first transporting member to a second position for pressing the medium by the first transporting member by stopping the first transporting operation of the first transporting member and decreasing a height of the first transporting member.

According to this configuration, since the first transporting member presses the already aligned medium, a motion of the already aligned medium can be suppressed.

R. In the post-processing device, when the medium on which the first transporting member performs the first transporting operation is a first medium, and the medium stacked uppermost on the processing tray in a case where the first transporting member performs the first transporting operation is a second medium, the processing tray may include a second transporting member disposed downstream in the transport direction from the first transporting member, and when a position in which the first transporting member transports the first medium is a first position, the control portion may be configured to cause the second transporting member to start a second transporting operation of transporting the first medium upstream in the transport direction when the first transporting member is in the second position, and cause the first transporting member to return to the first position from the second position and start the first transporting operation again until a rear end of the first medium reaches the first transporting member.

According to this configuration, the first transporting member can establish both of suppression of the motion of the already aligned second medium by the second position of the first transporting member, and alignment of the first medium by the first position of the first transporting member.

S. In the post-processing device, the control portion may be configured to cause the first transporting member to return to the first position from the second position and start the first transporting operation again after the second transporting member transports the first medium by a predetermined amount.

According to this configuration, the control portion can start the first transporting operation again before the rear end of the medium reaches the first transporting member.

T. A printing system includes a transport path along which a medium printed by a liquid ejecting portion included in a printing device is transported, a processing tray on which the medium transported by the transport path is stacked, a first transporting member that is disposed in the processing tray and that starts a first transporting operation of transporting the medium upstream in a transport direction after a rear end of the medium passes through the transport path, a rear-end alignment portion that comes into contact with the rear end of the medium transported by the first transporting member and that aligns the medium, a control portion controlling an operation of the first transporting member, and a detection portion detecting a transporting state of the medium in the processing tray, in which when the control portion determines, from an output of the detection portion, that the medium reaches the rear-end alignment portion, the control portion regulates the first transporting operation of the first transporting member.

According to this configuration, the control portion controls the first transporting operation when the control portion determines, from the transporting state of the medium detected by the detection portion, that the rear end of the medium reaches the rear-end alignment portion. In addition, the control portion continues detecting the transporting state of the medium from when the medium is transported until the first transporting operation is regulated. When the medium printed with liquid ejected by the liquid ejecting portion is aligned, frictional resistance between the medium transported by the first transporting member and the medium stacked earlier on the processing tray changes in the processing tray in accordance with the condition of the parameter. In addition, even when a time period for the rear end of the medium to reach the rear-end alignment portion is lengthened by an increase in frictional resistance between media, the control portion regulates the first transporting operation by acquiring the state of the medium when the rear end of the medium reaches the rear-end alignment portion. Thus, the printing system can suppress non-alignment of the medium or buckling of the medium caused by not transporting the medium or excessively transporting the medium.

U. The printing system includes a transport path along which a medium printed by a liquid ejecting portion included in a printing device is transported, a processing tray on which the medium transported by the transport path is stacked, a first transporting member that is disposed in the processing tray and that starts a first transporting operation of transporting the medium upstream in a transport direction after a rear end of the medium passes through the transport path, a rear-end alignment portion that comes into contact with the rear end of the medium transported by the first transporting member and that aligns the medium, a control portion controlling an operation of the first transporting member, and a detection portion detecting a transporting state of the medium in the processing tray, in which the control portion regulates the first transporting operation of the first transporting member based on the transporting state of the medium and a condition of a parameter of the medium.

According to this configuration, the detection portion acquires the transporting state of the medium near where the rear end of the medium reaches the rear-end alignment portion. When a medium containing water is aligned, a coefficient of friction between media is increased compared to when a medium not containing water is aligned. Even when a time period for the rear end of the medium to reach the rear-end alignment portion is lengthened by an increase in coefficient of friction between media, the control portion acquires the transporting state immediately before the rear end of the medium reaches the rear-end alignment portion. Thus, non-alignment of the medium or buckling of the medium caused by not transporting the medium or excessively transporting the medium can be accurately suppressed.

What is claimed is:

1. A post-processing device comprising:

a transport path along which a medium printed by a liquid ejecting portion is transported;

a processing tray on which the medium transported by the transport path is stacked;

a first transporting member that is disposed in the processing tray and configured to start a first transporting operation of transporting the medium upstream in a transport direction after a rear end of the medium passes through the transport path;

a rear-end alignment portion configured to:

come into contact with the rear end of the medium transported by the first transporting member; and align the medium;

a control portion configured to control an operation of the first transporting member; and a detection portion configured to detect a transporting state of the medium in the processing tray, wherein when the control portion determines, from an output of the detection portion, that the medium reaches the rear-end alignment portion, the control portion is further configured to regulate the first transporting operation of the first transporting member, and when the control portion determines, from the transporting state of the medium, that the medium reaches the rear-end alignment portion, the control portion is further configured to stop the first transporting operation of the first transporting member, decrease a height of the first transporting member, and change the first transporting member to a second position for pressing the medium by the first transporting member.

2. The post-processing device according to claim 1, wherein the detection portion includes a light source configured to irradiate a front surface of the medium, and a capturing portion configured to capture a pattern of the front surface using reflected light from the medium, and the detection portion is further configured to output a movement amount and a movement direction of the medium from two patterns captured at a time interval by the capturing portion.

3. The post-processing device according to claim 1, wherein when the control portion determines, from the output, that the medium is skewed, the control portion is further configured to change a transporting amount of the first transporting member in accordance with a skew amount of the medium.

4. The post-processing device according to claim 1, further comprising:

a first rotation motor configured to rotationally drive the first transporting member, wherein the detection portion is further configured to:

detect a current value of the first rotation motor; and determine that the medium reaches the rear-end alignment portion when the current value exceeds a predetermined threshold.

5. The post-processing device according to claim 1, wherein when the medium on which the first transporting member performs the first transporting operation is a first medium, and the medium stacked uppermost on the processing tray in a case where the first transporting member performs the first transporting operation is a second medium, the processing tray includes a second transporting member disposed downstream in the transport direction from the first transporting member, and when a position in which the first transporting member transports the first medium is a first position, the control portion is further configured to cause the second transporting member to start a second transporting operation of transporting the first medium upstream in the transport direction when the first transporting member is in the second position, and before a rear end of the first medium reaches the first transporting member, cause the first transporting member to return to the first position from the second position and start the first transporting operation.

6. The post-processing device according to claim 5, wherein the control portion is further configured to, after the second transporting member transports the first medium by a predetermined amount, cause the first transporting member to return to the first position from the second position and start the first transporting operation.

7. A post-processing device comprising:

a transport path along which a medium printed by a liquid ejecting portion included in a printing device is transported;

a processing tray on which the medium transported by the transport path is stacked;

a first transporting member that is disposed in the processing tray and configured to start a first transporting operation of transporting the medium upstream in a transport direction after a rear end of the medium passes through the transport path;

a rear-end alignment portion configured to:

come into contact with the rear end of the medium transported by the first transporting member; and align the medium;

a control portion configured to control an operation of the first transporting member; and a detection portion configured to detect a transporting state of the medium in the processing tray, wherein the control portion is further configured to regulate the first transporting operation of the first transporting member based on the transporting state of the medium and a condition of a parameter of the medium, and when the control portion determines, from the transporting state of the medium, that the medium reaches the rear-end alignment portion, the control portion is further configured to stop the first transporting operation of the first transporting member, decrease a height of the first transporting member, and change the first transporting member to a second position for pressing the medium by the first transporting member.

8. The post-processing device according to claim 7, wherein the detection portion is a sensor configured to detect passage of an end portion of the medium, and the control portion is further configured to detect the transporting state of the medium based on information about the passage, detected by the sensor, of the end portion of the medium.

9. The post-processing device according to claim 7, wherein the detection portion is a sensor configured to detect a cumulative thickness of the medium stacked on the processing tray, the sensor is disposed at an end portion upstream in the transport direction above the processing tray, and when the medium is transported by the first transporting member, the control portion is further configured to detect the transporting state of the medium based on an increase in cumulative thickness of the medium stacked on the processing tray.

10. The post-processing device according to claim 7, wherein the control portion is further configured to:

regulate the first transporting operation when a first cumulative number of rotations after the rear end of the medium passes through the detection portion reaches a first necessary number of rotations necessary for aligning the rear end of the medium to the rear-end alignment portion, and decide the first necessary number of rotations in accordance with a detection result of the transporting state of the medium and the condition of the parameter.

11. The post-processing device according to claim 10, wherein the control portion is further configured to use, as the parameter, at least one of a temperature of an environment in which the printing device is installed, humidity of the environment in which the printing device is installed, a size of the medium, a basis weight of the medium, and a number of sheets of the medium stacked on the processing tray.

12. The post-processing device according to claim 10, wherein the control portion is further configured to use, as the parameter, at least one of an elapsed time period from a start of printing on the medium by the liquid ejecting portion until the first transporting member starts the first transporting operation of transporting the medium, a standby time period after printing in the medium printed by the liquid ejecting portion, and a liquid ejecting amount, per area, of liquid ejected to the medium by the liquid ejecting portion.

13. The post-processing device according to claim 12, wherein the elapsed time period is at least one of a printing time period in the medium printed by the liquid ejecting portion, a transport time period in the medium printed by the liquid ejecting portion, and a transport pitch time period of the medium from the start of the first transporting operation until a subsequent start of the first transporting operation.

14. The post-processing device according to claim 12, wherein the control portion is further configured to use, as the parameter, at least one of the standby time period, the liquid ejecting amount of the liquid per area, and a size of the medium, and as a numerical value of the parameter is increased, the first necessary number of rotations is increased.

15. The post-processing device according to claim 12, wherein when a surface on the processing tray side in a case where the medium is stacked on the processing tray is a back surface, and the medium on which the first transporting member performs the first transporting operation is a first medium, the control portion is further configured to use, as the parameter, the liquid ejecting amount per area for a back surface of the first medium and a size of the first medium.

16. The post-processing device according to claim 12, wherein when a surface on the processing tray side in a case where the medium is stacked on the processing tray is a back surface, and the medium on which the first transporting member performs the first transporting operation is a first medium, the control portion is further configured to use, as the parameter, the liquid ejecting amount per area for a back surface of the first medium and humidity of an environment in which the printing device is installed.

17. The post-processing device according to claim 10, wherein when the medium on which the first transporting member performs the first transporting operation is a first medium, and a position in which the first transporting member transports the first medium is a first position, the control portion is further configured to decide, in accordance with the condition of the parameter, a height of the first transporting member that is a distance between a rotation center of the first transporting member and a bottom surface of the processing tray on which the medium is stacked.

18. A printing system comprising:

a transport path along which a medium printed by a liquid ejecting portion is transported;

a processing tray on which the medium transported by the transport path is stacked;

a first transporting member that is disposed in the processing tray and configured to start a first transporting operation of transporting the medium upstream in a transport direction after a rear end of the medium passes through the transport path;

a rear-end alignment portion configured to:

come into contact with the rear end of the medium transported by the first transporting member; and align the medium;

a control portion configured to control an operation of the first transporting member; and a detection portion configured to detect a transporting state of the medium in the processing tray, wherein when the control portion determines, from an output of the detection portion, that the medium reaches the rear-end alignment portion, the control portion is further configured to regulate the first transporting operation of the first transporting member, and when the control portion determines, from the transporting state of the medium, that the medium reaches the rear-end alignment portion, the control portion is configured to stop the first transporting operation of the first transporting member, decrease a height of the first transporting member, and change the first transporting member to a second position for pressing the medium by the first transporting member.

* * * * *